US006937222B2

(12) United States Patent
Numao

(10) Patent No.: US 6,937,222 B2
(45) Date of Patent: Aug. 30, 2005

(54) DISPLAY, PORTABLE DEVICE, AND SUBSTRATE

(75) Inventor: Takaji Numao, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 333 days.

(21) Appl. No.: 10/034,251

(22) Filed: Jan. 3, 2002

(65) Prior Publication Data

US 2002/0093472 A1 Jul. 18, 2002

(30) Foreign Application Priority Data

Jan. 18, 2001 (JP) ..... 2001-010866
May 15, 2001 (JP) ..... 2001-145517
Jun. 29, 2001 (JP) ..... 2001-200074

(51) Int. Cl.[7] ..... G09G 3/36
(52) U.S. Cl. ..... 345/98; 345/82
(58) Field of Search ..... 345/90, 91, 92, 345/96, 97, 204, 205, 206, 207, 76, 82, 98, 89

(56) References Cited

U.S. PATENT DOCUMENTS

| | | | | | |
|---|---|---|---|---|---|
| 4,996,523 | A | | 2/1991 | Bell et al. | |
| 5,798,746 | A | | 8/1998 | Koyama | |
| 5,945,194 | A | * | 8/1999 | Pester | 428/120 |
| 5,945,972 | A | * | 8/1999 | Okumura et al. | 345/98 |
| 5,952,991 | A | * | 9/1999 | Akiyama | 345/98 |
| 6,157,356 | A | * | 12/2000 | Troutman | 345/82 |
| 6,636,194 | B2 | * | 10/2003 | Ishii | 345/98 |
| 2003/0058200 | A1 | * | 3/2003 | Numao | 345/76 |

FOREIGN PATENT DOCUMENTS

| | | |
|---|---|---|
| JP | 63-226178 | 9/1988 |
| JP | 02-148687 | 6/1990 |
| JP | 5-289635 A | 11/1993 |
| JP | 06-067151 | 3/1994 |
| JP | 07-056143 | 3/1995 |
| JP | 07-253764 | 10/1995 |
| JP | 08-194205 | 7/1996 |
| JP | 08-237578 | 9/1996 |
| JP | 08-250749 | 9/1996 |
| JP | 08-286170 | 11/1996 |
| JP | 09-212140 | 8/1997 |
| JP | 11-002797 | 1/1999 |
| JP | 11-295700 | 10/1999 |
| JP | 2000-221942 | 8/2000 |
| JP | 2000-227608 | 8/2000 |
| JP | 2000-227782 | 8/2000 |
| JP | 2000-347623 | 12/2000 |
| JP | 2001-147676 | 5/2001 |
| JP | 2002-132217 | 5/2002 |
| JP | 2002-175040 | 6/2002 |
| JP | 2002-202755 | 7/2002 |
| JP | 2002-278499 | 9/2002 |
| WO | WO 00/08625 | 2/2000 |

OTHER PUBLICATIONS

Chinese Office Action mailed Oct. 10, 2003 in corresponding Chinese patent application No. 02102329.8 and English translation thereof.
Korean Office Action mailed Jul. 28, 2004 (w/English translation thereof).
Japanese Office Action mailed Oct. 5, 2004 (w/English translation thereof).

* cited by examiner

*Primary Examiner*—Xiao Wu
*Assistant Examiner*—Kevin M. Nguyen
(74) *Attorney, Agent, or Firm*—Nixon & Vanderhye P.C.

(57) ABSTRACT

A memory circuit is caused to retain a voltage corresponding to largest tone data, then a voltage corresponding to tone data except for the largest tone data is applied to a liquid crystal element, and the voltage corresponding to the largest tone data is supplied from the memory circuit to the liquid crystal element. The development of moving picture break-ups can be suppressed with a display producing a time-division gray-scale display, without having to carry out a display scanning operation for every display.

16 Claims, 34 Drawing Sheets

DISPLAY, PORTABLE DEVICE, AND SUBSTRATE

FIELD OF THE INVENTION

The present invention relates to displays, portable devices, and substrates in or on which every pixel has a memory element and a light-emitting element.

BACKGROUND OF THE INVENTION

The organic LED (light-emitting diode) display, a type of flat panel display, is a recent focus of attention as a competitor of the liquid crystal display. A great deal of efforts are put into the development of display circuits and driving methods for the organic LED display.

Drive circuits and methods for use with the organic LED display are divided into two major categories: passive and active. To apply the active drive technology to organic LED displays, those TFT which drive the pixels have to be made of polysilicon.

This is because when self-luminous elements are to be driven by TFTs as in the organic LED display, sufficient movement is required with electric charges in the silicon forming the TFTs to ensure an amount of current flow through the self-luminous elements. This explains why polysilicon is needed in the organic LED display, while amorphous silicon is sufficient in the non-light-emitting shutter element, such as liquid crystal.

U.S. Pat. No. 4,996,523 (issued Feb. 26, 1991) discloses a pixel configuration of the organic LED display based on monocrystalline silicon TFTs instead of polysilicon TFTs, in particular, a configuration using memory elements.

FIG. 26 shows a circuit configuration in a single pixel (precisely, should be termed "a single dot" because 1 pixel=1 dot in a black & white display and 1 pixel=RGB 3 dots in a color display; however, no strict restrictions are made here).

According to U.S. Pat. No. 4,996,523, as shown in FIG. 26, each pixel is formed by: multiple memory cells 221 or $C_n$ to $C_{n-3}$; transistors 222 or $D_n$ to $D_{n-3}$; to select from those memory cells; a constant current circuit 225; and an organic LED element 226.

The constant current circuit 225 is a current mirror circuit including FETs 223, 224. Therefore, the current through the organic LED element 226 is determined by the total current flow in the FETs $D_n$ to $D_{n-3}$. The current flow in the FETs $D_n$ to $D_{n-3}$ is specified by the gate voltages of the FETs $D_n$ to $D_{n-3}$ which are determined by the data stored in the memory cells $C_n$ to $C_{n-3}$.

The configuration of the memory cells 221 is shown in FIG. 27. Specifically, a CMOS inverter 228 and MOS transmission gates 227, 229 are controlled by means of a LOW control signal. When the LOW control signal is in a selection state, the MOS transmission gate 227 is in a conducting state, and the MOS transmission gate 229 is in a non-conducting state; therefore, a column input signal Bn is fed to the gate of a CMOS inverter 230 via the MOS transmission gate 227. When the LOW control signal is in a non-selection state, the MOS transmission gate 227 becomes non-conducting, and the MOS transmission gate 229 becomes conducting; therefore, the output from a CMOS inverter 231 is fed back to the CMOS inverter 230 via the MOS transmission gate 229. In the memory cell 221, the output from the CMOS inverter 230 is fed back to the gate of the CMOS inverter 230 via the CMOS inverter 231 and the MOS transmission gate 229; the circuit can be therefore regarded as being a static memory circuit with two-stage inverters.

This way, U.S. Pat. No. 4,996,523 discloses a memory structure including monocrystalline silicon TFTs, as a pixel-TFT configuration for use with the organic LED display.

The aforementioned pixel memory structure disclosed in U.S. Pat. No. 4,996,523 (see FIG. 26) includes multiple memory cells $C_n$ to $C_{n-3}$, as well as a current mirror circuit 225, in each pixel to convert a digital signal to an analog signal (current value) by means of the current mirror circuit.

The structure including a current mirror circuit requires its components, the FETs 223, 224, to have identical characteristics; however, fabricating the FETs by a polysilicon process, which is used for fabrication of liquid crystal displays for example, does not guarantee identical characteristics between neighboring FETs.

As a result, the circuit for an analog gray-scale method in FIG. 26 entails a problem of irregular characteristics in polysilicon TFTs and can produce a homogeneous gray-scale display across the entire screen only with difficulties.

Accordingly, it is suggested to restrain irregularities in polysilicon TFT characteristics by the adoption of digital gray-scale techniques. FIG. 33 shows a pixel circuit structure for use in a time-ratio gray-scale method, a kind of those digital gray-scale method techniques. Specifically, the structure includes a TFT 107 which drives an organic LED display 108, a capacitor 119 which builds voltage accumulation to control the conduction of the TFT 107, and a TFT 106 to control the voltage applied to the capacitor 119. In this structure, the method rewrites the voltage applied to the capacitor 119 in the pixel several times in a single frame period TF as shown in FIG. 34 and produces a gray-scale display by setting the voltage to either such a value that causes the TFT 107 to conduct or such a value that causes the TFT 107 to not conduct.

Japanese Unexamined Patent Application 8-194205 (Tokukaihei 8-194205/1996; published on Jul. 30, 1996) discloses a configuration of a liquid crystal display, in which a static memory structure is incorporated in every pixel by means of a polysilicon TFT.

Referring to FIG. 28, in Tokukaihei 8-194205, there are pixel electrodes 202 arranged in a matrix on a first glass substrate, and a scan line 203 running horizontally and a signal lines 204 running vertically between every pair of adjacent pixel electrodes 202. Also, reference lines 205 are provided in parallel to the scan lines 203. At every crossing of the scan lines 203 and the signal lines 204, a memory element 206 (detailed later) is provided, and a switching element 207 is provided between the memory element 206 and the pixel electrode 202.

A second glass substrate is provided to oppose the first glass substrate at a predetermined distance. The second glass substrate has opposite electrodes on a side facing the first glass substrate. A liquid crystal layer as a display material layer is sealed between the two glass substrates. In FIG. 28, 208 is a scan line driver, 209 is a signal line driver, and 210 is a reference line driver.

FIG. 29 is a circuit diagram showing the structure of a pixel portion in FIG. 28. A binary data recording memory element 206 is connected to each of the crossings, of the scan lines 203 and the signal lines 204, arranged in a matrix. The memory element 206 has an output section for outputting stored information. A TFT 214, as a three-terminal switching element 207, is connected to the output section. The switching element 207 controls the resistance between the reference lines 205 and the pixel electrodes 202 to adjust the bias applied to the liquid crystal layer 215.

In FIG. 29, a static memory element is used as the memory element 206. The static memory element is a memory circuit which delivers a positive feedback by means of two-stage inverters. Consequently, the data fed through the signal lines 204 is supplied to the gate terminal of the inverter 212 when the TFT 211 is conducting. The output from the inverter 212 is resupplied to the gate terminal of the inverter 212 via the inverter 213; therefore, when the TFT 211 conducts, the data supplied to the inverter 212 is fed back to the inverter 212 without changing the polarity thereof and stored until the TFT 211 conducts next time.

This way, Tokukaihei 8-194205 discloses a memory structure including polysilicon TFTs, as a pixel-TFT configuration for use with the liquid crystal display. The TFT substrate structure disclosed in the Tokukaihei as shown in FIG. 29 includes a static memory 206 for every pixel and produces a binary display from data stored in the pixel memory.

Japanese Unexamined Patent Application 2000-227608 (Tokukai 2000-227608; published on Aug. 15, 2000) discloses a circuit structure for a liquid crystal display in which an exterior of a display section has a memory function.

FIG. 30 is a block diagram showing the structure of a display substrate disclosed in the document.

According to Tokukai 2000-227608, a display section 310 on the display substrate is connected to an image memory 308 via line buffer 309. The image memory 308 includes memory cells arranged in a matrix and has a bitmap structure sharing a common address space with those pixels in the display section 310. An address signal 303 is supplied via a memory control circuit 306 to a memory line selector circuit 311 and a column selector circuit 307. The memory cell address by the address signal 303 is selected by a column line and a line wire (not shown) so that display data 304 is written to the memory cell. After the writing, data for a single line including the selected pixel is transmitted to the line buffer 309 by an address signal supplied to the memory line selector circuit 311. Since the line buffer 309 is connected to signal wiring (not shown) of the display section, the read-out data is transmitted to the signal wiring.

The address signal is also supplied to an address line converter circuit 305 so as to apply the selected voltage to line selector wiring (not shown) by means of a display line selector circuit 312

This operation results in the writing of the data in the image memory 308 to the display section 310.

The pixel circuit structure of the display section 310 is shown in FIG. 31. A control TFT 405 is controlled with a line selector wire 401, the data supplied from a signal wire 402 is stored in a capacitor 406 located between a common wire 404 and the control TFT 405, conduction (and non-conduction) of a drive TFT 409 is controlled by the voltage across the capacitor 406, and it is determined whether to apply a voltage supplied to a display electrode 408 from a liquid crystal standard wire 403. A correction capacitor 409 is connected between the source and drain terminals.

FIG. 32 shows another pixel circuit structure of the display section 310. The TFT drives liquid crystal using an analog switch 504. To drive the analog switch, which is composed of a pch TFT and a nch TFT, two sets of memory circuits are provided, each set including a sampling capacitor 503, 507 and a sampling TFT 502, 506. Data items of different polarities are supplied via two data wires 501, 505, connected to a common line selector wire 401, and simultaneously sample to produce a display.

The document also discloses that the data items with different polarities which drive the analog switch can be produced by an inverter circuit built inside a pixel, instead of the provision of two sets of memory circuits, and that the memory circuit used for semiconductor as a memory circuit is constructed around a TFT.

This way, Tokukai 2000-227608 discloses the configuration of a polysilicon TFT substrate for a liquid crystal display. The configuration is such that the TFT substrate structure shown in FIG. 30 includes, outside the display section 310 the image memory 308 composed of an SRAM, the display section 310 includes pixel memories constructed around a capacitor as shown in FIGS. 31 and 32, and a display is produced from binary data stored in the pixel memories.

As mentioned in the foregoing, it is suggested to restrain irregularities in polysilicon TFT characteristics by the adoption of digital gray-scale method techniques. However, the time-ratio gray-scale method could probably entail the development of moving picture breakup (dynamic false contours) as is the case with PDPs (plasma display panels). The moving picture breakups develop according to the following mechanism (see FIG. 35). The eye moves as indicated by broken lines (a)–(d) when the pattern of tone level 32 moves on the background of tone level 31 and can recognize a tonal pattern formed by those pixels on the lines at the time of the eye passing over them. For example, along broken line (a), the eye movement coincides with a light-on timing of tones 1, 2, 4, 8, 32 so that the eye can see tone level 47. Along broken line (d), the eye movement coincides only with the light-on timing of tone 16 so that the eye can see tone level 16.

Accordingly, in the PDP and other pieces of apparatus, the animated-image moving picture breakup is improved by dividing large bit-weight data into several sets and displaying those sets before or after small bit-weight data. In other words, the moving picture breakup is reduced by large bit-weight data which appears several times in a cycle of a certain frame period.

However, to produce a display from that large bit-weight data several times on a PDP, etc. scanning is necessary for every display.

Further, U.S. Pat. No. 4,996,523 mentions that the circuit shown in FIG. 26 is provided to each pixel. To compete with recent developments of liquid crystal displays which have achieved a 64 gray-scale method, the PDP requires a 6-bit memory for each pixel. However, in a normal display, three (RGB) pixels are accommodated in a limited space of about 150 [$\mu$m]×150 [$\mu$m]–300 [$\mu$m]×300 [$\mu$m], in which there must be further provided a gate wire, source wire, power source wire, etc, as well as a 6-bit memory circuit arranged as shown in FIG. 26. This is not easy even with a present low-temperature polysilicon process. Building more than 3-bit memory wold be impossible. When this is the case, the device can produce a maximum of only 8 tones and lacks appeal as a commercial product.

Meanwhile, according to Tokukaihei 8-194205, each pixel is provided with only 1-bit memory. Although this is feasible with a present low-temperature polysilicon process, a resultant still image is only binary (of multicolor owing to RGB colors), because the device relies on the 1-bit memory in producing a still image display.

Note that Tokukai 2000-227608 is free from these problems, since the memory is located outside the pixel (display region). Nevertheless, locating the memory outside the display region requires an additional area on the display substrate, which means a smaller number of substrates fabricated from a glass substrate (of an equal display area) in a TFT process and an increased manufacturing cost for a substrate of an equal display area.

We presume that the biggest advantage in imparting a memory function to the substrate is power saving, which would give the device the most competitive edge in the portable device market than in other markets. However, the above technique is not still preferable in the portable device market where miniaturization and light weight are the key factors, since a larger substrate size is required to produce an equal display area.

SUMMARY OF THE INVENTION

An objective of the present invention is to offer a display, portable device, and substrate as means for dividing a display period for a bit without new scanning.

Another objective of the present invention is to offer a display, portable device, substrate as a structure of a circuit for a display substrate which can produce more tones than memories provided to a single pixel.

A further objective of the present invention is to offer, in a display substrate structure in which memories are arranged outside display regions, a display, portable device, substrate as a structure of a circuit for a display substrate which is smaller in size with less memories arranged outside display regions, but still capable of producing more or less the same number of tones.

To achieve the objectives, a display in accordance with the present invention includes multiple electro-optic elements and is characterized in that the display includes memory means and potential maintaining means both provided for each of the electro-optic element, wherein a display operation by the electro-optic elements is controlled using outputs from the memory means and the potential maintaining means.

To achieve the objectives, a display in accordance with the present invention includes multiple electro-optic elements and is characterized in that the display includes memory means provided for each of the electro-optic elements, wherein the electro-optic elements and the memory means have individual power source lines.

To achieve the objectives, a portable device in accordance with the present invention is characterized in that the portable device includes the above display.

To achieve the objectives, a substrate in accordance with the present invention includes multiple electrodes and is characterized in that the substrate includes: memory means and potential maintaining means both provided for each of the electrodes; and means for controlling either voltage or current applied to the electrodes using outputs from the memory means and the potential maintaining means.

Consequently, with the arrangement in which each pixel has memory means (memory) and potential maintaining means (capacitor), more tones than memories provided to the pixels can be displayed. Further, by switching between the memories provided to the pixels, a video image is switchably selected to produce a display without externally receiving further data. Moreover, the first memory element can be caused to retain a voltage corresponding to the largest tone data, a voltage application time for that data can be divided in the application of voltage, so as to suppress moving picture breakups.

For a fuller understanding of the nature and advantages of the invention, reference should be made to the ensuing detailed description taken in conjunction with the accompanying drawings.

DETAILED DESCRIPTION OF THE PREFERRED EMBODIMENTS

[Embodiment 1]

Figure 1:
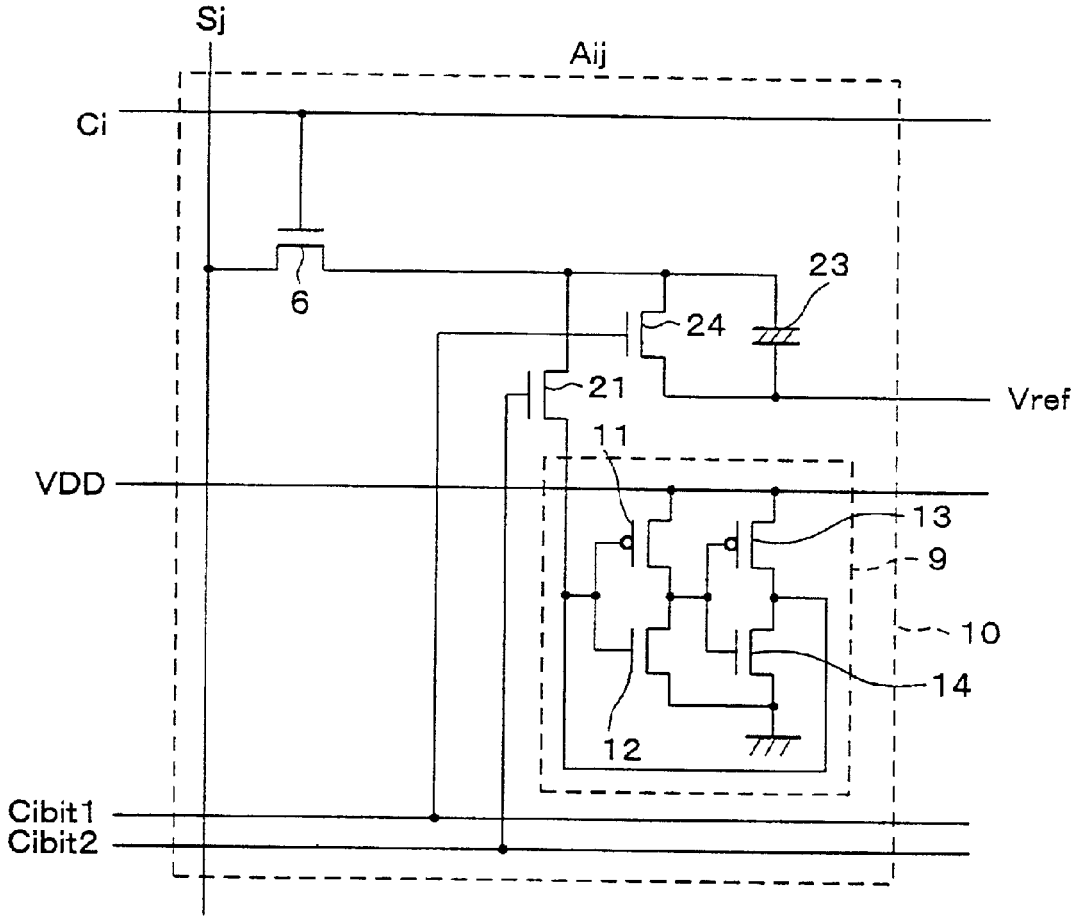
FIG. 1 is a circuit diagram showing a circuit structure of a pixel used in embodiment 1.

The following will describe an embodiment in accordance with the present invention in reference to FIG. 1.

FIG. 1 shows an equivalent circuit of a pixel Aij which is a first arrangement of first means in accordance with the present invention. The equivalent circuit is adapted so that a data wire Sj, as a signal line, is connected to the source terminal of a TFT (thin film transistor, first switching means) 6 and that the source terminal of a TFT (second switching element) 21 and a pixel electrode of a liquid crystal element (electro-optic element) 23 which doubles as potential maintaining means are connected to the drain terminal of the TFT 6. A memory circuit (first memory element) 9, which is a static memory element, is connected to the drain terminal of the TFT 21.

The TFT 6 is needed, because the data wire Sj does not make a one-to-one correspondence to the electro-optic element. If the data wire Sj is arranged to make such a correspondence to the electro-optic element, the TFT 6 is dispensable.

To form such a memory circuit 9, the present embodiment employs a CGS (Continuous Grain Silicon) TFT fabrication process. For more details about the process, see Japanese Unexamined Patent Application 8-250749, for example; here, detailed description is omitted.

To control the display state of the liquid crystal element 23, while keeping the potential, Vref, of the opposite electrode of the liquid crystal element 23 at GND, the TFT 6 and the TFT 21 are switched on, i.e., source-to-drain current is caused to flow therein, and the highest-order bit data is applied to the pixel electrode and memory circuit 9 of the liquid crystal element 23. The highest-order bit data here is binary: VDD or GND. To switch on the TFT 6, a selector voltage is applied to a scan line connected to the gate terminal of the TFT 6. To switch on the TFT 21, a selector voltage is applied to a control line Cibit2 connected to the gate terminal of the TFT 21.

In the present embodiment, the source and drain terminals of the TFT are exchangeable since there are not clear distinctions between these two terminals.

Now, while keeping the TFT 6 on and the TFT 21 off, a voltage for a tone equivalent to a low-order bit is applied to the pixel electrode of the liquid crystal element 23.

Thereafter, the TFT 6 is switched off, and the TFT 21 is switched on, to apply the highest-order bit data built up in the memory circuit 9 to the liquid crystal element 23.

Once retained in the memory circuit 9 by the foregoing driving, the highest-order bit data can be applied to the liquid crystal element 23 several times per frame, even with intervening bits.

Note that an a.c. potential can be applied to the liquid crystal element 23 in a frame period which differs from the display period by applying a VDD potential as the potential Vref and switching the voltage applied to the liquid crystal element 23 between VDD and GND via the TFT 6, the TFT 21, etc.

To produce a still image display, the bit data which cannot be arranged in a pixel is also supplied to the liquid crystal (potential maintaining means) from the outside of the pixel. This has an useful effect: 2-bit or more tones are produced even when the memory means in the pixel is capable of handling only a 1-bit gray-scale method.

By the benefit the foregoing driving, the liquid crystal has a time-division gray-scale method capability too. The response of liquid crystal however is so slow that moving picture breakups are rarely visible (they are clearly visible on a high-speed liquid crystal, such as a ferromagnetic liquid crystal). With a high-speed liquid crystal, the driving is useful in restraining moving picture breakups.

Incidentally, in FIG. 1, a TFT 24 (sixth switching element) which enters parallel to the liquid crystal display element 23 and a control line Cibit1 which switches the TFT 24 on and off are provided for the purpose of setting the voltage applied to the liquid crystal element 23 to zero, adjusting the duration of the gray-scale period, and improve tone linearity.

Incidentally, In FIG. 1, the memory circuit 9 has a static memory structure in which a first inverter circuit formed by a p-type TFT 11 and an n-type TFT 12 is connected to a second inverter circuit formed by a p-type TFT 13 and an n-type TFT 14 so that the output of one is the input of the other.

Therefore, as the memory circuit 9, are there included the TFT 13 for controlling the connection to the VDD potential and the TFT 14 for controlling the connection to the GND potential.

Incidentally, a new p-type TFTx may be interposed between the output terminal of the second inverter circuit and the input terminal of the first inverter circuit, with the gate terminal of the p-type TFTx connected to a scan line Ci (the source terminal thereof connected to the output terminal of the second inverter circuit and the drain terminal thereof connected to the input terminal of the first inverter circuit).

When this is the case, when the data on the data wire Sj is acquired to the memory circuit 9 with the TFT 6 in a conductive state, the p-type TFT x changes into a non-conductive state, and the output of the second inverter circuit does not affect the input of the first inverter circuit, which makes data setting to the memory circuit 9 easy. When the TFT 6 is in a non-conductive state, the p-type TFT changes into a conductive state, and the output of the second inverter circuit is fed to the input of the first inverter circuit, and the data in the memory circuit 9 is held.

Incidentally, either of the VDD potential and the GND potential can be designated an ON brightness setting potential, while the remaining one is an OFF brightness setting potential: the designation varies depending on whether the liquid crystal element 23 operates in normally white mode or normally black mode, i.e., whether the transmissive condition or the opaque condition is designated "ON."

[Embodiment 2]

Figure 2:
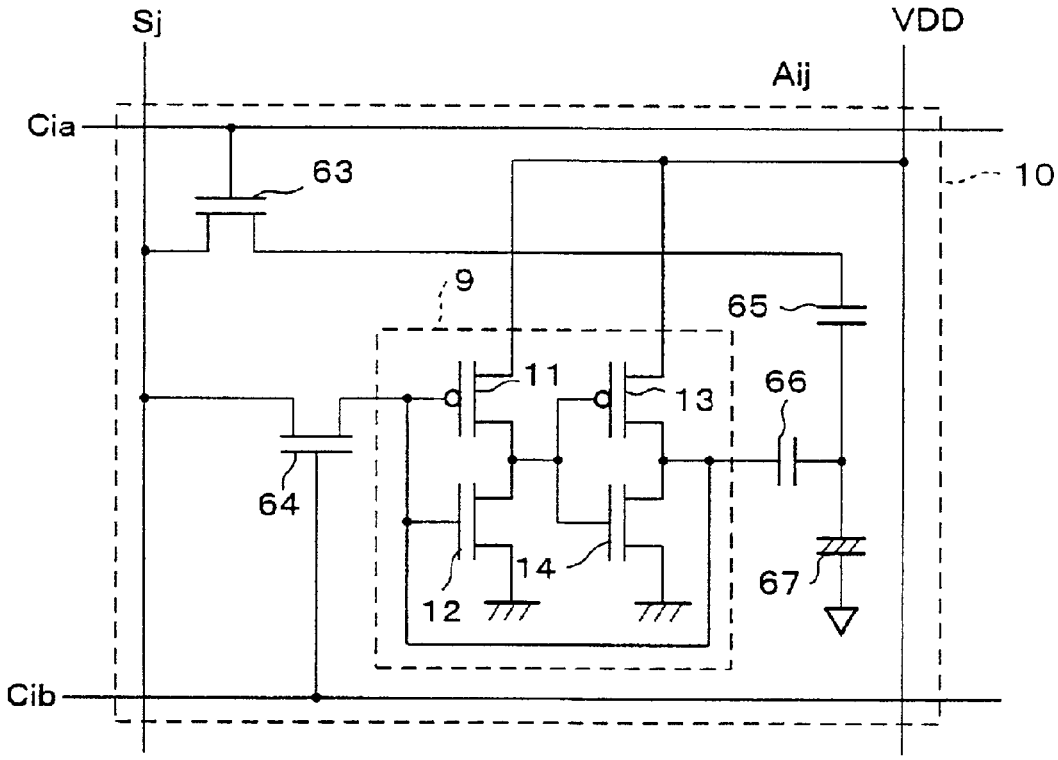
FIG. 2 is an equivalent circuit diagram showing a circuit structure of a pixel used in embodiment 2.

FIG. 2 shows an equivalent circuit of a pixel Aij which is a second arrangement of the first means in accordance with the present invention. The equivalent circuit includes a TFT (first switching means) 63 so that a data wire Sj, as a signal line, is connected to the source terminal of the TFT 63 and that a capacitor (potential maintaining means) 65 is connected to the drain terminal of the TFT 63. The equivalent circuit further includes a TFT (fourth switching means) 64 so that a data wire Sj, as a signal line, is connected to the source terminal of the TFT 64 and that an input terminal of a memory element (memory means) 9 is connected to the drain terminal of the TFT 64. A scan line Cia is connected to the gate terminal of the TFT 63, and a scan line Cib is connected to the gate terminal of the TFT 64.

This memory element 9 is identical to that in FIG. 1 and has a static memory structure in which an inverter formed by a p-type TFT 11 and an n-type TFT 12 is connected to another inverter formed by a p-type TFT 13 and an n-type TFT 14 so that the output of one is the input of the other.

A capacitor 66 is connected to an output terminal (which doubles as an input terminal in FIG. 2) of the memory element 9.

A liquid crystal element, which is an electro-optic element, is commonly connected to the other terminals of the capacitors 65, 66. To the remaining terminal of the liquid crystal element is connected a potential Vref of the opposite electrode.

The voltage applied to the liquid crystal will be referred to simply as Vref=GND. Assume that the capacitor 65 has a capacitance of C65, the capacitor 66 a capacitance of C66, and the liquid crystal a capacitance of Clc. When the output from the memory means 9 is GND potential, if the voltage applied to the capacitor 65 from the data wire Sj is GND potential, the voltage applied to the liquid crystal is 0 [V]. If the voltage applied to the capacitor 65 from the data wire Sj is VDD, the voltage applied to the liquid crystal is given by VDD×C65/(Clc+C66+C65) [V]. When the output from the memory means 9 is VDD potential, when the voltage applied to the capacitor 65 from the data wire Sj is GND potential, the voltage applied to the liquid crystal is given by VDD×C66/(Clc+C66+C65) [V]. If the voltage applied to the capacitor 65 from the data wire Sj is VDD, the voltage applied to the liquid crystal is given by VDD×(C65+C66)/(Clc+C66+C65) [V].

Accordingly, by setting C65 and C66 to large values relative to Clc and the power source voltage VDD to an appropriate value, a gray-scale method can be produced using the liquid crystal 67. That is, the present embodiment is equivalent to a case where the electro-optic element is driven to produce a display by the application of a voltage created corresponding to the weight of the data stored in the memory means or the potential maintaining means. In such a case, if the data wire Sj makes a one-to-one correspondence to the memory means 9 and the potential maintaining means 65, the TFTs 63, 64 are again dispensable. In such a case, the bit data that cannot be arranged in the pixel is fed to the liquid crystal 65, which is the potential maintaining means, from the outside of the pixel in a time-division manner. This is advantageous in that even if the memory means arranged in a pixel is only for a single bit of a memory circuit 9, 2-bit or more tones can be produced (second objective in accordance with the present invention).

[Embodiment 3]

Figure 3:
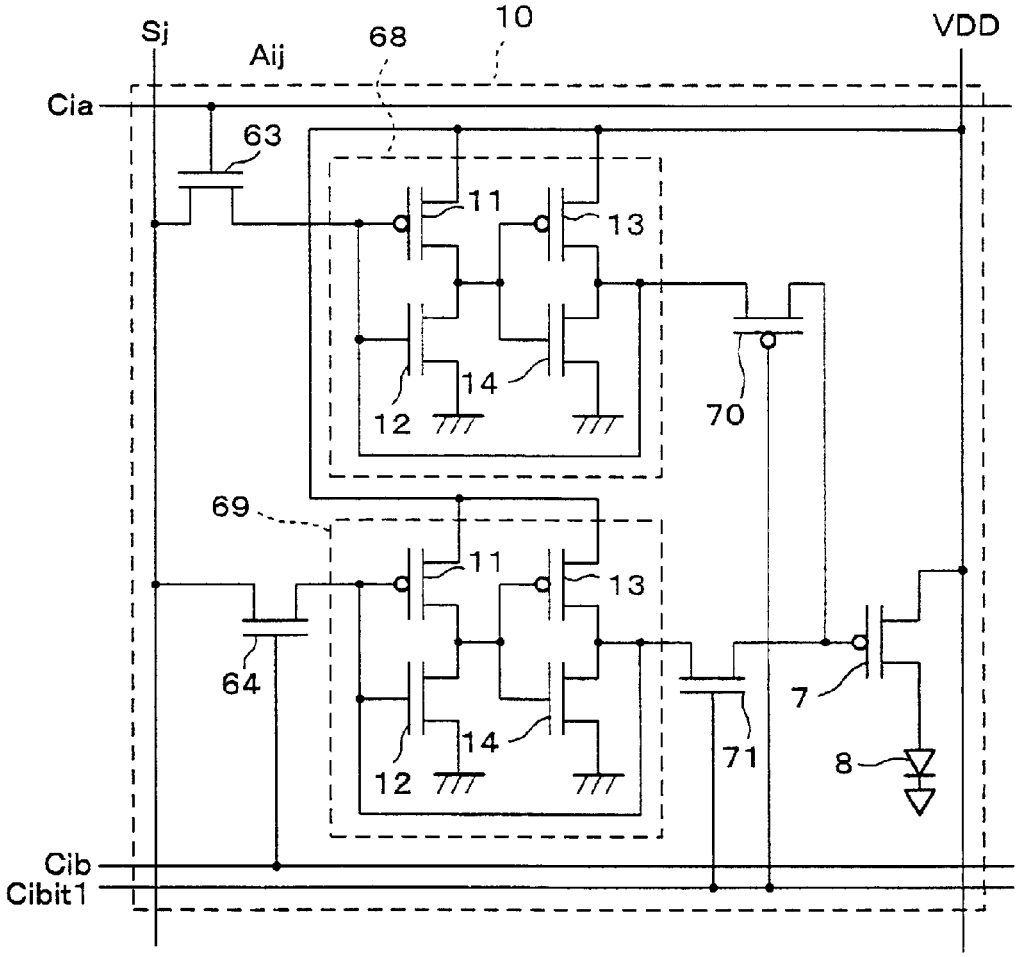
FIG. 3 is an equivalent circuit diagram showing a circuit structure of a pixel used in embodiment 3.

FIG. 3 shows an equivalent circuit of a pixel Aij which is a second arrangement of first means in accordance with the present invention. The equivalent circuit is adapted so that a data wire Sj, as a signal line, is connected to the source terminal of a TFT (first switching means) 63, that an input terminal of a static memory (potential maintaining means) 68 is connected to the drain terminal of the TFT 63, that a data wire Sj, as a signal line, is connected to the source terminal of a TFT (fourth switching means) 64, and that the input terminal of a static memory (memory means) 69 is connected to the drain terminal of the TFT 64. A scan line Cia is connected to the gate terminal of the TFT 63, and a scan line Cib is connected to the gate terminal of the TFT 64.

An output terminal of the potential maintaining means 68 is connected to the source terminal of a p-type TFT (fifth switching element) 70, and the drain terminal of the TFT 70 is connected to a gate terminal of a TFT 7 which, in combination with an organic LED display 8, forms an electro-optic element. An output terminal of the memory means 69 is connected to the source terminal of an n-type TFT (fifth switching element) 71. The drain terminal of the TFT 71 is connected to the gate terminal of the TFT 7 which, in combination with the organic LED display 8 (will be described later in detail), forms an electro-optic element.

Either one of the TFTs 70 and 71 is an n-type TFT, while the other is a p-type TFT. Therefore, with the gate terminals thereof connected to a common control line Cibit1, if a control line Cibit1 is HIGH, the TFT 71 is in a conducting state; if the control line Cibit1 is LOW, the TFT 70 is in a conducting state.

Incidentally, if both the TFTs 70, 71 in FIG. 3 are n-type TFTs, the control line connected to the gate terminal of the TFT 71 differs from the control line Cibit1 connected to the gate terminal of the TFT 70.

Therefore, the former case (the example shown in FIG. 3) is advantageous in the use of less control lines, but risky due to possible conduction between the TFTs caused by irregular threshold characteristics of the TFTs 70, 71.

Conversely, in the latter case, the TFTs 70, 71 are separately controlled. Separate control of the TFTs is possible so that they will not conduct simultaneously even when the threshold characteristics of the TFTs 70, 71 are irregular.

Also, in this case, the electro-optic element is formed by the p-type TFT 7 and the organic LED display 8, and the source terminal of the TFT 7 is connected to a power source line at VDD. The drain terminal of the TFT 7 is connected to the anode of the organic LED display 8 (will be described later in detail in terms of its structure). The cathode of the organic LED display 8 is connected to GND.

Figure 4:
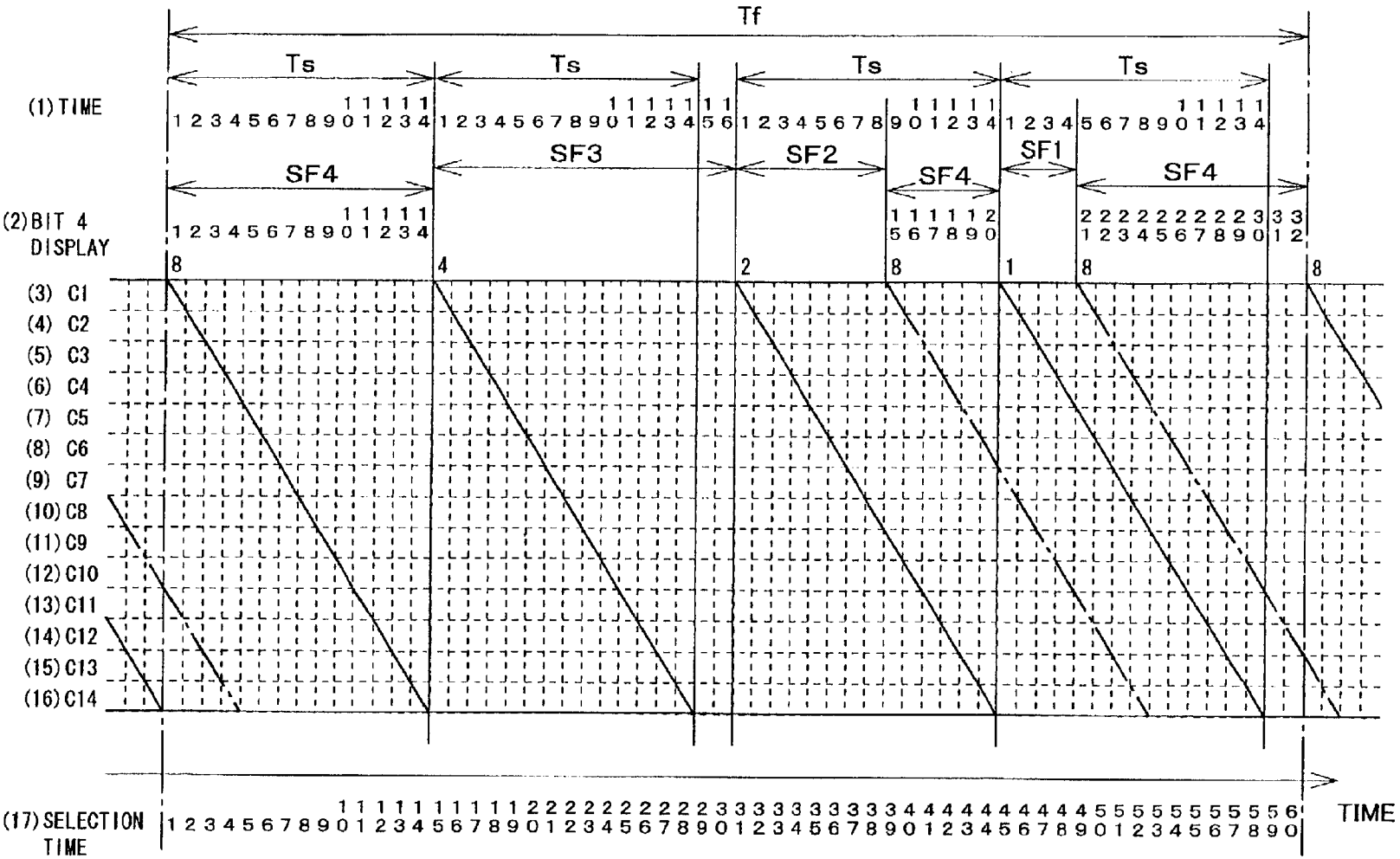
FIG. 4 is a timing diagram of a time-division tone scan method used in embodiment 3.

Accordingly, scanning is done as shown in FIG. 4. Incidentally, in FIG. 4, 3) to 16) represent scan lines, the scanning represented by solid lines is data acquisition from the data wire Sj, and the scanning represented by broken lines is data acquisition from the memory means.

Specifically, a single frame period Tf is divided into multiple scanning periods Ts, and first, the highest-order bit data is written to the memory means 69, which switches the control line Cibit1 to HIGH and puts the TFT 71 in a conducting state; the output of the memory means 69 is hence fed to the gate electrode of the TFT 7. Consequently, during this period, a current in accordance with the highest-order bit data runs through the organic LED display 8.

Next, the low-order bit data is written to the potential maintaining means 68, which switches the control line Cibit1 to LOW and turns the TFT 70 into a conducting state; the output of the potential maintaining means 68 is hence fed to the gate electrode of the TFT 7. Consequently, during this period, a current in accordance with the low-order bit data runs through the organic LED display 8.

However, with a low-order bit, the display period of a low-order bit may be shorter than the scanning period Ts. Accordingly, during the remaining time, the control line Cibit1 is switched to HIGH and the TFT 71 to a conducting state, so as to feed the output from the memory means 69 to the gate electrode of the TFT 7.

As a result, the period in which current flows through the organic LED display 8 in accordance with the highest-order bit data is divided into subperiods. The sum of the subperiods is made proportional to the weight of the highest-order bit.

This driving is effective in restraining the moving picture breakup which is observed when the organic LED display 8 is used to produce a time-ratio gray-scale method.

Incidentally, the present embodiment is equivalent to a case where the output from the memory means or the potential maintaining means is fed to the electro-optic element during a period which corresponds to the weight of the data stored in the memory means or the potential maintaining means.

Another effect is that even if the memory means 69 arranged in a pixel is only for a single bit, 2-bit or more tones can be produced as a result of the supply of the bit data from the outside of the pixel to the static memory 68 which is the potential maintaining means.

Incidentally, when data is transmitted to a pixel as digital data as in the present embodiment, a problem arises that the number of data transmissions is multiplied by the number of bits in comparison to a case where an analog-like voltage is transmitted to the pixel.

However, when an analog-like voltage is transmitted to the pixel, a voltage may be needed to be transmitted to a signal wire Sj to drive the electro-optic element. To this end, a voltage amplitude of, for example, 10 V is needed.

Meanwhile, when binary digital data is transmitted to the pixel, a simple voltage level converter circuit can be provided to the pixel. This means that for example, the voltage transmitted to the signal wire Sj can be maintained as low as about 3 V even when a voltage amplitude of 10 V is applied to the electro-optic element.

Taking the power consumption to transmitted a 10-V voltage once by an analog tone to $10\times10\times1=100$, since power consumption is proportional to the voltage squared, the power consumption when a 3-V voltage is transmitted 8 times by a digital tone is reduced to $3\times3\times8=76$.

Figure 5:
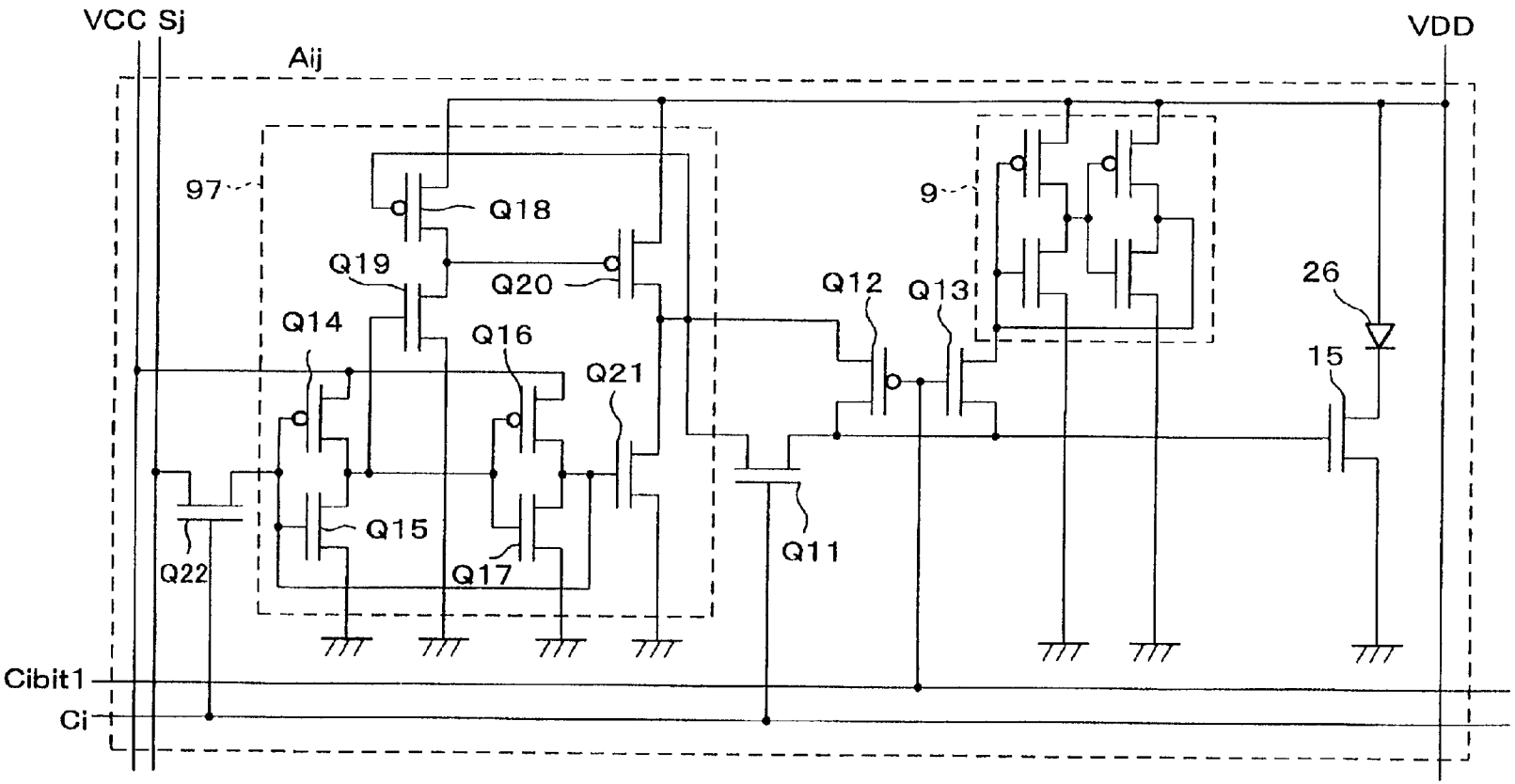
FIG. 5 is an equivalent circuit diagram showing a circuit structure of a voltage converter circuit described in embodiment 3.

FIG. 5 shows an example of such a voltage converter circuit. In FIG. 5, in a voltage converter circuit 97, a static memory structure is employed including a first inverter formed by a p-type TFT Q14 and an n-type TFT Q15 and a second inverter formed by a p-type TFT Q16 and an n-type TFT Q17; that positive polarity data and reverse polarity data are produced from the data input through the signal wire Sj. One of the two data sets is applied to the gate electrode of an n-type TFT Q19 of a third inverter formed by a p-type TFT Q18 and the n-type TFT Q1, and the other data set is applied to the gate electrode of an n-type TFT Q21 of a fourth inverter formed by a p-type TFT Q20 and the n-type TFT Q21. The p-type TFTs 18 and 20 are connected so that the output of one is supplied to the gate electrode of the other.

Accordingly, as the gate electrode of the n-type TFT Q19 or 21 comes to have a voltage of VCC and turns into a conducting state, the output of the conducting inverter is GND potential. As a result of this, the gate terminal of either the p-type TFT Q18 or 20 becomes equal to GND potential, and a p-type TFT, situated on the side of an n-type TFT, which has been in a non-conducting state now turns into a conducting state. The output from the inverter on that side is VDD. Accordingly, the voltage conversion is completed from VCC to VDD.

This data, converted in terms of voltage, is written to a memory 9 when a scan wire Ci is in a selection state and a control wire Cibit1 is HIGH. The voltage converter circuit 97 doubles as potential maintaining means. This is because new data can be written to the memory circuit 9 only after it is passed through the voltage converter circuit 97, and therefore the voltage converter circuit 97 should be regarded as being potential maintaining means, rather than memory means. Incidentally, the scan wire Ci is in a non-selection state, and the control wire Cibit1 is LOW, the output from the voltage converter circuit 97 which is potential maintaining means is applied to the TFT 15 which is an electro-optic element. The control wire Cibit1 is HIGH, the output from the memory circuit 9 which is memory means is applied to the TFT 15 which is an electro-optic element.

in this manner, by providing a voltage converter circuit to each pixel, power consumption is lowered in a time-ratio gray-scale method.

[Embodiment 4]

Figure 6:
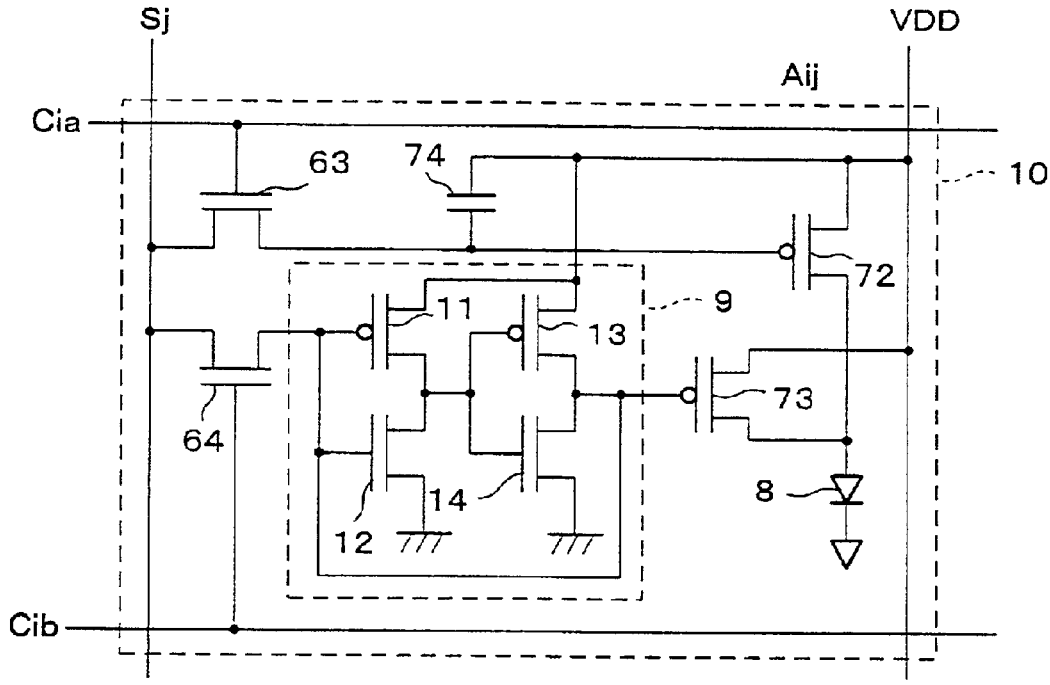
FIG. 6 is an equivalent circuit diagram showing a circuit structure of a pixel used in embodiment 4.

FIG. 6 shows an equivalent circuit of a pixel Aij which is a second arrangement of first means in accordance with the present invention. The equivalent circuit is adapted so that a data wire Sj, as a signal line, is connected to the source terminal of a TFT (first switching means) 63 and that a capacitor (potential maintaining means) 74 and the gate terminal of a TFT 72 forming an electro-optic element are connected to the drain terminal of the TFT 63. Further, the data wire Sj, as a signal line, is connected to the source terminal of a TFT (fourth switching means) 64, and the input terminal of a static memory (memory means) 9 is connected to the drain terminal of the TFT 64. A scan line Cia is connected to the gate terminal of the TFT 63, and a scan line Cib is connected to the gate terminal of the TFT 64.

An output terminal of the memory means 9 is connected to the gate terminal a TFT 73 forming an electro-optic element. In this case, the electro-optic element is formed by the p-type TFTs 72, 73 and the organic LED display 8, the source terminals of the TFTs 72, 73 are connected to a power source line VDD, and the drain terminals of the TFTs 72, 73 are connected to an anode of the organic LED display 8 (the organic LED display will be described later in detail in terms of its structure). The cathode of the organic LED display 8 is connected to GND.

Accordingly, while the highest-order bit data of the pixel Aij is being supplied to the signal line Sj in FIG. 6, by turning the scan line Cib to a selection state, the data is acquired to memory means 9. The low-order bit data of the pixel Aij is supplied to the signal line Sj in a time-ratio manner, during that period, by turning the scan line Cia to a selection state, the data is acquired to the capacitor 74.

The TFT 72 ceases to conduct when the capacitor 74 is HIGH and starts to conduct when LOW. The TFT 73 ceases to conduct when the memory means 9 is HIGH and starts to conduct when LOW. The TFTs 72, 73 are fabricated to share the same arrangement (size); if both of them are in a conducting state, the current doubles in comparison to a case where only one of them is in a conducting state.

Accordingly, a gray-scale method can be produced by control the interval at which the low-order data of the pixel Aij is applied to the capacitor 74 in accordance with the weight of that bit. In this case, the present embodiment is equivalent to a case where a current is generated in accordance with the weight of the data stored in the memory means or the potential maintaining means to display an electro-optic element. In such a case, if the data wire Sj makes a one-to-one correspondence to the memory means 9 and the potential maintaining means 65, the TFTs 63, 64 are again dispensable. Again In this case, the bit data that cannot be arranged in a pixel can be supplied from the outside of the pixel to the capacitor (potential maintaining means) 74, which is effective in producing 2-bit or more tones even when the memory means in the pixel is capable of handling only a 1-bit gray-scale method.

[Embodiment 5]

Figure 7:
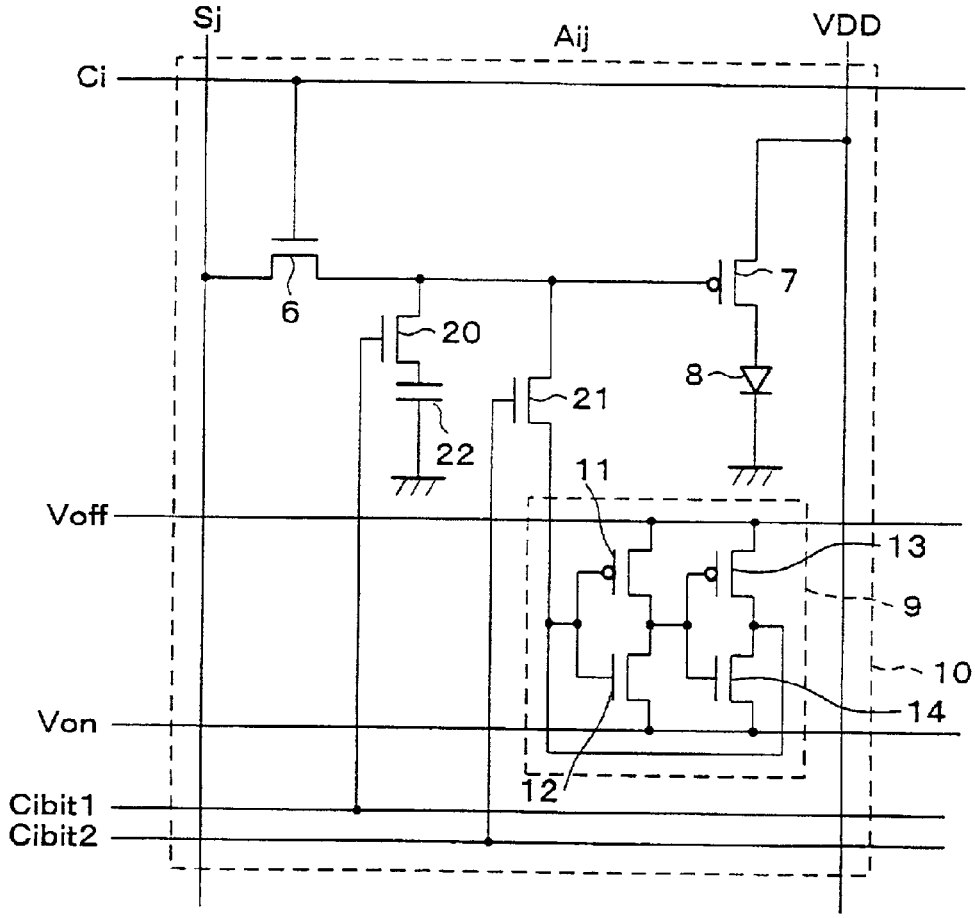
FIG. 7 is a circuit diagram showing a circuit structure of a pixel used in embodiment 5.
Figure 12:
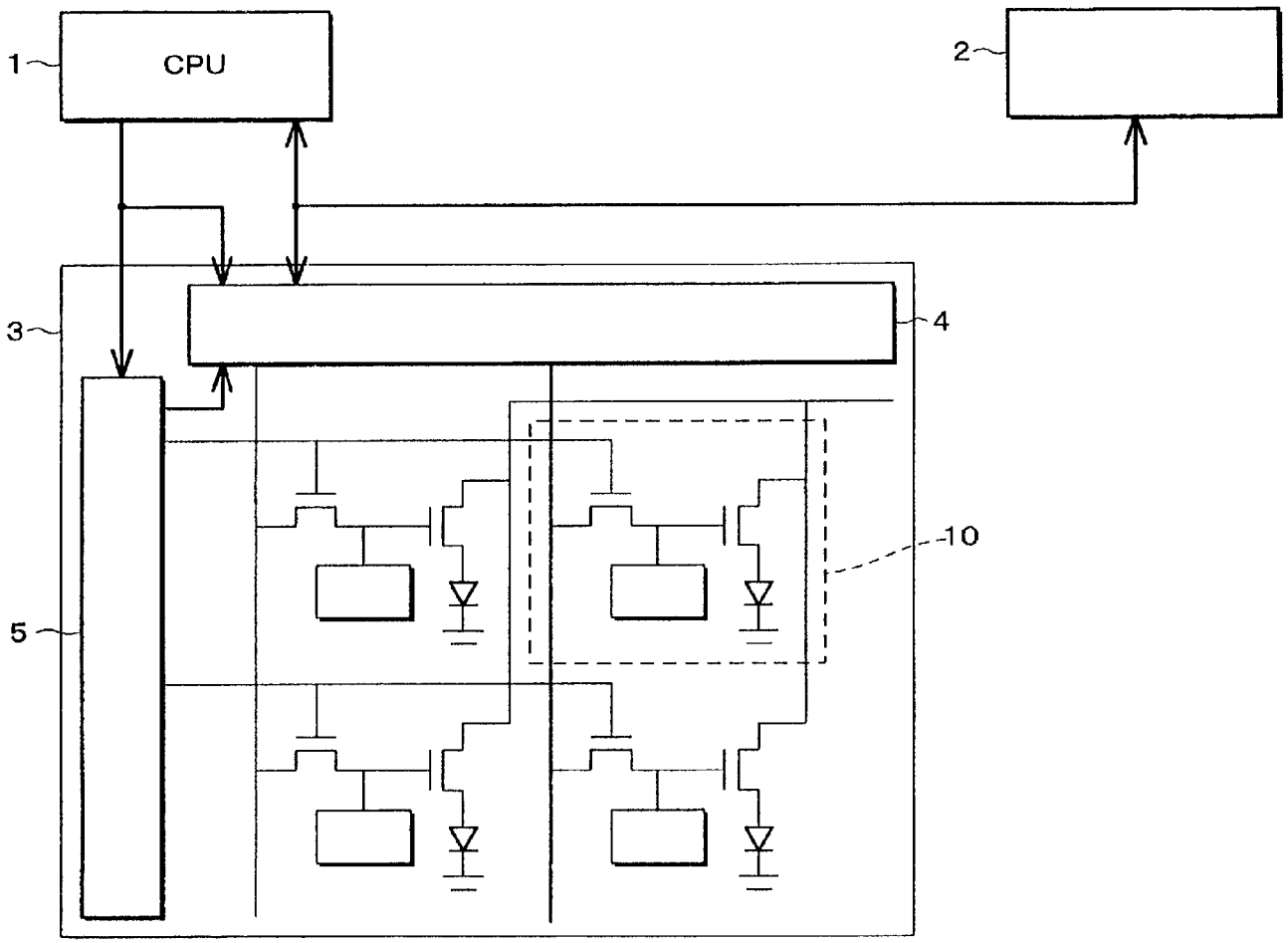
FIG. 12 is a block diagram showing a system configuration of a display, used in embodiment 5, which includes a memory for each pixel.

FIG. 7 shows an equivalent circuit of a pixel Aij which is a first arrangement in first means in accordance with the present invention. FIG. 12 shows a block circuit structure including a second memory element (memory array) outside of a display region (pixel) which is second means in accordance with the present invention. Here, for convenience, those members of the present embodiment that have the same arrangement and function as members of any one of the foregoing embodiments, and that are mentioned in that embodiment are indicated by the same reference numerals and description thereof is omitted.

Here, since a self-luminous element, such as an organic LED display, is used, a TFT for use with a self-luminous element drive is fabricated by a silicon process with a large electric charge mobility. That is, to fabricated a TFT for use in the present embodiment, a CGS TFT fabrication process is employed as in embodiments 1–4.

FIG. 7 shows an equivalent circuit of the pixel Aij. The equivalent circuit is adapted so that a data wire Sj is connected to the source terminal of a TFT (first switching element) 6 and that the source terminal of a TFT (second switching element) 21, the source terminal of a TFT (third switching element) 20, and the gate terminal of a TFT 7 forming an electro-optic element are connected to the drain terminal of the TFT 6. Incidentally, a static memory circuit (memory means) 9 is connected to the drain terminal of the TFT 21, and a capacitor (potential maintaining means) 22 is connected to the drain terminal of the TFT 20.

Incidentally, in the structure of FIG. 7, the TFT 20 which is the third switching element is dispensable. The TFT 20 is provided to maintain the potential of the capacitor 22 when the output from the memory element 9 is applied to the gate electrode of the TFT 7. Further, the TFT 20 provided so that the memory state of the memory element 9 does not change due to electric charge of the capacitor 22 when the output of the memory element 9 is fed to the gate terminal of the TFT 7. On account of this, the information stored in the capacitor 22 is retained, and the capacitor 22 works as if it was memory means adopting a dynamic memory, and the stray capacitance of the gate electrode of the TFT 7 works as if it is potential maintaining means.

Therefore, if the TFT 20 is provided, the capacitor 22 is not potential maintaining means of means 1 in accordance with the present invention in a strict sense.

Nevertheless, considering that the stray capacitance of the gate electrode of the TFT 7 is not sufficient and is affected by surrounding wires, resulting in variable potential and that electric power is consumed due to exchange of electric charges in the capacitor 22 too when the capacitor (potential maintaining means) 22 is charged up from the memory means, to prevent development of such problems, the TFT 20 as the third switching element is inserted in series with the capacitor 22 as potential maintaining means to form a potential maintaining means in accordance with the present invention.

With this objective in mind, the third switching element may be situated between the gate electrode of the TFT 7 and the capacitor 22 as in FIG. 7 or between the capacitor 22 and GND. Either way, when the TFT 20 is in a non-conducting state, the electric charge of the capacitor 22 does not vary.

A control line Cibit1 is connected to the gate terminal of the TFT 20, and a control line Cibit2 is connected to the gate terminal of the TFT 21.

Figure 8:
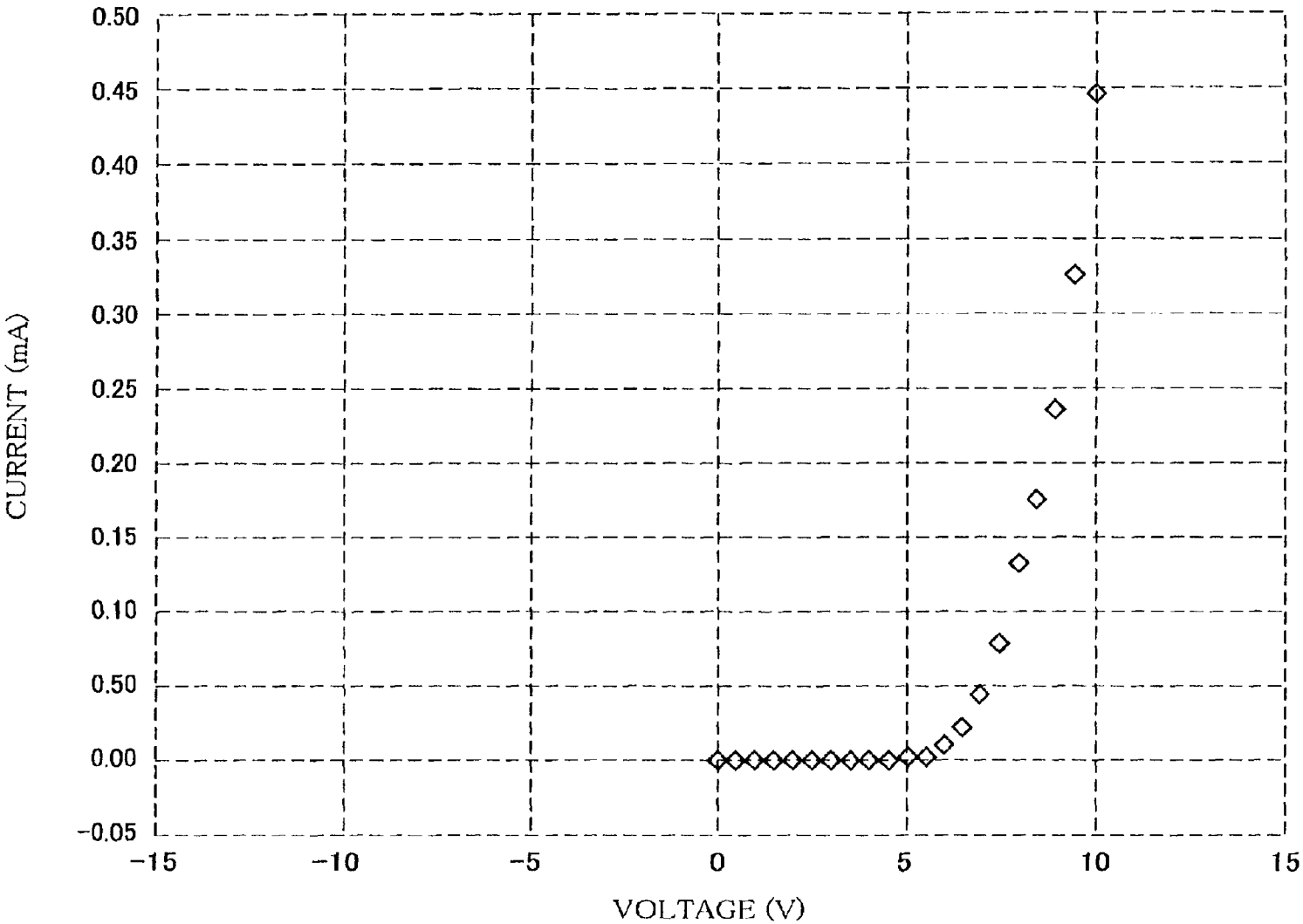
FIG. 8 is a graph showing an applied voltage versus organic LED display light-emitting current of an organic LED display used in an embodiment.

In the present embodiment, an organic LED display is used as an electro-optic element driven by the TFT 7. FIG. 8 shows characteristics of the element in terms of applied voltage V and current I. FIG. 8 is I-V static characteristics (linear) of an organic LED element. Incidentally, a typical structure of the organic LED display is shown in FIG. 9(*a*).

Figure 9:
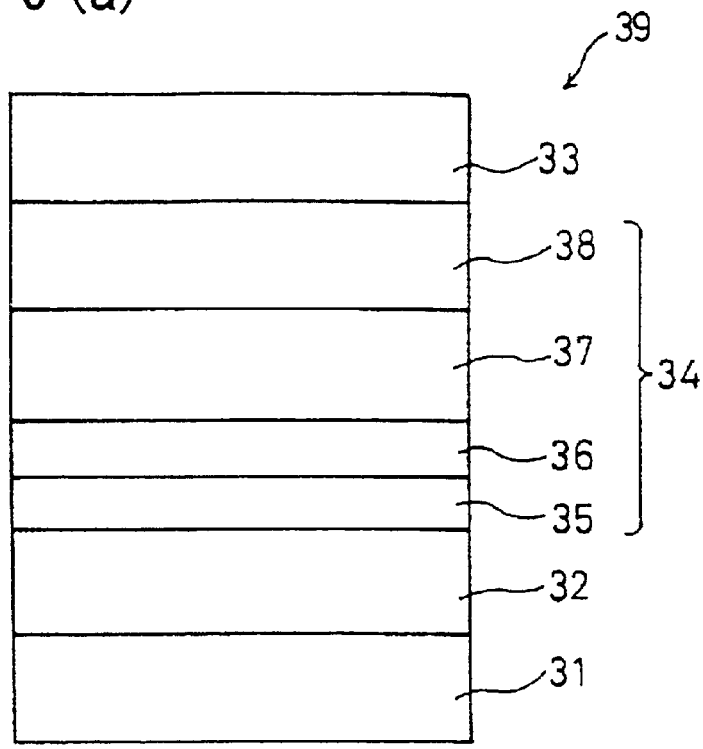
FIGS. 9(*a*) and 9(*b*) show a concept of an organic LED display used in an embodiment, FIG. 9(*a*) being an explanatory drawing showing a layer structure, FIG. 9(*b*) being an explanatory drawing a chemical structure.
Figure 9:
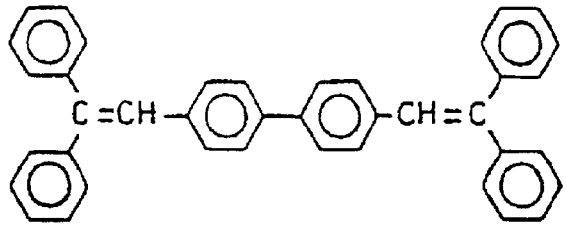

As shown in FIG. 9(*a*), a layered structure 39 is used in which an anode 32, an organic multilayered film 34 (hole entering layer 35, hole transport layer 36, light-emitting layer 37, electron transport layer 38), and a cathode 33 are stacked in this order on a substrate 31.

Incidentally, FIG. 9(*b*) shows biphenyl (DPVBi available from Idemitsu Kosan Co., Ltd) which is an example of the structure of the light-emitting layer 37.

Incidentally, since the present embodiment is described in a preferred combination, it is also an embodiment in a case when the power source line for the electro-optic element in accordance with the present invention and the power source line for the memory means are separate wires. In other words, in FIG. 7, as the memory circuit 9, an arrangement is made so that a gate ON power source wire (voltage Von) and a gate OFF power source wire (voltage Voff) are power source wires and that a voltage can be specified independently from a power source VDD which drives an organic LED display.

The following will describe how the voltage is specified in the present embodiment. According to a grayscale method in accordance with the present invention, an arrangement in which each pixel has a separate static memory or an arrangement in which an SRAM (static random access memory) is included outside the pixel is preferably used.

Figure 30:
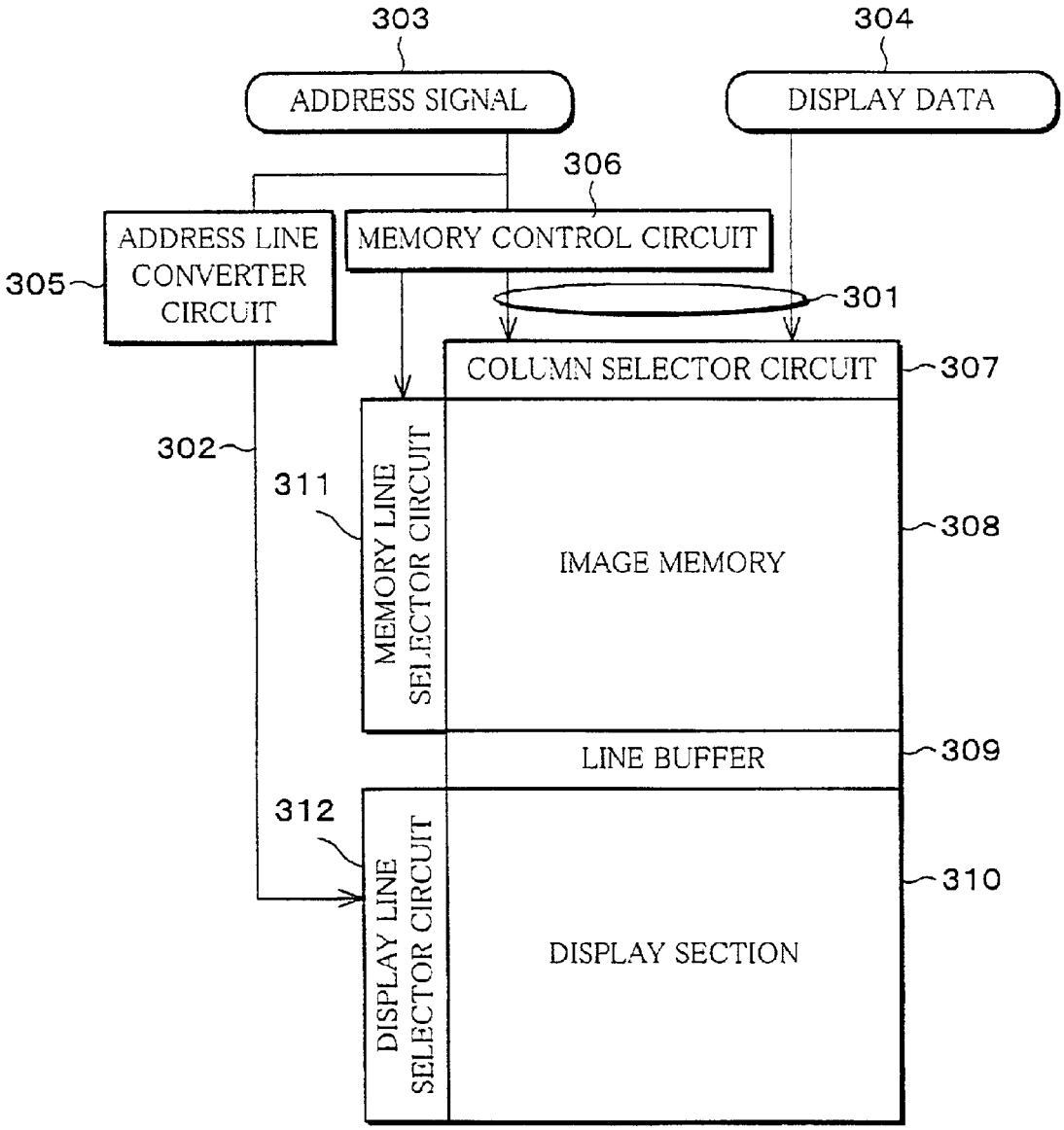
FIG. 30 is an explanatory drawing showing a system configuration of a conventional liquid crystal display which includes a memory for each pixel.
Figure 31:
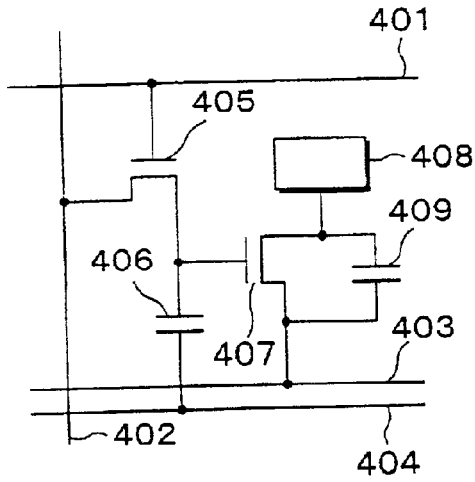
FIG. 31 is a circuit diagram showing a circuit structure of the pixel memory in FIG. 30.
Figure 32:
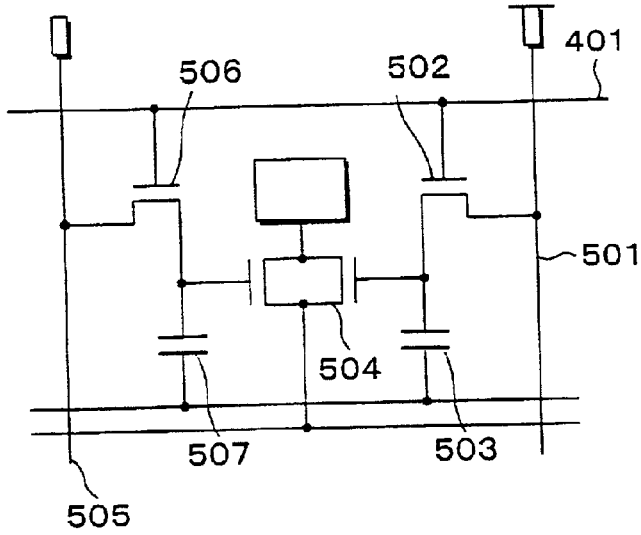
FIG. 32 is a circuit diagram showing another circuit structure of the pixel memory in FIG. 30.
Figure 33:
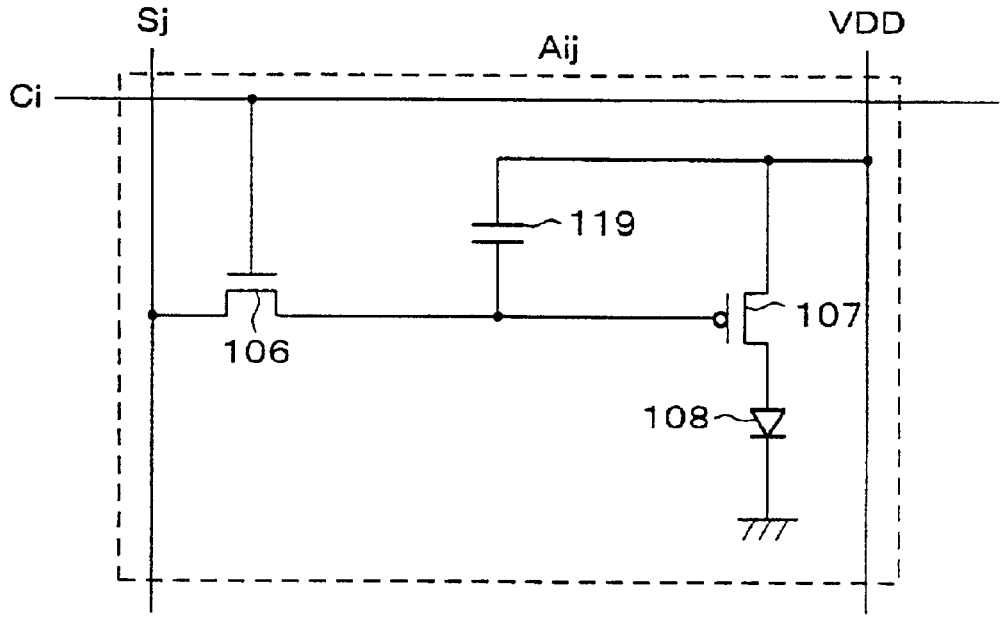
FIG. 33 is a circuit diagram showing a conventional circuit structure.
Figure 34:
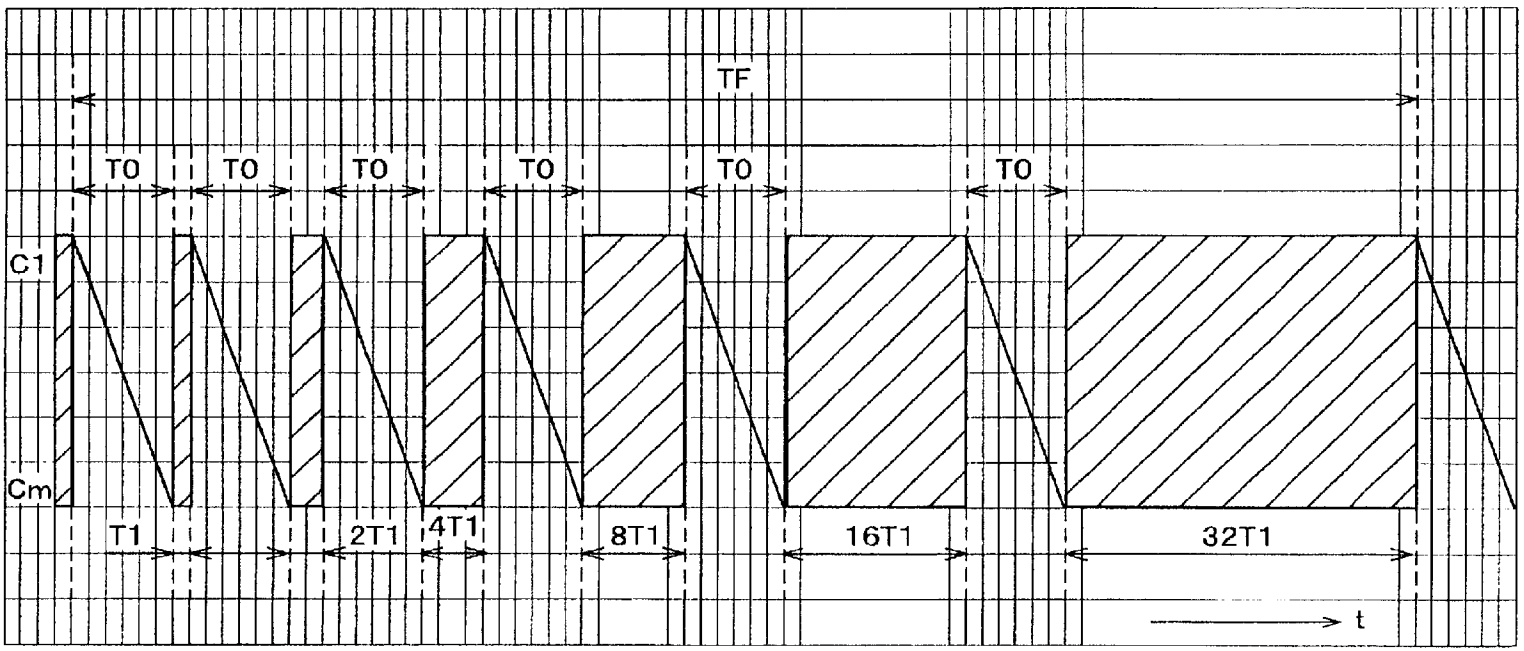
FIG. 34 is an explanatory drawing illustrating a conventional time-ratio gray-scale method.

Tokukai 2000-227608 introduced in the Background of the Invention is one example of such an arrangement that includes an SRAM (static random access memory) outside the pixel. FIG. 30 shows a TFT substrate structure disclosed by the laid-out patent application: as mentioned earlier, an SRAM-based image memory 308 is provided outside the display section 310, and a display section 310 has a pixel memory formed by the capacitors shown in FIG. 31 and FIG. 32 to produce a display from binary data stored in this pixel memory.

In the foregoing arrangement in which each pixel includes a different memory, the output voltage of the memory is applied to the gate electrode of the TFT for driving the organic LED display. Now, what kind of gate voltage is required to stabilize the display will be described.

Figure 10:
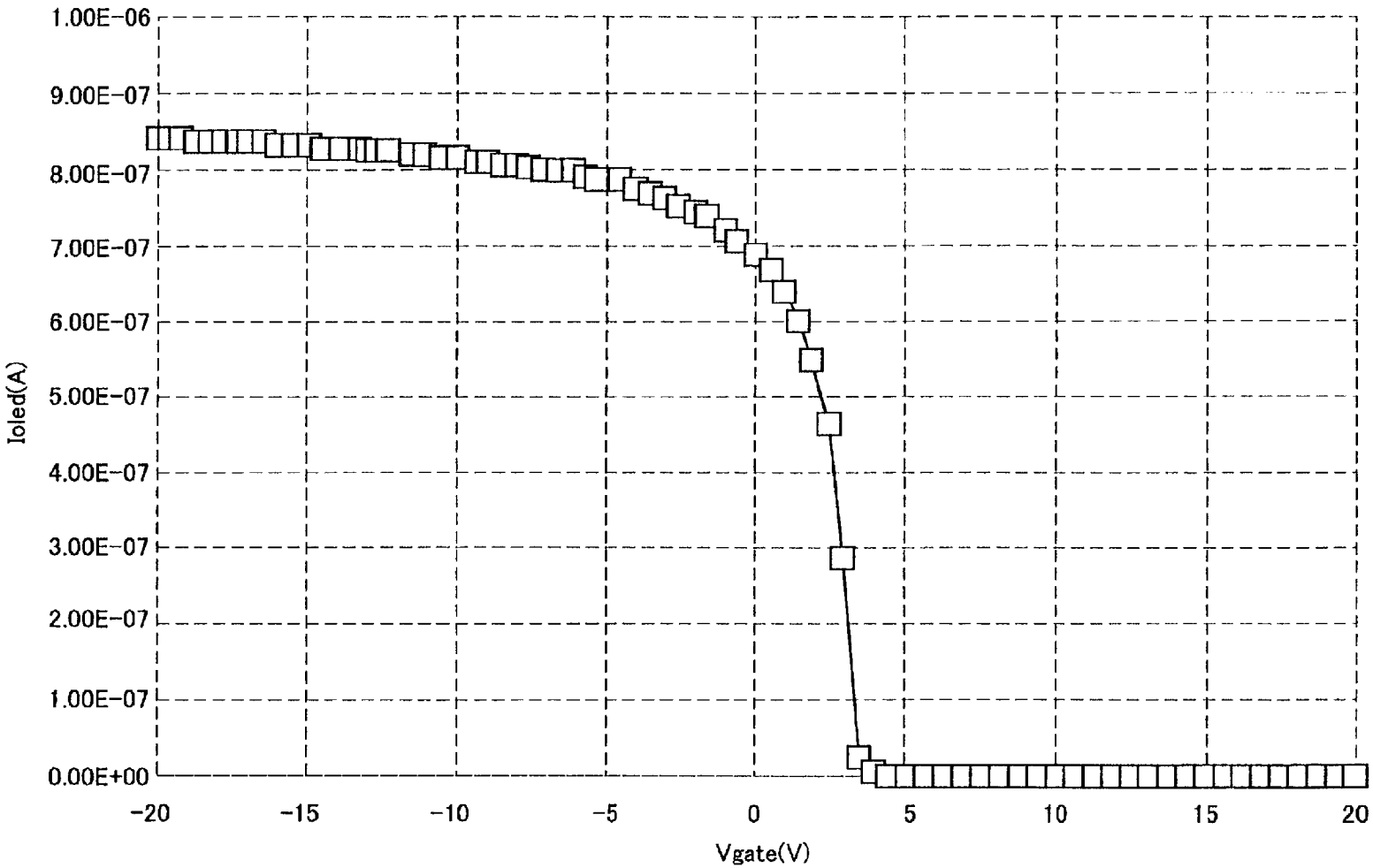
FIG. 10 is a graph showing a gate voltage and organic LED display light-emitting current of a TFT for used in an organic LED display drive used in embodiment 1.

FIG. 10 shows a result of simulation of relationship of characteristics, Ioled, of a current running through a gate voltage Vgate of a driver TFT and an organic LED display in an arrangement in which an organic LED display whose applied-voltage-versus-current characteristics are shown in FIG. 8 is connected in series with a driver TFT.

As would be understood from FIG. 10, a self-luminous element, such as the organic LED display, changes the value of the current running in the organic LED display depending on whether the gate voltage of the driver TFT is −5 V or −2 V.

In other words, it would be understood that even if the memory outputs normal logic output voltages (VDD, GND), it is insufficient as a voltage to be applied to the gate electrode of a TFT to drive the organic LED display.

Worse than that, we have found out that with the circuit structure disclosed in Tokukai 2000-227608 (see FIG. 31), a change in the electric charges stored in the capacitor 406 causes a change in the gate voltage of the driver TFT 407 and a change in brightness of emitted light. The same holds true with FIG. 32.

Figure 29:
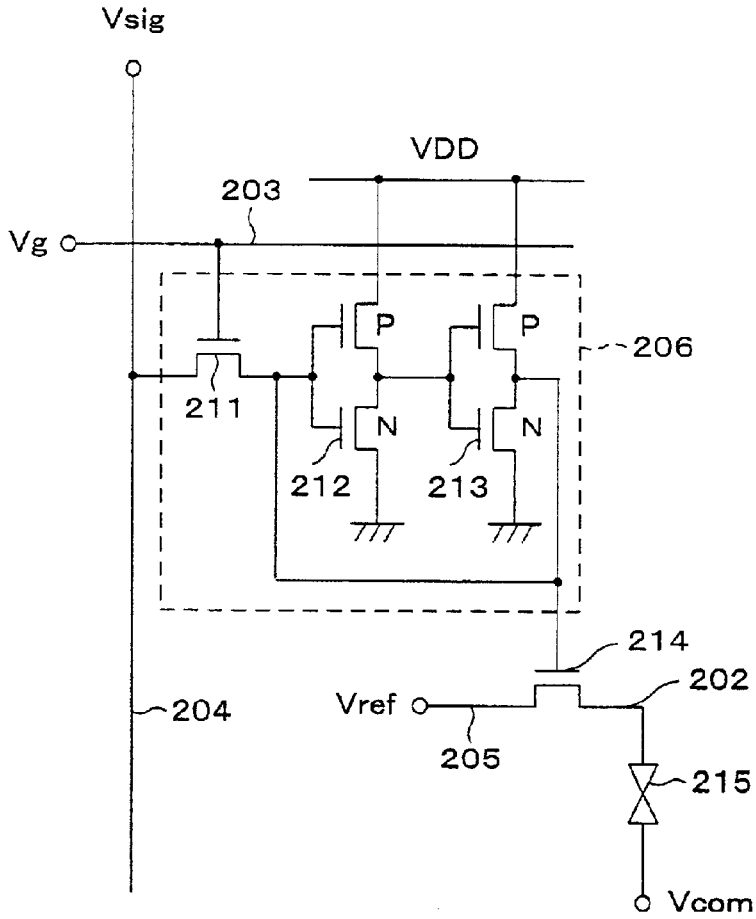
FIG. 29 is a circuit diagram showing a circuit structure of the pixel memory in FIG. 28.

Tokukaihei 8-194205 introduced in the Background of the Invention is one example of such an arrangement that include a different static memory for each pixel; as mentioned earlier, the TFT substrate structure disclosed in the laid-open patent application (see FIG. 29) includes a different static memory 206 for each pixel to produce a binary display from the data stored in the pixel memory. In this structure, as the gate voltage of the driver TFT 214, the power source voltage VDD for the logic circuit or the GND voltage is directly used. To drive an self-luminous element, such as the organic LED display, voltage and current are preferably selected so that the V-I characteristics changes little in the relationship between the gate voltage V of the driver TFT in FIG. 10 and the characteristics I of the current running through the organic LED display.

This is because in a driver TFT for use with an self-luminous element, such as an organic LED display, a change in the gate voltage results in a change in brightness of emitted light. However, in a structure in which the power source voltage VDD or GND is directly used, suitable selection of voltage is impossible.

In contrast, according to the arrangement of the present embodiment, as will be described below, a pixel memory circuit can be obtained which is suitable to a display device including different memories for different pixels and also which has stable brightness characteristics when used in a self-luminous element, such as an organic LED display.

FIG. 10 shows V-I characteristics obtained by simulation of the relationship of the gate voltage V of the p-type TFT 7 and the current I running through the organic LED display 8 in a combination of a p-type TFT 7 which is used to drive an organic LED display shown in FIG. 7 and an organic LED display 8 whose V-I characteristics are shown in FIG. 8 when the power source voltage VDD is approximately 6 V.

As would be understood from FIG. 10, the gate OFF voltage of the p-type TFT 7 of about 4 V or greater will generate a satisfactory 0 $\mu$A; however, a gate ON voltage of 0 V is still insufficient, and that of about −5 V or lower will generate a stable, approximate 0.8 $\mu$A.

For example, taking the gate OFF voltage to Voff=5 V and the variation of the gate ON voltage Von, to (Gate ON Voltage: Von−Gate OFF Voltage: Voff)×(1±0.1), a 0-V gate ON voltage results in a brightness deviation of about ±3%, but a −5 V gate ON voltage results in a small brightness deviation of about ±1%.

The gate voltage of the TFT used to drive the organic LED display is variable due to stray capacitances with surrounding wiring; therefore, setting the gate ON voltage of the organic LED display driver TFT to such a voltage that produces smaller brightness deviations is effective.

By thus connecting a source terminal of one of the two TFTs (transistors) in the inverter circuit which is an output end of the static memory element provided to each pixel which is means 2 in accordance with the present invention to an ON brightness setting wire and the drain terminal of the other TFT (transistor) to an OFF brightness setting wire, the output potential of the static memory element can be rendered a suitable ON potential or OFF potential.

The structure is effective not only with means 1 in accordance with the present invention, but generally with a structure including a static memory element in each pixel.

Accordingly, in the present embodiment, the organic LED display drive voltage is set to +6 V, the gate ON voltage Von is set to −5 V, and the gate OFF voltage Voff is set to +5 V.

In other words, in FIG. 7, the gate OFF power source wire (voltage Voff) is a power source wire at about 5 V, and the gate ON power source wire (voltage Von) is a power source wire at about −5 V. The gate OFF voltage wire (voltage Voff) is connected to the gate wire of the driver TFT 7 via the p-type TFT 13, and the gate ON voltage wire (voltage Von) is connected to the gate wire of the driver TFT 7 via the n-type TFT 14.

Using such a circuit structure, suitable ON and OFF voltages can be supplied to the gate wire of the organic LED display driver TFT. Incidentally, the p-type TFT 13 an the n-type TFT 14 in FIG. 7 forms an inverter circuit. Accordingly, by adding forming another inverter circuit stage with a p-type TFT 11 and a n-type TFT 12 and connecting the gate electrode of one to the output electrode of the other and vice versa, a static memory can be formed based on the memory circuit 9.

Figure 11:
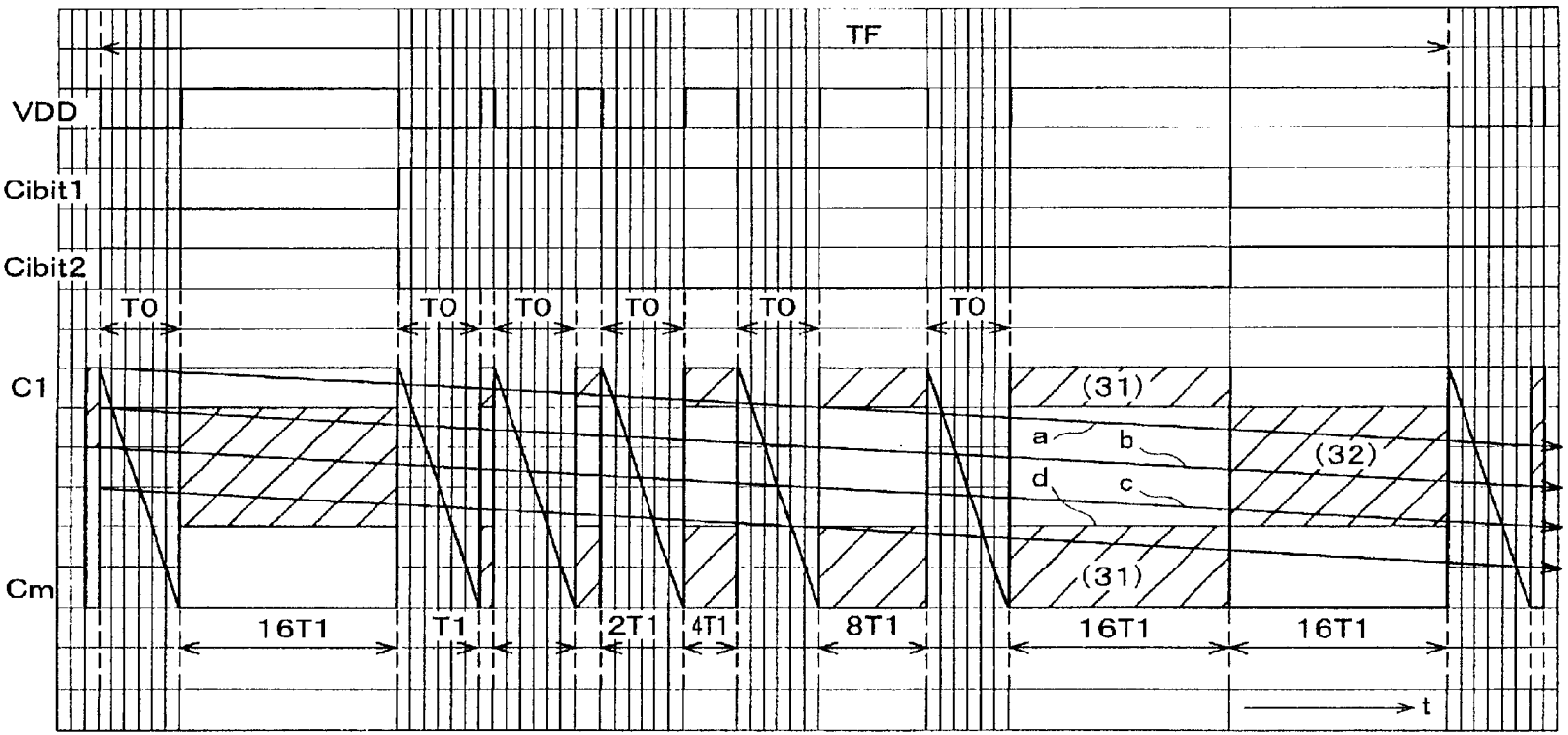
FIG. 11 is an explanatory drawing showing effects of a moving picture breakup, in accordance with the present invention, used in embodiment 5.

FIG. 11 shows a method of controlling the display state of the organic LED element 8.

Specifically, by rendering the power source VDD GND potential (or below GND potential, for example, −6 V) and the control line Cibit2 to a selection state within a first part, TO, of a single frame period TF, the TFT 21 is turned to a conducting state, the TFT 6 (or the source-drain thereof) is turned to a conducting state sequentially for each scan line, and the highest-order bit data is recorded in the memory circuits in the pixels of all the scan lines.

Thereafter, within a period 16T1, the power source VDD is set to +6 V, and a voltage Von or a voltage Voff corresponding to the data stored in the memory circuit 9 is applied to the gate electrode of the organic LED display driver TFT 7.

Thereafter, the TFT 21 is turned to a non-conducting state by turning the control line Cibit2 to a non-selection state and the TFT 20 is turned to a conducting state by turning the control line Cibit1 to a selection state.

During this moment, within the period T0, the TFT 6 (or the source-drain thereof) is turned to a conducting state sequentially, the power source VDD is rendered GND potential, a potential which is equivalent to a low-order bit is built up in the capacitor 22, then the power source VDD is rendered +6 V only for a period corresponding to the weight of the bit, and either the voltage Von or the voltage Vof f corresponding to the data stored in the capacitor 22 is applied to the gate electrode of the organic LED display driver TFT 7.

After completing the display corresponding to the last, low-order bit, the TFT 20 is turned to a non-conducting state by turning the control line Cibit1 to a non-selection state, and the TFT 21 is turned to a conducting state by turning the control line Cibit2 to a selection state, and either the voltage Von or the voltage Voff, stored in the memory circuit 9, which corresponds to the highest-order bit data is applied to the gate electrode of the organic LED display driver TFT 7.

Figure 35:
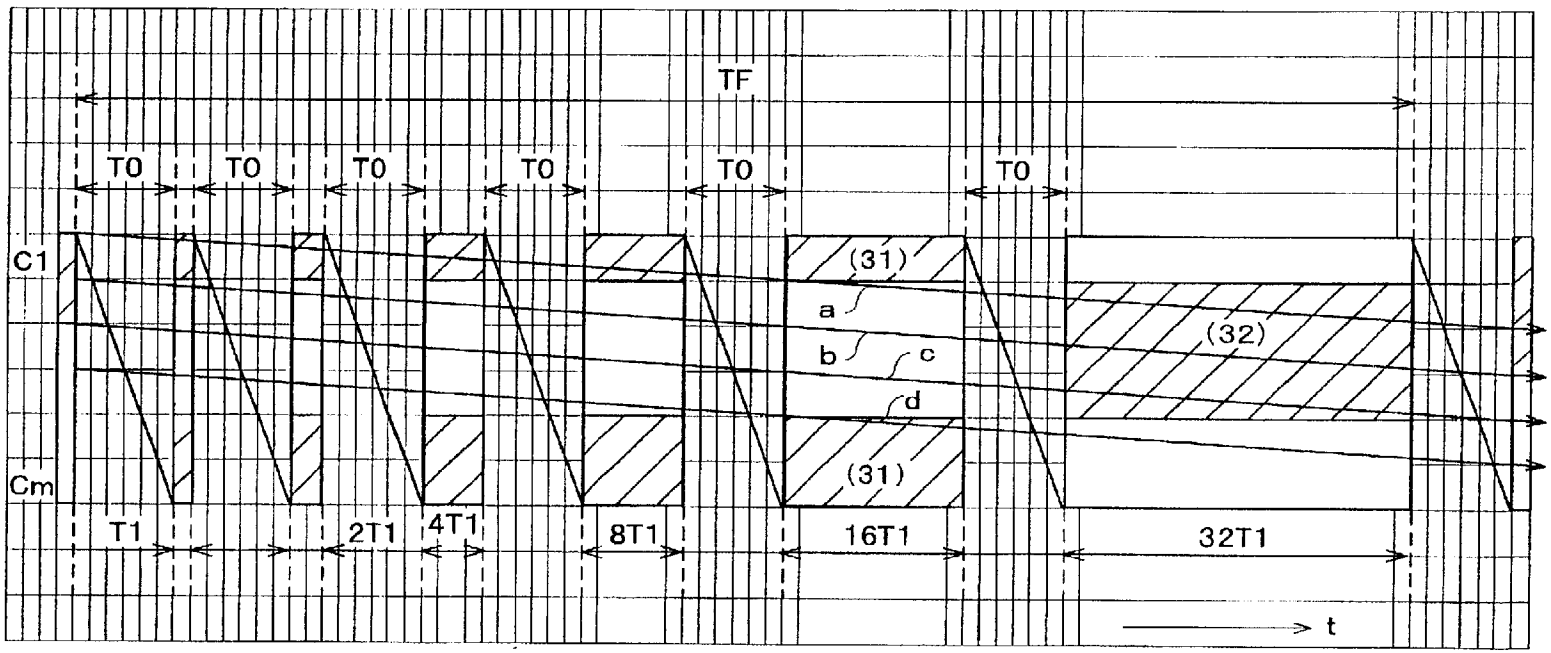
FIG. 35 is an explanatory drawing showing principles of the development of a moving picture breakup.

By such scanning, as shown in FIG. 11, when a pattern drawn by the tone level 32 moves on a background drawn by the tone level 31, even if the eye moves along the broken lines (a) to (d) in FIG. 11, there are fewer errors in a tone pattern upon eye movement over a pixel over which the eye moves than the conventional example in FIG. 35.

For example, as to the broken line (a), the eye movement comes across tones 1, 2, 4 and a light-on timing 32/2, and the tone level 23 (=1+2+4+32/2) is visible. As to the broken line (d), the eye movement comes across light-on timings of tones 32/2, 8, 16, and the tone level 40 (=32/2+8+16) is visible. The errors of these values with respect to the original tone levels 31, 32 are reduced by about a half, when compared to the case of FIG. 35.

in this manner, by providing a memory and a capacitor to each pixel and controlling the capacitor independently from the value of the memory, the driving method of the present embodiment becomes possible. The present embodiment is effective in restraining moving picture breakups as shown in FIG. 11, without having to change the required number of scans when compared to the conventional example shown in FIG. 35.

Incidentally, the pixel memory circuit 9 in FIG. 7 operates as follows:

(1) To update the data in the memory circuit 9, the TFT 6 is turned to a conducting state using the scan line Ci, as a control line, and the TFT 21 is turned to a conducting state using the control line Cibit2, from the data wire Sj, as a signal line, the voltage Von or Voff corresponding to the data is supplied to an input end of the first inverter circuit (circuit of the p-type TFT 11 and the n-type TFT 12), and the value of the memory circuit 9 is updated.

(2) To record data in the memory circuit 9, the TFT 6 or the TFT 21 is turned to a non-conducting state using the scan line (control line) Ci or the control line Cibit2, the output from the second inverter circuit (circuit of the p-type TFT 13 and the n-type TFT 14) is supplied to an input end of the first inverter circuit, and the value of the memory circuit 9 is retained.

(3) Throughout updating and recording of the data in the memory circuit 9, while the TFT 21 is being kept in a conducting state by turning the control line Cibit2 to a selection state, if the p-type TFT 13 in the second inverter circuit is in a conducting state, (regardless whether the TFT 20 is in a conducting or non-conducting state) the gate voltage of the p-type TFT 7 used to drive the organic LED display becomes Voff, and the organic LED display 8 turns to a non-light-emitting state.

(4) Throughout updating and recording of the data in the memory circuit 9, while the TFT 21 is being kept in a conducting state by turning the control line Cibit2 to a selection state, if the n-type TFT 14 in the second inverter circuit is in a conducting state, (regardless whether the TFT 20 is in a conducting or non-conducting state) the gate voltage of the p-type TFT 7 used to drive the organic LED display becomes Von, and the organic LED display 8 turns to a light-emitting state.

By doing this, the voltage Von or Voff which binary-drives the organic LED display suitably is supplied to the gate terminal of the organic LED display driver TFT 7 from the capacitor 22 as well as from the memory circuit 9. As a result, moving picture breakups are restrained and a display which boasts superior tone linearity becomes possible.

Figure 28:
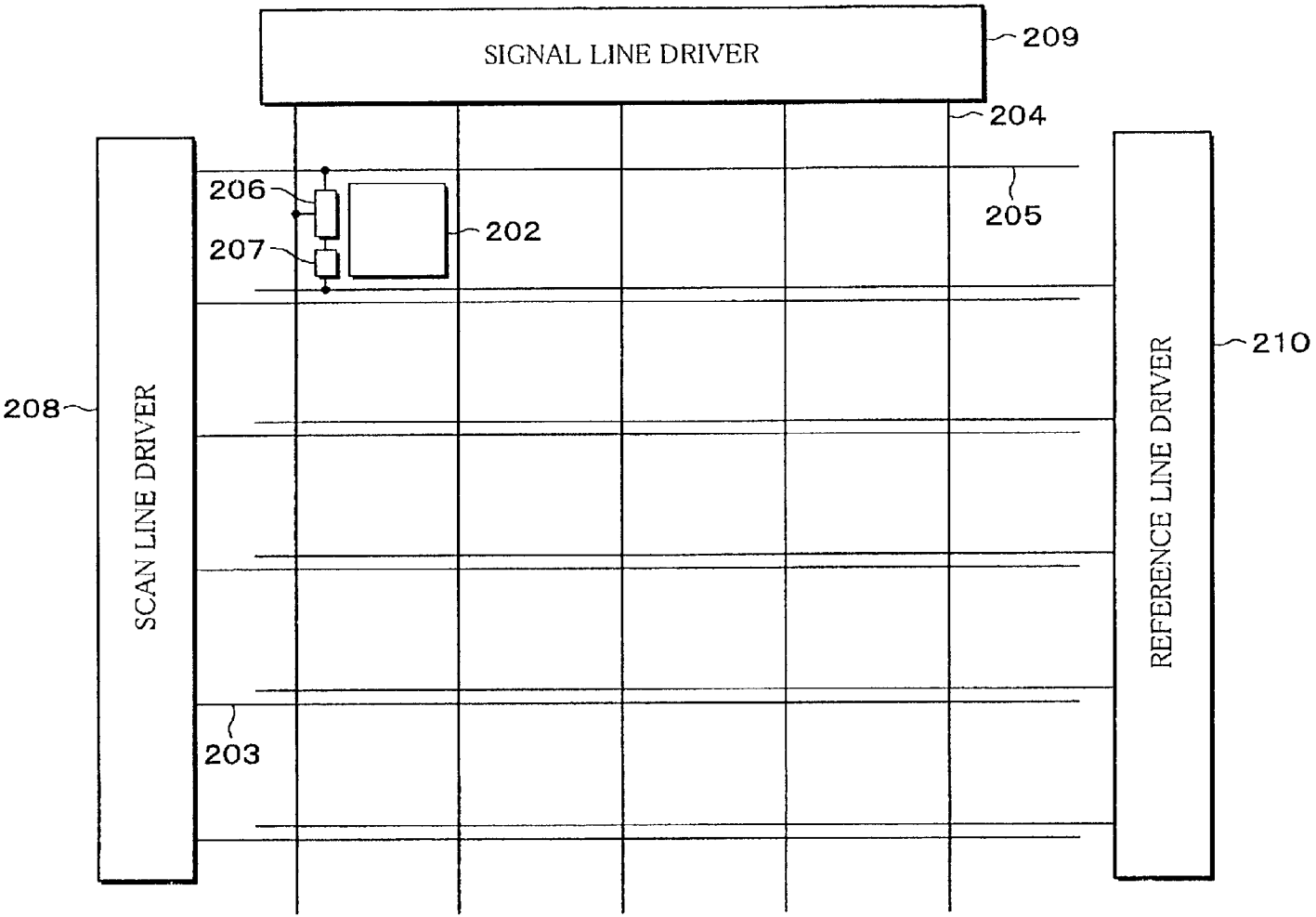
FIG. 28 is an explanatory drawing showing a system configuration of a conventional liquid crystal display which includes a memory for each pixel.

Incidentally, in the present embodiment, the second means in accordance with the present invention is used. Therefore, no data/voltage converter circuit, such as a signal line driver, needs to be inserted as shown in FIG. 28 in association to a conventional technique. Instead, the data in the SRAM located outside the pixel is transmitted to a static memory in the pixel with no modification at all. Accordingly, in FIG. 12, a system configuration is suggested which is suitable as the pixel TFT circuit of the present embodiment.

In other words, FIG. 12 shows a structure in which the display incorporates, as an integral part therefor, the SRAM 4 (second memory element) to which the CPU (Central Processing Unit) 1 writes image (additionally, text and the like) data from which a display is produced on the display 3. The SRAM 4 per se may be either built integrally in the display by the aforementioned CGS TFT fabrication process or fabricated as a separate IC by a monocrystalline semiconductor process for mounting to the display 3. In the latter case, the IC may be either directly mounted to the display 3 or mounted to a tape having copper foil wiring thereon by TAB (Tape Automated Bonding) so that the resultant TCP (Tape Carrier Package) is bonded to the display substrate.

Incidentally, 2 is a flash memory located externally to the display. 5 is a controller/driver circuit which writes the data in the SRAM 4 to the pixel 10. The pixel 10 has a circuit structure identical to the pixel TFT circuit structure in FIG. 7.

Figure 13:
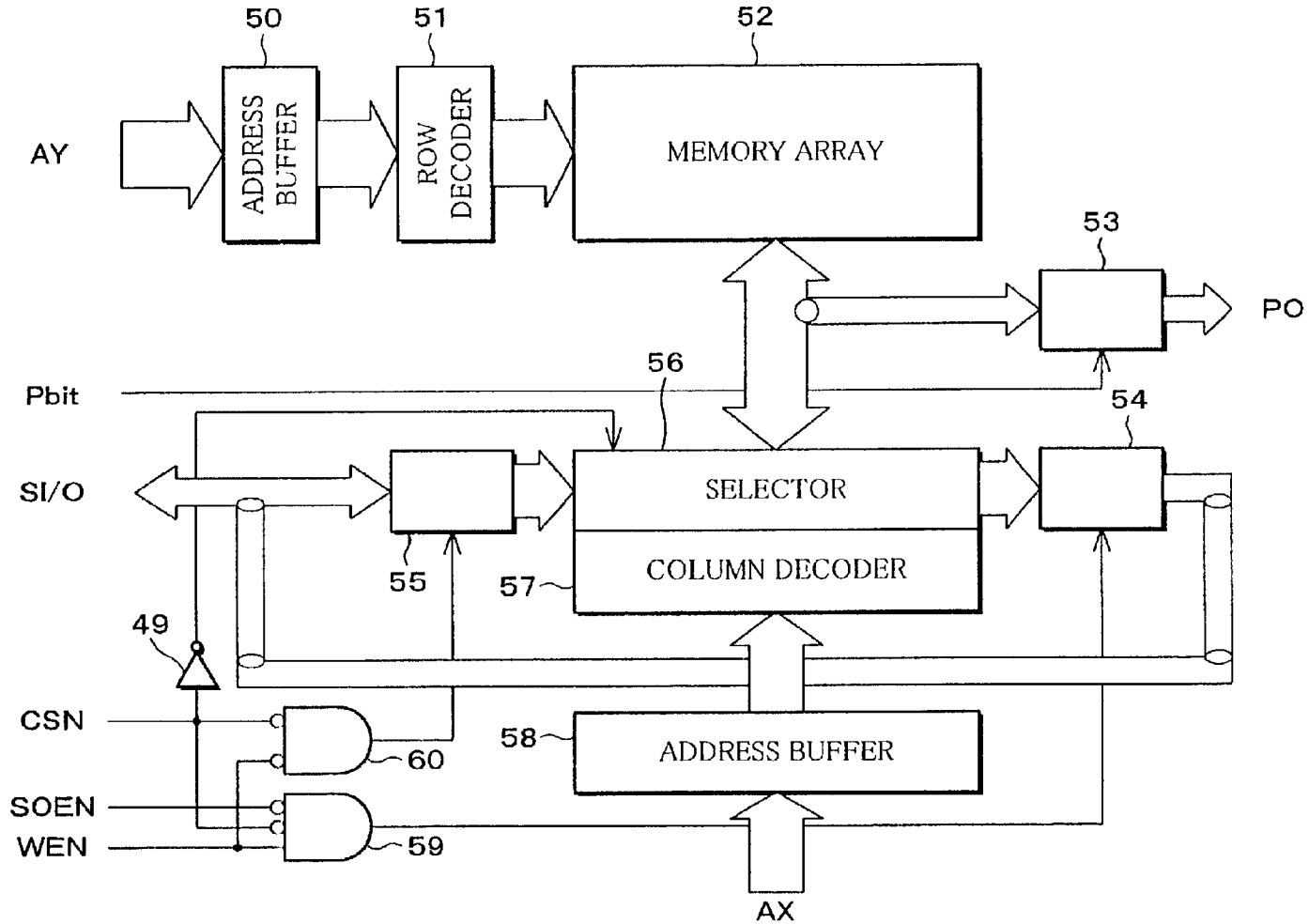
FIG. 13 is a block diagram showing a circuit structure of a SRAM in FIG. 12.

Apart from a serial I/O port (serial IN control circuit 55 and serial OUT control circuit 54) to the CPU 1, the SRAM 4, as shown in FIG. 13, has a port (parallel OUT control circuit 53) for parallel outputs of data, for the display 3, corresponding to one column (pixel Ail to pixel Aim) on the side of the SEG (signal line driver). Otherwise, the SRAM 4 is identical to a typical SRAM circuit and has address buffers 50, 58, a row decoder 51, a column decoder 57, a selector 56, and a memory array 52. 59, 60 are AND circuits.

Using this SRAM, the externally input data for each pixel is converted to data for each bit described earlier in association with the driving method and written directly from the SRAM to the pixel memory; as a result, the data does not need to be transmitted serially from the SRAM to the SEG driver. Energy is saved and the display overall consumes less electric power. Also, the user can use the display without paying attention to the employment of such a driving method.

In such a display including a memory element provided to a pixel, the disposition of the second memory element (memory array) outside the pixel (display region) which is the second means in accordance with the present invention is greatly effective.

Incidentally, in the pixel TFT circuit structure in FIG. 7, the gate ON voltage wire (voltage Von)and the power source VDD used to drive the organic LED display are provided as separate wires; however, the V-I characteristics in FIG. 10 tells that a Von of 4 V or higher is all required, and the 6-V VDD can be used. In this case, the gate ON voltage wire (voltage Von) and the power source VDD used to drive the organic LED display can be provided as a single, common wire.

[Embodiment 6]

FIGS. 14–18 show another embodiment of means 1 and means 2 in accordance with the present invention.

Figure 14:
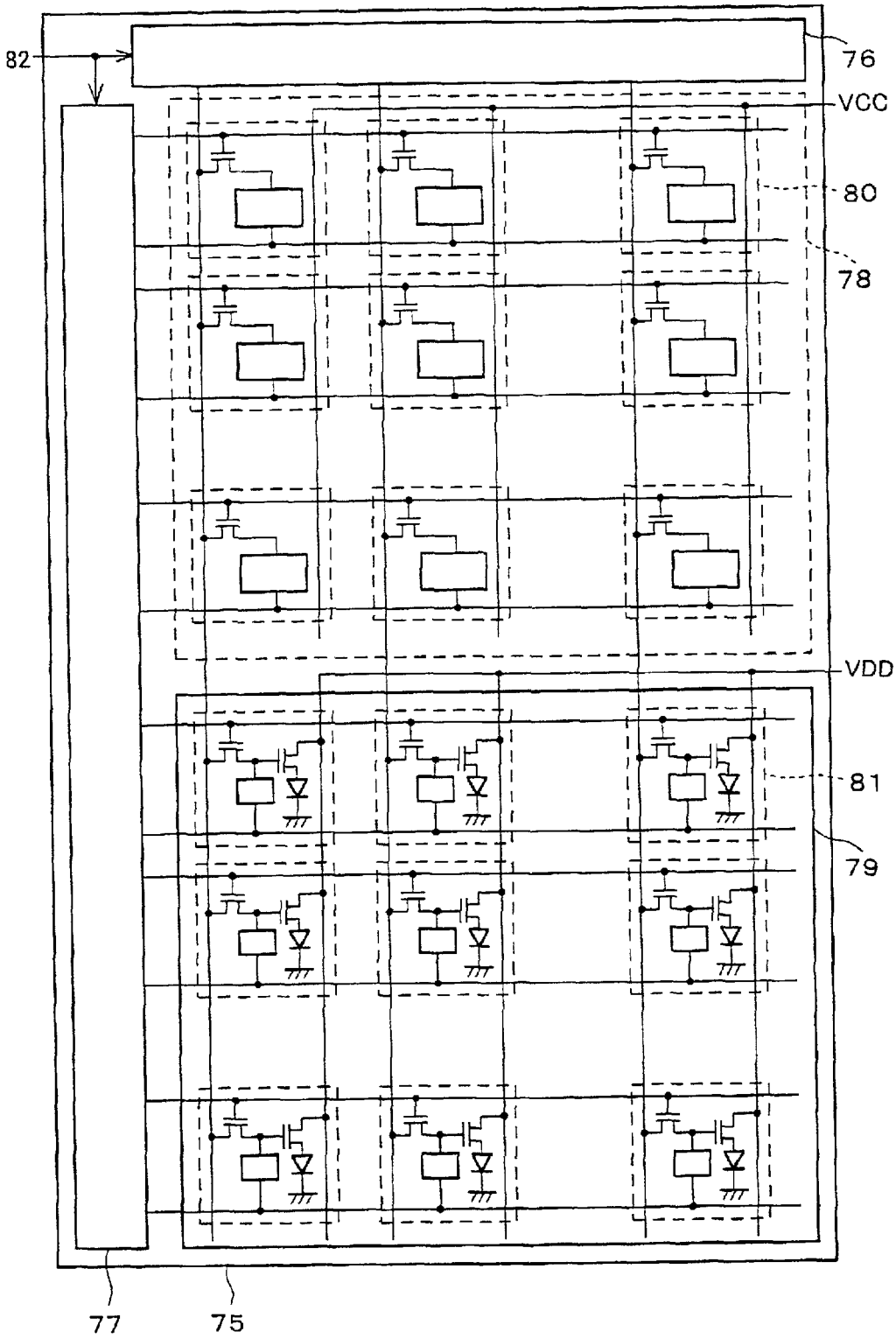
FIG. 14 is a block diagram showing a system configuration of a display, used in embodiment 6, which includes a memory for each pixel.

FIG. 14 shows a case where the bit data for a pixel is transmitted line by line similarly to conventional liquid crystal displays. In this case, on a substrate 75 are there provided a serial/parallel converter circuit 76, a controller 77, pixels 81 in display regions 79, and memory cells 80 in memory areas 78 situated external to the pixels.

Figure 15:
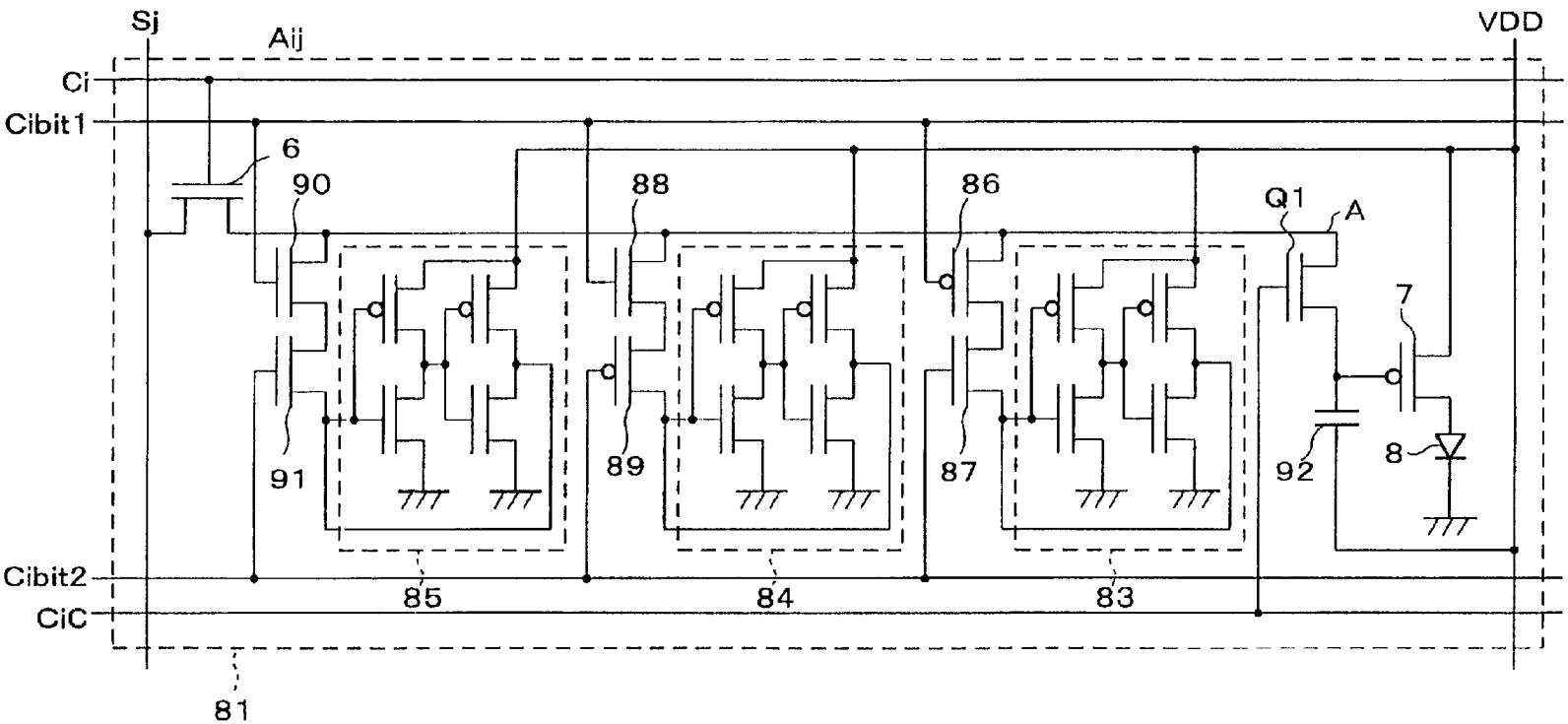
FIG. 15 is an equivalent circuit diagram showing a circuit structure of a pixel used in embodiment 6.
Figure 16:
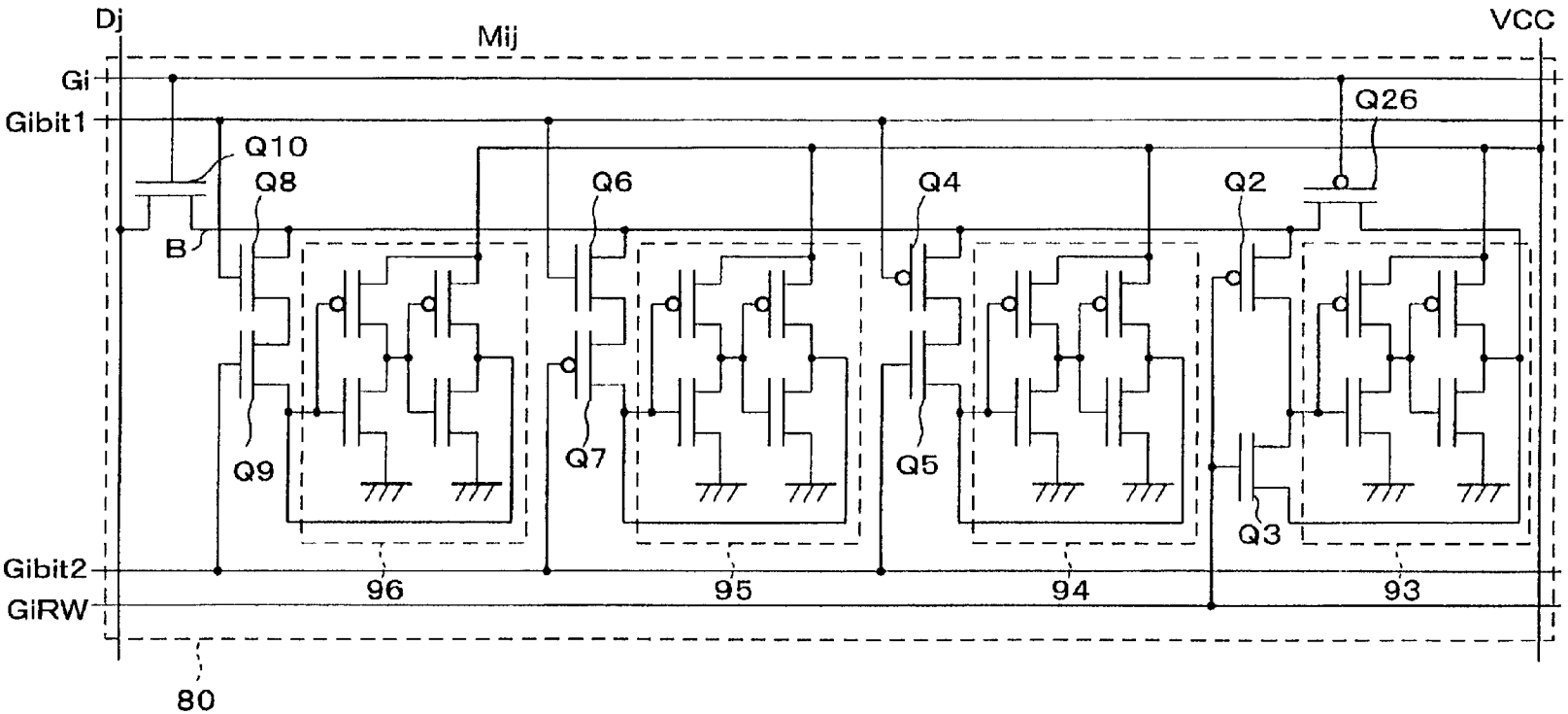
FIG. 16 is an equivalent circuit diagram showing a circuit structure of a memory cell used in embodiment 6.

FIG. 15 shows, as an example, an equivalent circuit structure of the display pixel, and FIG. 16 shows, as an example, an equivalent circuit structure of the memory cell.

Specifically, FIG. 15 is an embodiment of the first arrangement of the first means in accordance with the present invention. The pixel 81 includes a TFT (first switching element) 6, an organic LED display (an electro-optic element) 8, a capacitor (TFT 7, potential maintaining means)

92 which drives the organic LED display 8, and memories (memory means) 83–85. The TFT 6 is connected at the source electrode thereof to a signal wire Sj, at the gate electrode thereof to a scan wire Ci, and at the drain electrode thereof to a wire A. Between each of the memories 83–85 and the wire A are there interposed TFTs (second switching elements) 86–91 whose gate electrodes are connected to control lines Cibit1 and Cibit2.

In this case, when the TFT 6 is in a non-conducting state, since the memory 83 is connected to the p-type TFT 86 and the n-type TFT 87, if the control line Cibit1 is LOW and the control line Cibit2 is HIGH, the data in the memory 83 is output to the wire A. Further, since the memory 84 is connected to the n-type TFT 88 and the p-type TFT 89, if the control line Cibit1 is HIGH and the control line Cibit2 is LOW, the data in the memory 84 is output to the wire A. Further, since the memory 85 is connected to the n-type TFT 90 and the n-type TFT 91, if the control lines Cibit1 and Cibit2 are both HIGH, the data in the memory 85 is output to the wire A.

When the TFT 6 is in a conducting state, if the control line Cibit1 is LOW and the control line Cibit2 is HIGH, the data in the signal wire Sj is written to the memory 83. Further, if the control line Cibit1 is HIGH and the control line Cibit2 is LOW, the data in the signal wire Sj is written to the memory 84. Further, if the control lines Cibit1 and Cibit2 are both HIGH, the data in the signal wire Sj is written to the memory 85.

A TFT Q1 is connected between the capacitor 92 and the wire A. A control line CiC is connected to the gate electrode of the TFT Q1. Accordingly, when the TFT Q1 is in a conducting state, the potential of the capacitor 92 is the potential given to the wire A. When the TFT Q1 is in a non-conducting state, the potential of the capacitor 92 is retained. The driver TFT 7 used to drive the organic LED display 8 is controlled through the potential of the capacitor 92.

FIG. 16 shows the memory cell 80 which is another embodiment of the first means in accordance with the present invention. In the memory cell 80 are there provided a TFT (first switching element) Q10 and memories (memory means) 93–96. The TFT Q10 is connected at the source electrode thereof to a signal wire Dj, at the gate electrode thereof to a gate wire Gi, and at the drain electrode thereof to a wire B. The memories 94–96 are connected to TFTs (second switching elements) Q4–Q9 whose gate electrodes are connected to control lines Gibit1, Gibit2.

In this case, when the TFT Q1 is in a conducting state and there is no output from the serial/parallel converter circuit 76, since the memory 94 is connected to the p-type TFT Q4 and the n-type TFT Q5, if the control line Gibit1 is LOW and the control line Gibit2 is HIGH, the data in the memory 94 is output to the wire B. Further, since the memory 95 is connected to the n-type TFT Q6 and the p-type TFT Q7, if the control line Gibit1 is HIGH and the control line Gibit2 is LOW, the data in the memory 95 is output to the wire B. Further, since the memory 96 is connected to the n-type TFT Q8 and the n-type TFT Q9, if the control lines Gibit1 and Gibit2 are both HIGH, the data in the memory 96 is output to the wire B.

When the TFT Q1 is in a conducting state and there is an output from the serial/parallel converter circuit 76, if the control line Gibit1 is LOW and the control line Gibit2 is HIGH, the data in the signal wire Dj is written to the memory 94. Further, if the control line Gibit1 is HIGH and the control line Gibit2 is LOW, the data in the signal wire Dj is written to the memory 95. Further, if the control lines Gibit1 and Gibit2 are both HIGH, the data in the signal wire Dj is written to the memory 96.

Further, a p-type TFT Q2 is interposed between the input terminal of the memory 93 and the wire B. To the gate electrode thereof is connected a control line GiRW. An n-type TFT Q3 is interposed between the second inverter output terminal (output terminal) of the memory 93 and the first inverter input terminal (input terminal) thereof. To the gate electrode thereof is connected a control line GiRW. Further, a p-type TFT Q26 is interposed between the second inverter output terminal and the wire B. To the gate electrode thereof is connected a gate wire Gi.

As a result, if the gate wire Gi is HIGH and the control line GiRW is LOW, the data in the signal line Dj is written to the memory 93. Further, if the gate wire Gi is HIGH and the control line GiRW is HIGH, the data in the memory 93 is retained. Further, if the gate wire Gi is LOW, the data in the memory 93 is output to the wire B.

Since the output impedance of the memory 93 is specified lower than the other memories 94–96, if the gate wire Gi is LOW, and the other memories 94–96 turns into a conducting state with the wire B, the data in the memories is replaced with the data in the memory 93.

In FIG. 14, the input bit data 82 is temporarily stored in a shift register (not shown) in the serial/parallel converter circuit 76 and thereafter stored in a latch (not shown) where data for one line is retained.

From the latch, data for one line is sequentially output for each bit. For example, in a case of a 6-bit tone, as shown in (1) of FIG. 17, data is output line by line for each bit from the 6th bit through the 1st bit.

Part of the output bit data is acquired to a memory located in the pixel 81 in the display region 79 through the control by the control circuit 77 and the rest is acquired to a memory in the memory cell 80 located in the area 78 outside the pixel (display region).

Figure 17:
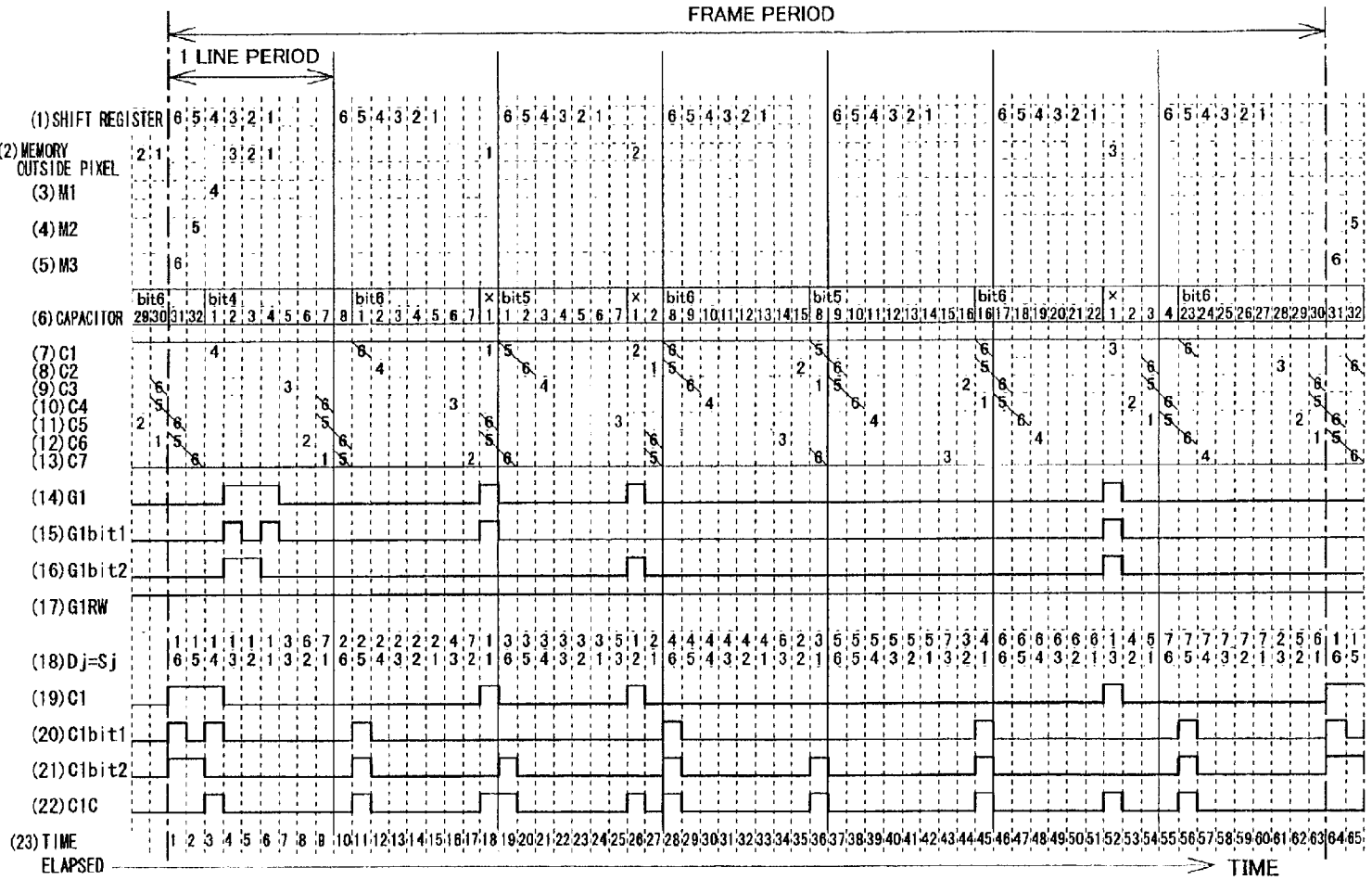
FIG. 17 is a timing diagram of a time-division tone scan method used in embodiment 6.

For example, the 3rd- through 1st-bit data is written to a memory (memories 94–96 in FIG. 16) outside the pixel as shown in (2) of FIG. 17, and the 6th-through 4th-bit data is written to memories M3-M1 (memories 83–85 in FIG. 15) inside the pixel as shown in (3)–(5) of FIG. 17.

Incidentally, the 4th-bit data is simultaneously written also to the capacitor 92 which controls the TFT 7 for driving the organic LED display 8.

FIG. 17(14)–(22) shows the behavior of a control signal for that purpose.

Specifically, supposing that a wire and a signal travelling therethrough are identified by the same number, for example, to describe a case of i=1, when the scan signal C1 in FIG. 17(19) is HIGH, data is written from the outside of the pixel to the memory or capacitor in the pixel. It is the control signal C1bit1 (20) and the control signal C1bit2 (21) that control to which memory data is written. It is the control signal C1C (22) that controls to which capacitor data is written. If the gate signal G1 (14) in FIG. 17 is HIGH, data is written to a memory outside the pixel. It is the control signal G1bit1 (15) and the control signal G1bit2 (16) that control to which memory data is written.

Referring to the total time identified as (23) in FIG. 17, the 4th-bit data display period coincides with 8 selection periods from the 3rd selection period to the 10th selection period as shown in (6). Thereafter, the 6th-bit data is transmitted from the memory inside the pixel to the capacitor 92, to produce a display for 7 selection periods from the 11th through 17th selection period. Thereafter, the 1st-bit data is transmitted from the capacitor 92 to the memory outside the pixel to produce a display for one selection period, that is, the 18th selection period. Thereafter, the 5th-bit data is transmitted 92 from the memory to the capacitor inside the pixel to produce a display for 7 selection periods from the 19th through 25th selection period. Thereafter, the 2nd-bit data is transmitted from the memory outside the pixel to the capacitor 92 to produce a display for 2 selection periods from the 26th through 27th selection period. Thereafter, the 6th-bit data is transmitted from the memory inside the pixel to the capacitor 92 to produce a display for 8 selection periods from the 28th through 35th selection period. Thereafter, the 5th-bit data is transmitted from the memory inside the pixel to the capacitor 92 to produce a display for 9 selection periods from the 36th through 44th selection period. Thereafter, the 6th-bit data is transmitted from the memory inside the pixel to the capacitor 92 to produce a display for 7 selection periods from the 45th through 51th selection period. Thereafter, the 3rd-bit data is transmitted from the memory outside the pixel to the capacitor 92 to produce a display for 4 selection periods from the 52nd through 55th selection period. Thereafter, the 6th-bit data is transmitted from the memory inside the pixel to the capacitor 92 to produce a display for 10 selection periods from the 56th through 68th selection period.

As a result, the display period for the 6th-bit data totals 7+8+7+10=32 selection periods, and that for the 5th-bit data totals 7+9=16 selection periods. If means 2 in accordance with the present invention is used in this manner, the 3-bit memory located in the area 80 outside the pixel, apart from the 3-bit memory located in the pixel 81, can be used to produce a display; therefore, a display in a total of 6-bit tones becomes possible. This produces more tones with less memories arranged in the pixel. Further, the memories located outside the pixel can be reduced as many as the memories located in the pixel. Therefore, the memory area outside the pixel is reduced, and more panels can be cut out of the same glass substrate, which reduces cost and enables fabrication of a smaller display device but with the same display area.

Incidentally, the greatest advantage in locating the memories on the display substrate is reduction in power consumption, which is especially useful in the portable device market.

If a self-luminous element is used as an electro-optic element, it is preferred to use an organic LED display with high light emission efficiency for large amounts of reductions in power consumption.

The effect of locating memories on the display substrate is evident not only when producing a still image, but also when producing simple video switching displays (less than the memories located on the substrate).

Figure 18:
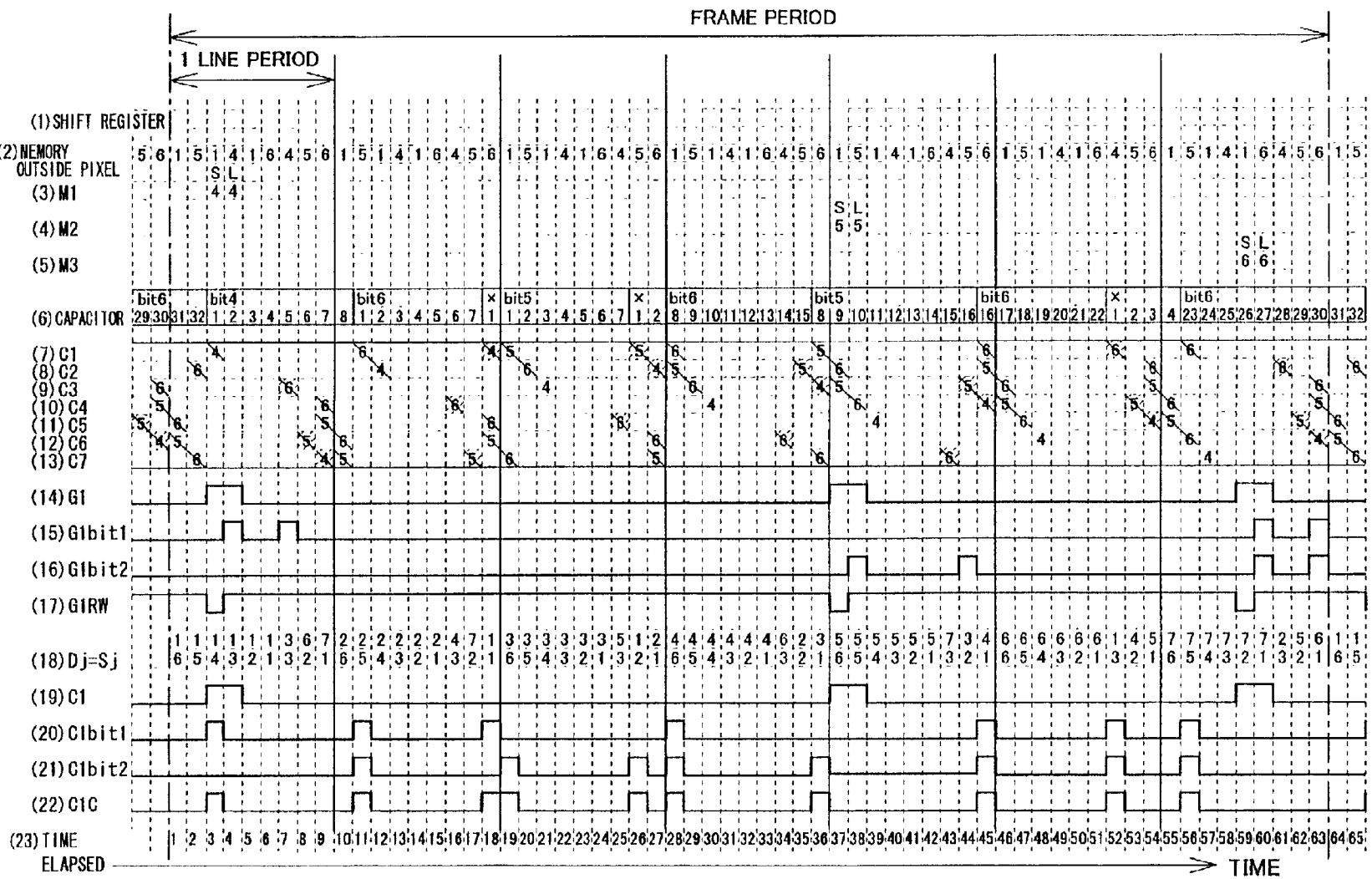
FIG. 18 is a timing diagram of a video switching scan method used in embodiment 6.

A 3-bit memory is located in the pixel in FIG. 15 and a 4-bit memory is located outside the pixel (display region) in FIG. 16. Adopting the structure, two 3-bit tone video images can be displayed by switching between them. FIG. 18 shows the outline of the switching display in which the periods allocated to the 1st through 3rd bit at the display timings in FIG. 17 are allocated anew to the 4th through 6th bits which are memory located in the pixel to produce a 3-bit gray-scale method.

This is because using only those memories located inside the pixels consume less power to produce displays. Further, video switching between two or so displays would presumably require no more than one or two switchings per second; therefore, to display 64 frames per second, one single video image display would last about 30 frames. During that period, only the memories located in the pixel are used to produce the display. Thereafter, contents are swapped between the 3-bit memories located outside the pixel and the 3-bit memories located in the pixel as shown in FIG. 18 only when the video display is switched.

Incidentally, in FIG. 18, in the 3rd selection period, the 4th bit (1st bit in video 1) data is acquired from the memory located in the pixel 84 to the memory 93 located outside the pixel. In the 4th selection period, the 1st bit (lst bit in video 2) data is acquired from the memory outside the pixel 95 to the memory located in the pixel 84. In the 7th selection period, the 4th bit (1st bit in video 1) data is acquired from the memory outside the pixel 93 to the memory outside the pixel 95. In this case, the output impedance of the memories outside the pixels 94–96 is specified lower than the output impedance of the memories located in the pixels 83–85.

Further, in the 37th selection period, the 5th bit (2nd bit in video 1) data is acquired from the memory located in the pixel 83 to the memory 93 located outside the pixel. In the 38th selection period, the 2nd bit (2nd bit in video 2) data is acquired from the memory outside the pixel 94 to the memory located in the pixel 83. In the 44th selection period, the 5th bit (2nd bit in video 1) data is acquired from the memory outside the pixel 93 to the memory outside the pixel 94.

Further, the 59th selection period, the 6th bit (3rd bit in video 1) data is acquired from the memory located in the pixel 85 to the memory 93 located outside the pixel. In the 60th selection period, the 3rd bit (3rd bit video 2) data is acquired from the memory outside the pixel 96 to the memory located in the pixel 85. In the 63rd selection period, the 6th bit (3rd bit in video 1) data is acquired from the memory outside the pixel 93 to the memory outside the pixel 96.

The 3-bit data in the memory located in the pixel is thus exchanged with the 3-bit data in the memory located outside the pixel.

in this manner, with the first means and the second means in accordance with the present invention, the display can be switched between multiple video images without applying power to the an external information source, such as a CPU and therefore the present invention can reduce power consumption by significant amounts.

[Embodiment 7]

Figure 19:
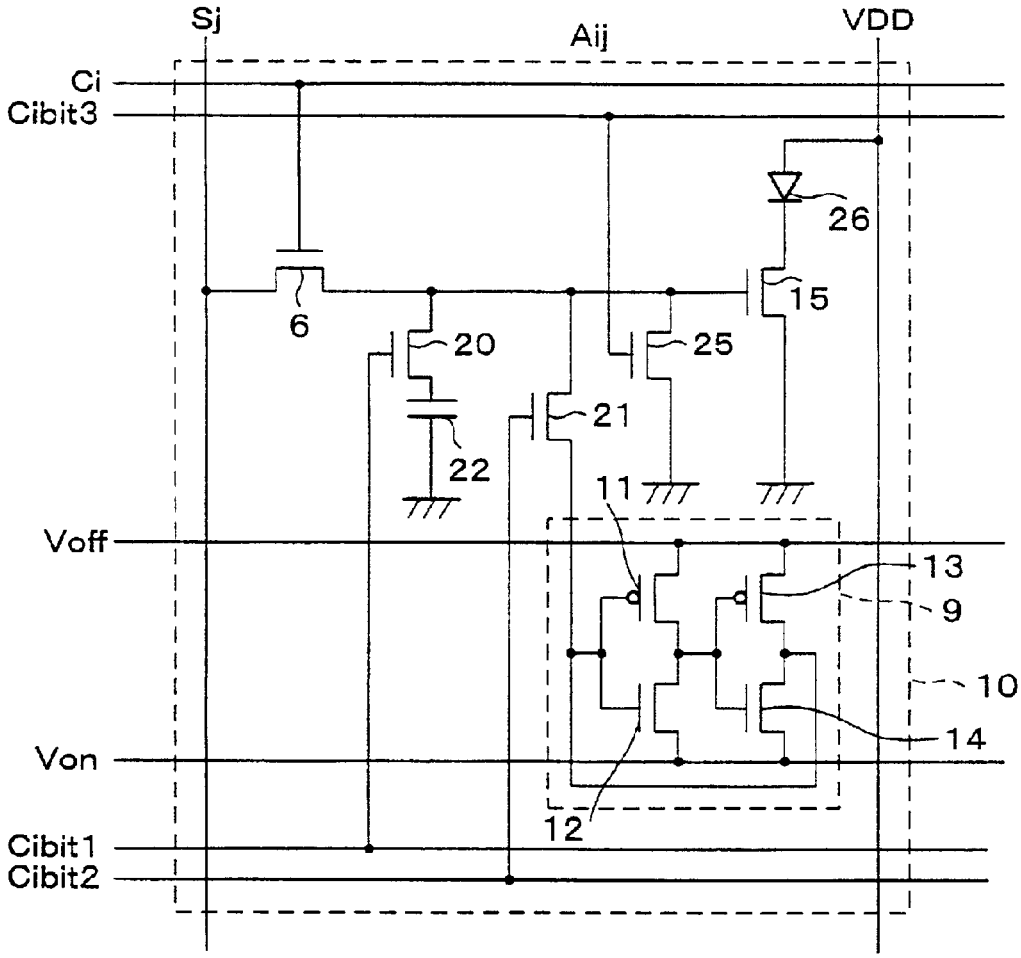
FIG. 19 is a circuit diagram showing a circuit structure of a pixel used in embodiment 7.
Figure 20:
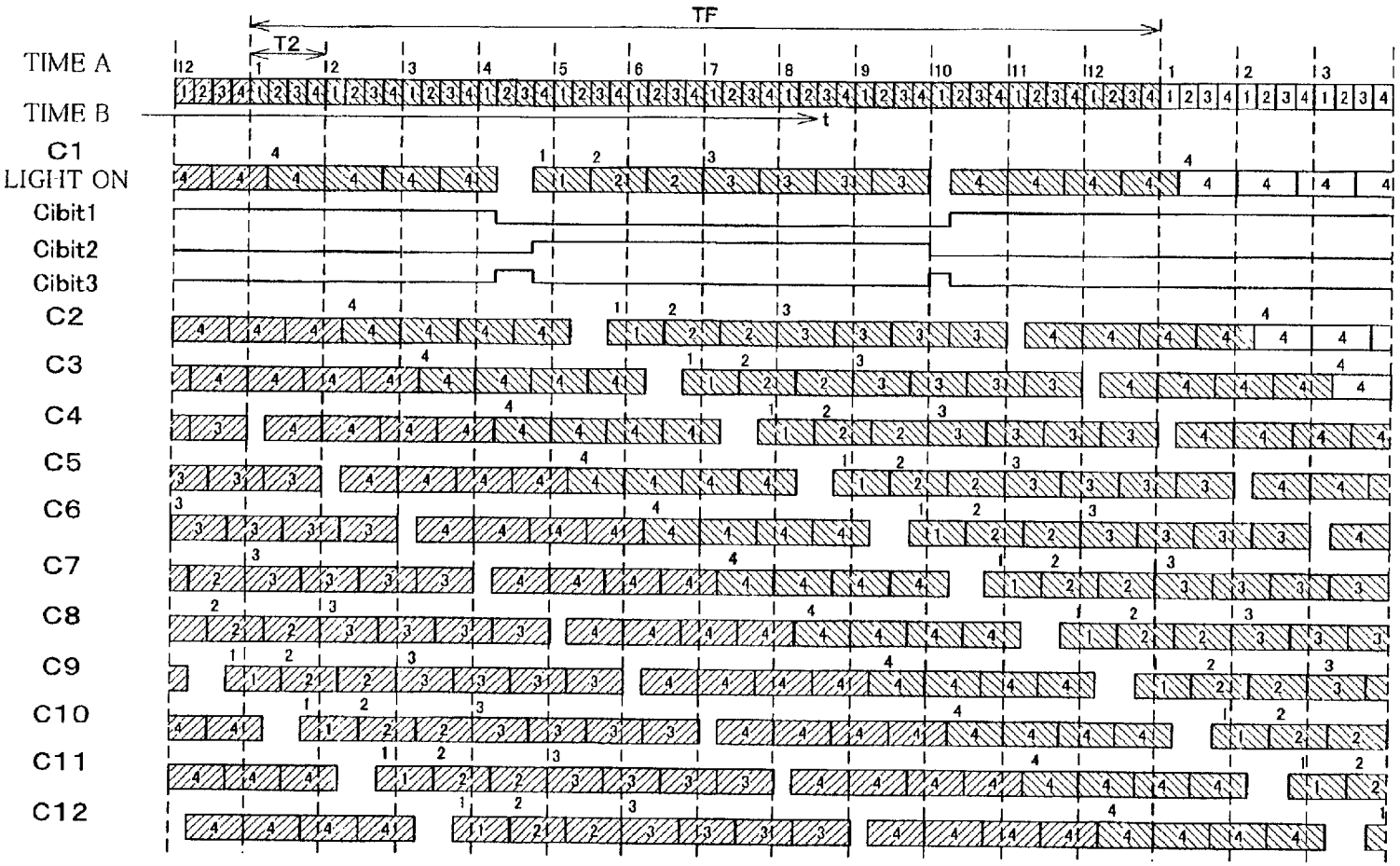
FIG. 20 is an explanatory drawing showing a time-division scan method, in accordance with the present invention, used in embodiment 7.

Referring to FIGS. 19, 20, the following will describe another embodiment in accordance with the present invention. Here, for convenience, those members of the present embodiment that have the same arrangement and function as members of any one of the foregoing embodiments, and that are mentioned in that embodiment are indicated by the same reference numerals and description thereof is omitted.

The present embodiment is an example of a driving method using a pixel circuit of the first arrangement of means 1 in accordance with the present invention.

FIG. 19 shows an equivalent circuit structure of a pixel Aij of the present embodiment. The equivalent circuit is adapted so that a data wire Sj is connected to the source terminal of a TFT (first switching element) 6 and that the source terminal of a TFT (second switching element) 21, the source terminal of a TFT (the third switching element) 20, and the gate terminal of a TFT 15 forming an electro-optic element are connected to the drain terminal of the TFT 6. Incidentally, a memory circuit (static memory) 9 is connected to the drain terminal of the TFT 21, and a capacitor 22 is connected to the drain terminal of the TFT 20.

Incidentally, without the TFT 20, the capacitor 22 acts as pure potential maintaining means; with the TFT 20, the capacitor 22 can double as memory means. In the latter case, the potential maintaining means is the stray capacitance of a gate electrode of the TFT 15. Further, the TFT (sixth switching element) 25 is connected to the gate terminal of the TFT 15.

In other words, as mentioned earlier, in the organic LED display 8 in FIG. 7, as shown in FIG. 9(*a*), a substrate 31, an anode 32, a hole entering layer 35, a hole transport layer 36, a light-emitting layer 37, an electron transport layer 38, and a cathode 33 are formed in layers in this order to render the organic LED display driver TFT 7 a p-type and interposed the organic LED display 8 between the TFT 7 and GND.

In contrast, in the organic LED display (electro-optic element) 26 of the present embodiment in FIG. 19, conversely, a substrate 31, a cathode 33, an electron transport layer 38, a light-emitting layer 37, a hole transport layer 36, a hole entering layer 35, and an anode 32 are formed in layers in this order to render the organic LED display driver TFT 15 an n-type and interpose the organic LED display 8 between the TFT 15 and the power source VDD.

In the pixel circuit structure in FIG. 19, Voff is about 0 V, and Von is about 10 V. Incidentally in the pixel TFT circuit structure in FIG. 19, the gate ON voltage wire (voltage Voff) and the GND wire are provided separately; however, since Voff=0 V, the gate OFF voltage wire (voltage Voff) and the GND wire may be provided as a common single wire.

FIG. 20 shows a method of controlling a display state using the pixel circuit structure in FIG. 19. Incidentally, in FIG. 20, for descriptive purposes, it is presumed that the number, m, of scan lines of a panel is 12 and that the number, K, of tone bits displayed by each pixel is 4 bits or 16 tones. Incidentally, C1–C12 are scan lines.

First, a single frame period is divided by the number of scan lines, i.e., 12 to define a unit period (indicated by a time A in FIG. 20). Next, each unit period is divided by the number of tone bits, i.e., 4, to define a selection period (indicated by a time B in FIG. 20). Hereinafter, the Y-th selection period in the X-th unit period will be referred to as the time X-Y.

Therefore, for example, the p-th selection period in a certain unit period N(j) is given by N(j)−p(j) where j is a positive integer less than K.

In this case, one frame period TF is formed by 12×4=48 selection periods, the time for each tone is 48/15=3.2. Accordingly, 3 selection periods are allotted to each tone.

First, as shown by C1 in FIG. 20, the timing at which the 1st bit data of the pixel connected to the 1st scan line is transmitted to a data wire is defined as time 4—4. Under these conditions, the 2nd bit data of the pixel connected to the 1st scan line is transmitted to a data wire three selection periods later, that is, at a timing of time 5-3. The 3rd bit data of the pixel connected to the 1st scan line is transmitted to a data wire 3×2 selection periods later, that is, at a timing of time 7-1.

Before reaching this stage, if the Y segments of the selection periods X-Y of the bits overlap each other (if the Ys are equal), the number of selection periods per tone is adjusted so that there occurs no overlapping. In this example, the Y segments do not overlap, and the operations proceed.

In other words, here, time X-Y refers to the Y-th selection period in X unit selection periods. In the driving method, since the timing for the scan line A+1 comes one unit selection period later than the timing for the scan line A, overlapping Y segments cause simultaneous selection periods for the two scan lines. For example, in FIG. 20, if there is a selection period 4 in Y=1, "4" in C1 and "3" in C7 occur simultaneously. However, it is impossible to supply different data items simultaneously to one signal line, and no display is produced as a result. Accordingly, the overlapping of Y segments are avoided by the foregoing manner. That is, overlapping Ys mean that the number of selection periods allotted per tone is unsuitable and needs adjustment.

Next, a timing is determined when to write data to the memory (memory circuit 9) in the pixel connected to the 1st scan line. In other words, the memory in FIG. 19 is for only 1 bit, and the 4th bit data is transmitted to a data wire at a timing of 2, which is the remaining of the Y. The 4th bit data is transmitted at a timing of time 1-2 which is about 2 selection periods before the 1st bit data transmitted to a data wire and which is given by 3 (number of selection periods allotted to each tone)×8 (the ratio of the 4th bit to the 1st bit in weight)÷2 (roughly equal division is needed). Thus, displays are produced while writing the 4th bit data to the memory, and thereafter, the 1st to 3rd bit data is displayed. Thereafter, 4th bit data is read from the memory for displays.

The above process determines the transmit timings of the bit data. Those timings are timings for the scan line C1. Timings for the other scan lines C2–C12 are determined by delaying the timings sequentially by a unit period or periods.

The control line Cibit1 in FIG. 19 is controlled so that the TFT 20 is in a conducting state from the 1st-bit data transmit timing to a timing when a display is produced from the 3rd bit data.

The control line Cibit2 is controlled so that the TFT 21 turns to a conducting state at a timing when a display is produced from the 4th bit (MSB) data stored in the memory.

Incidentally, as for the timings in FIG. 20, 45 selection periods, which is a product of 3 selection periods of a 1-bit weight and the number of tones, that is, (2 to the 4th power −1)=(1+2+4+8), does not match 48, which is a product of the number of scan lines and the number of bits, that is, 12×4; therefore, the TFT 25 and the control line Cibit3 for switching the TFT 25 are included as shown in FIG. 19. To put it other way round, if the number, m, of scan lines times the number, K, of bits is equal to the selection period per bit times (2 to the K-th power −1), the TFT 25 does not need to be included.

The TFT 25 is connected at its source electrode to the gate electrode of the TFT 15 and at its drain electrode to GND, so that the current flowing through the organic LED display 26 is 0. The TFT 25, as shown in FIG. 20, is in a conducting state when the TFTs 20, 21 are in a non-conducting state.

FIG. 20 shows results of the above scanning by enclosed square patterns in C1–C12: the pixels connected to the scan lines perform display operations at the shown timings based on the shown bits.

Those pixels each having its own memory, capacitor controllable independently from the data stored in that memory, and reset means have advantages over the time-division tone control shown in FIG. 11. Some of the advantages are: (1) the power source VDD does not need to be controlled; and (2) light-on periods account for not less than 90% of each frame period.

Further, such pixels are as effective as FIG. 11 to restrain the development of moving picture breakups.

Incidentally, in FIG. 19, the TFT 20 is disposed in series with the capacitor 22; however, the TFT 20 is dispensable. Specifically, the TFT 20 is dispensable if the memory circuit 9 is a static memory circuit and the adverse effect that the electric charge stored in the capacitor 22 causes to the output voltage from the static memory circuit upon the turn-ON of the TFT 21 is evaluated to eliminate the adverse effect by, for example, reducing the capacitance of the capacitor 22 or interposing a capacitor with a capacitance larger than that of the capacitor 22 between the TFT 21 and the static memory.

Further, a capacitor may be used in place of a static memory.

Figure 21:
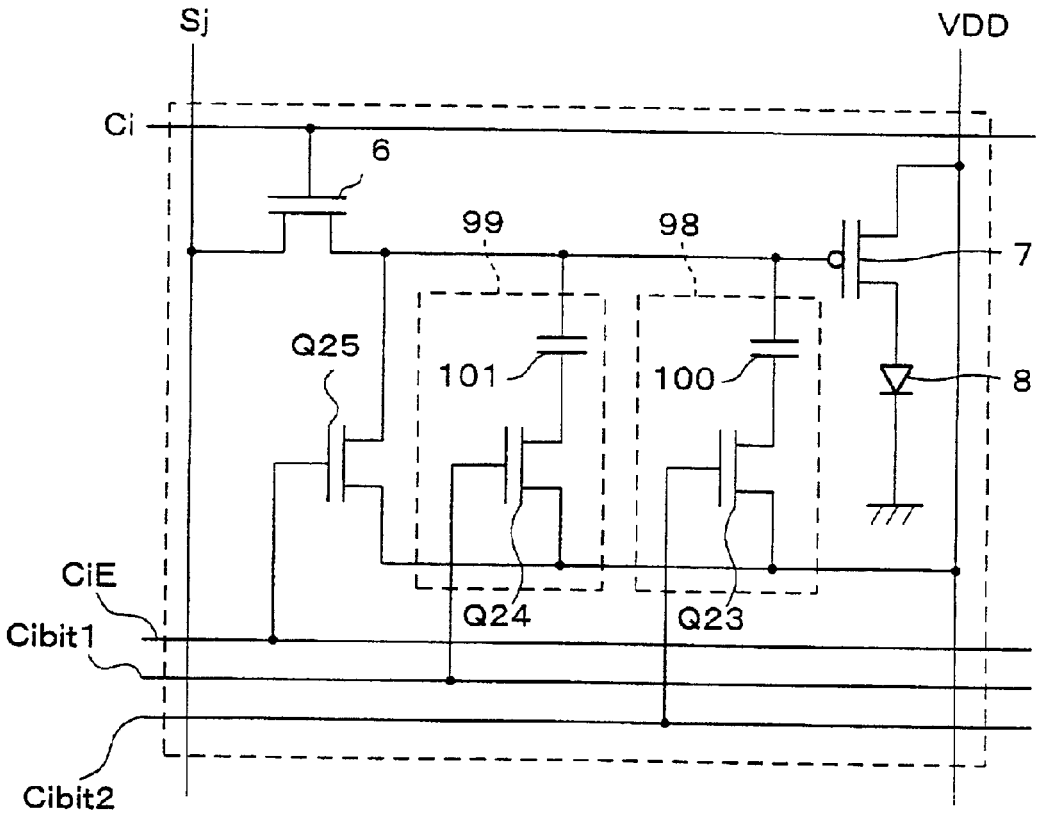
FIG. 21 is an equivalent circuit diagram showing a circuit structure of a pixel described in embodiment 7.

FIG. 21 shows such an example in which memory means 98 in accordance with the present invention is formed by a TFT Q23 and a capacitor 100 and potential maintaining means 99 is formed by a TFT Q24 and a capacitor 101.

Therefore, the arrangement in FIG. 21 enables the same driving method as that in FIG. 19.

[Embodiment 8]

Referring to FIGS. 22 through 25, the following will describe another embodiment of the driving method using a pixel circuit in accordance with the present invention. Here, for convenience, those members of the present embodiment that have the same arrangement and function as members of any one of the foregoing embodiments, and that are mentioned in that embodiment are indicated by the same reference numerals and description thereof is omitted.

Figure 22:
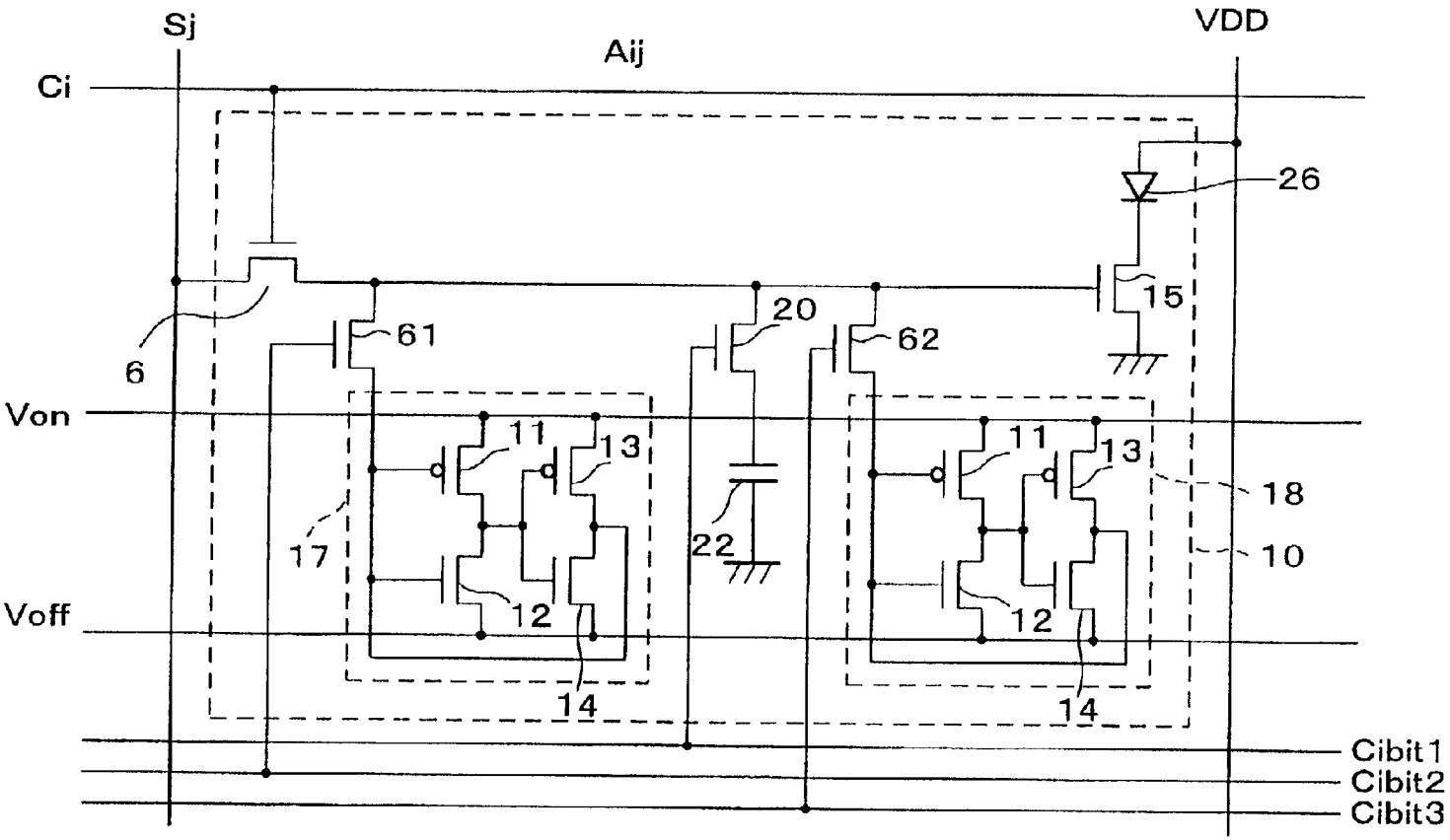
FIG. 22 is a circuit diagram showing a circuit structure of a pixel used in embodiment 8.

FIG. 22 shows a circuit structure of a pixel used in the present embodiment.

Specifically, the memory circuit 9 made of a static memory in FIG. 19 has a 1-bit arrangement. A corresponding memory circuit 18 made of a static memory in FIG. 22 is an example of a memory circuit structure for multiple bits (in FIG. 22, a 2-bit arrangement is shown for convenience in illustration) in which TFTs 61, 62 are disposed for bit control purposes between the gate of an organic LED display driver TFT 15 and a memory circuit 18 and between that gate and a memory circuit (first memory element) 17, the memory circuits 17 and 18 both being made of a static memory.

Here, conditions are calculated and applied under which the TFT 25 is not used as in FIG. 19. First, conditions are sought under which the Ys in times X-Y allotted to the bits do not overlap at low-order tones.

A research has exhibited that with a 2-bit memory provided, calculating up to a 5-bit tone is easy.

Figure 23:
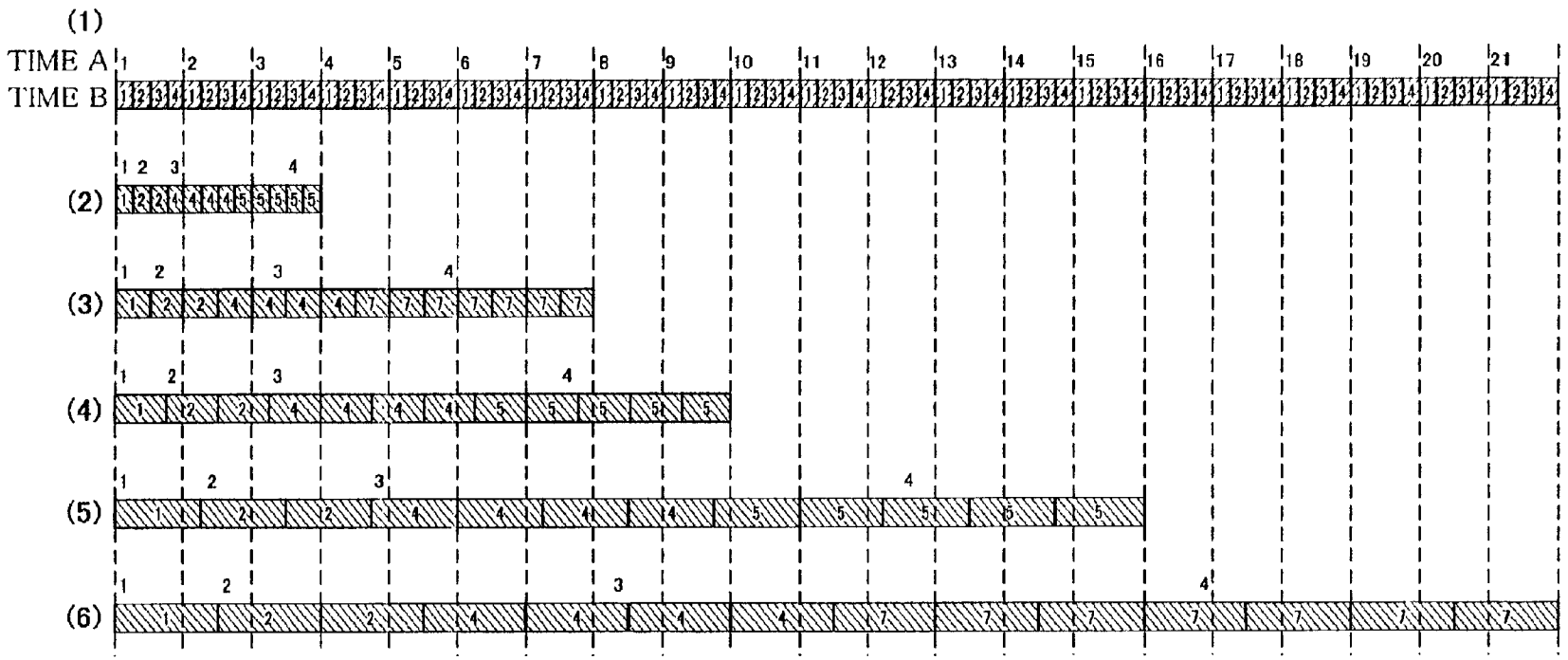
FIG. 23 is an explanatory drawing showing the acquisition of timings by a time-division scan method, in accordance with the present invention, used in embodiment 8.

In other words, with a 4-bit tone, anything will do and multiples of 4 per tone, for example, except 1, 2, 3, 5, 6, . . . selection periods, as shown by (2)–(6) in FIG. 23. Incidentally, (1) in FIG. 23 shows the Y-th selection periods (indicated by 1–4) of the X-th unit period (indicated by 1–21) which are indicated by time A and time B. Now that the number of selection periods per tone is known, it will be checked based on how many scan electrodes a display is produced.

In the case of (2) in FIG. 23, the number of selection periods required to produce a 16 gray-scale display is (16 tones −1)×1=15. However, the number is not a multiple of the number of bits, that is, 4, and the TFT 25 must be used as in FIG. 19 to achieve such a display. Accordingly, it is understood that a 13 grayscale display is to be produced so that the number of tones less one is a multiple of 4, and the number of required selection periods is (13 tones −1)×1=12, and 12/4=3 scan lines are sufficient. Here, the weight of the largest tone bit is 5 tones.

In the case of (3) in FIG. 23, the number of selection periods required to produce a 16 gray-scale display is (16 tones −1)×2=30. However, the number is not a multiple of the number of bits, that is, 4, and similarly, a 15 gray-scale display is to be produced so that the number of tones less one is a multiple of 4. It is understood that the number of required selection periods is (15 tones −1)×2=28, and 28/4=12 scan lines are sufficient. Here, the weight of the largest tone bit is 7 tones.

In the case of (4) in FIG. 23, the number of selection periods required to produce a 16 gray-scale display is (16 tones −1)×3=45. However, the number is not a multiple of the number of bits, that is, 4, and similarly, a 13 gray-scale display is to be produced so that the number of tones less one is a multiple of 4. It is understood that the number of required selection periods is (13 tones −1)×3=36, and 36/4=9 scan lines are sufficient. Here, the weight of the largest tone bit is 5 tones.

In the case of (5) in FIG. 23, the number of selection periods required to produce a 16 gray-scale display is (16 tones −1)×5=75. However, the number is not a multiple of the number of bits, that is, 4, and similarly, a 13 gray-scale display is to be produced so that the number of tones less one is a multiple of 4. It is understood that the number of required selection periods is (13 tones −1)×5=60, and 60/4=15 scan lines are sufficient. Here, the weight of the largest tone bit is 5 tones.

In the case of (6) in FIG. 23, the number of selection periods required to produce a 16 gray-scale display is (16 tones −1)×6=90. However, the number is not a multiple of the number of bits, that is, 4, and similarly, a 15 gray-scale display is to be produced so that the number of tones less one is a multiple of 4. It is understood that the number of required selection periods is (15 tones −1)×6=84, and 84/4=21 scan lines are sufficient. Here, the weight of the largest tone bit is 7 tones.

To summarize, as to 4 selection periods per unit period, if +1 (1 tone=1 selection period, 1 tone=5 selection periods) and +2 (1 tone=2 selection periods, 1 tone=6 selection periods) are OK, −1 (1 tone=3 selection periods) and −2 (1 tone=2 selection periods, 1 tone=6 selection periods) will also do.

Further, the number of obtained tones are also determined: 12 tones for +1 and −1 and 15 tones for +2.

Once the Y timings in the time X-Y to which the 1st and 2nd bits are allotted are determined in this manner and so is the number of scan lines, the Y timings in the time X-Y to which the remaining 3rd and the 4th bits are allotted can be determined suitably (Ys do not overlap) in a corresponding gray-scale display period.

The timings is determined in this manner, and about a half of the period allotted to the 4th bit which is the largest bit (including the 4th-bit data rewriting period) is moved near the beginning of the frame period one unit period at a time, to restrain moving picture breakups.

Further, if, as in (3) in FIG. 23, the 3rd-bit data rewriting period does not exist at the beginning of the period allotted to the 3rd bit, the timing is cut out from that rewriting period one unit period at a time and moved to a period in the first half allotted to the 4th bit which is the largest bit.

Figure 24:
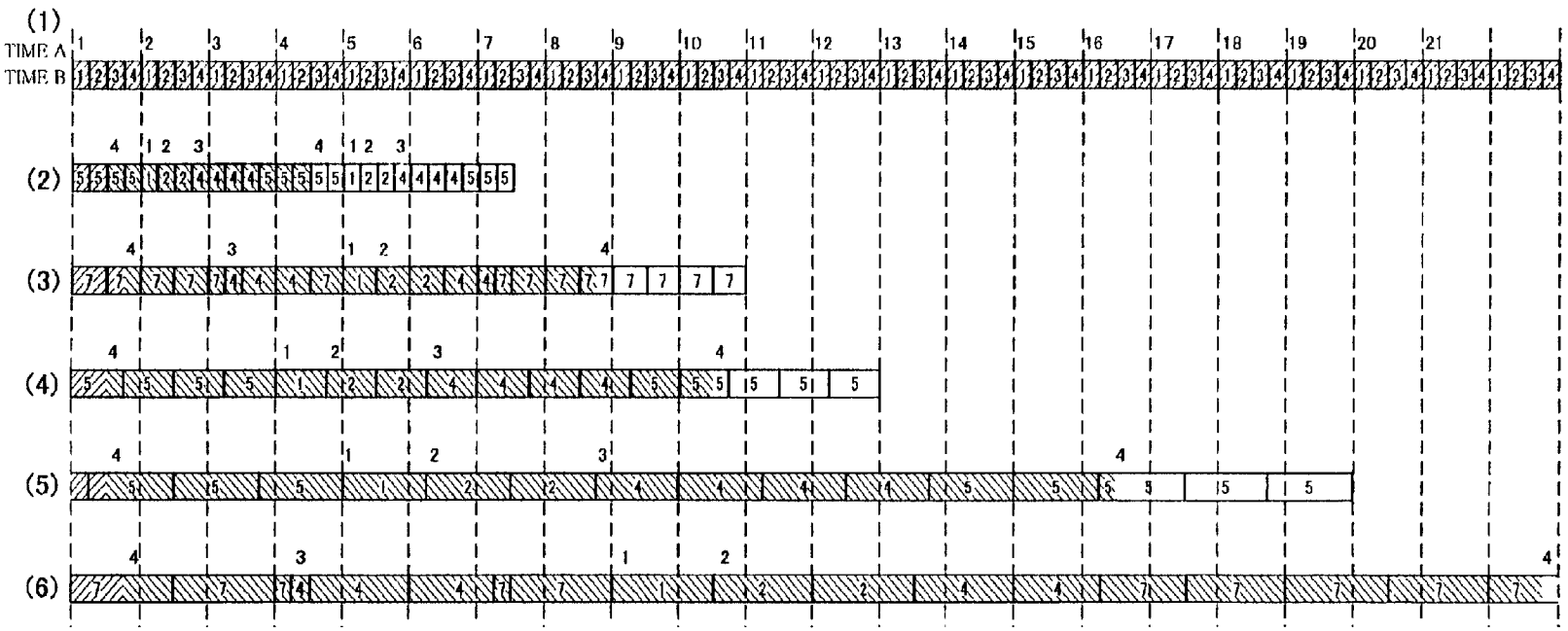
FIG. 24 is an explanatory drawing showing the acquisition of other timings by the time-division scan method, in accordance with the present invention, used in embodiment 8.

FIG. 23 is rewritten in this manner, and the results are shown in FIG. 24.

The timing thus determined are the timings for the scan line C1 in FIG. 20. Those for the remaining scan lines C2–C12 can be determined by sequentially delaying the timings by a unit period.

Figure 25:
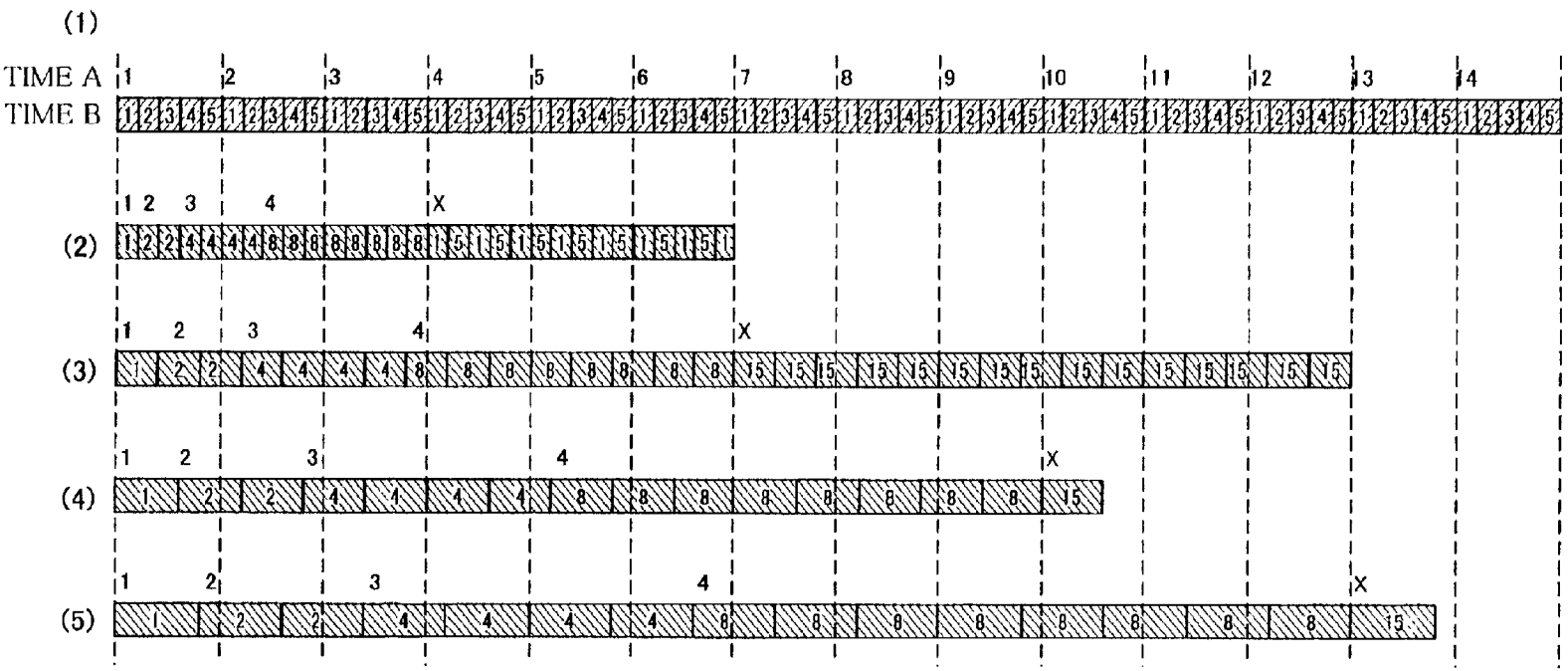
FIG. 25 is an explanatory drawing showing the acquisition of other timings by the time-division scan method, in accordance with the present invention, used in embodiment 8.
Figure 26:
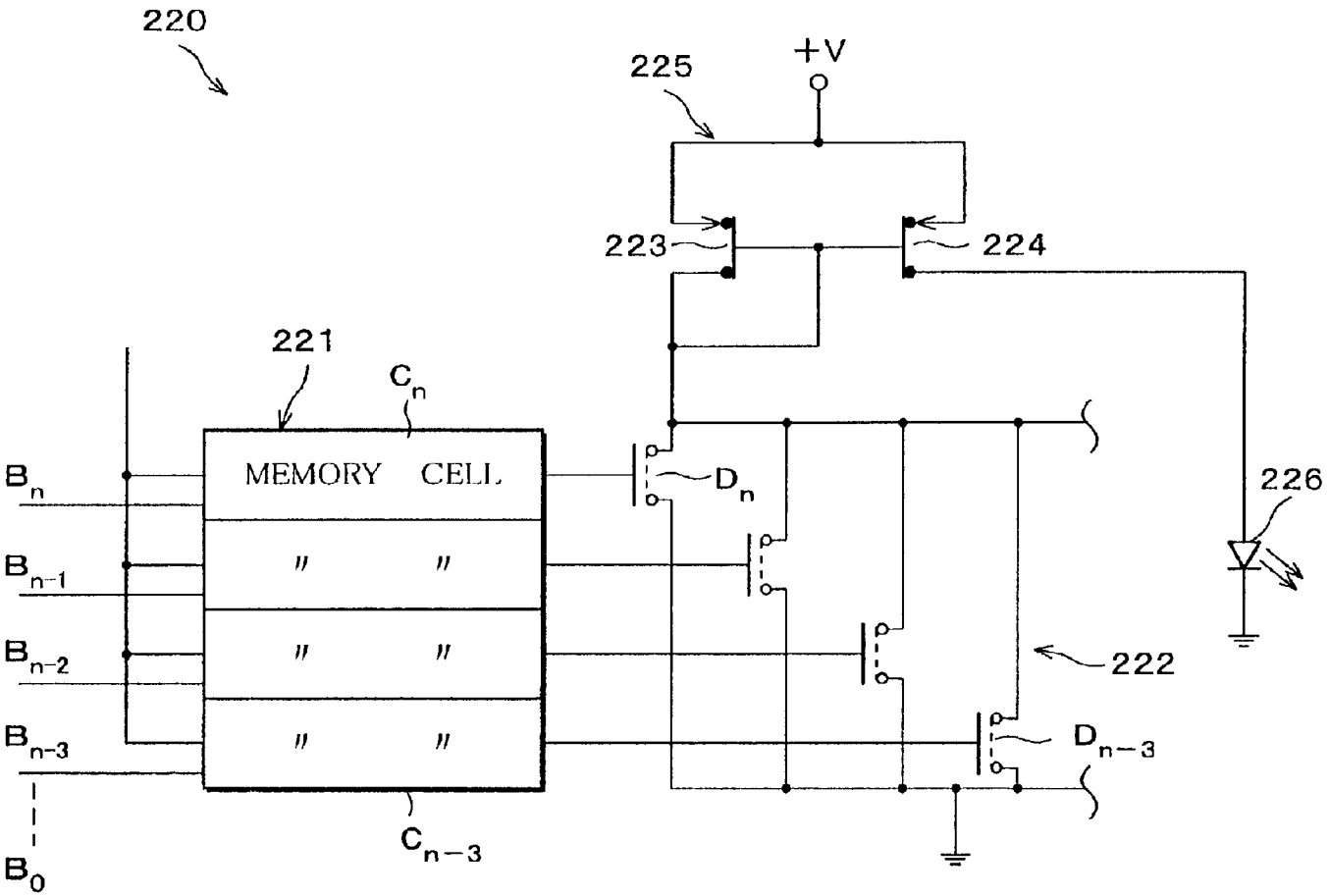
FIG. 26 is a circuit diagram showing a circuit structure of a pixel in a conventional organic LED display which includes a memory for each pixel.
Figure 27:
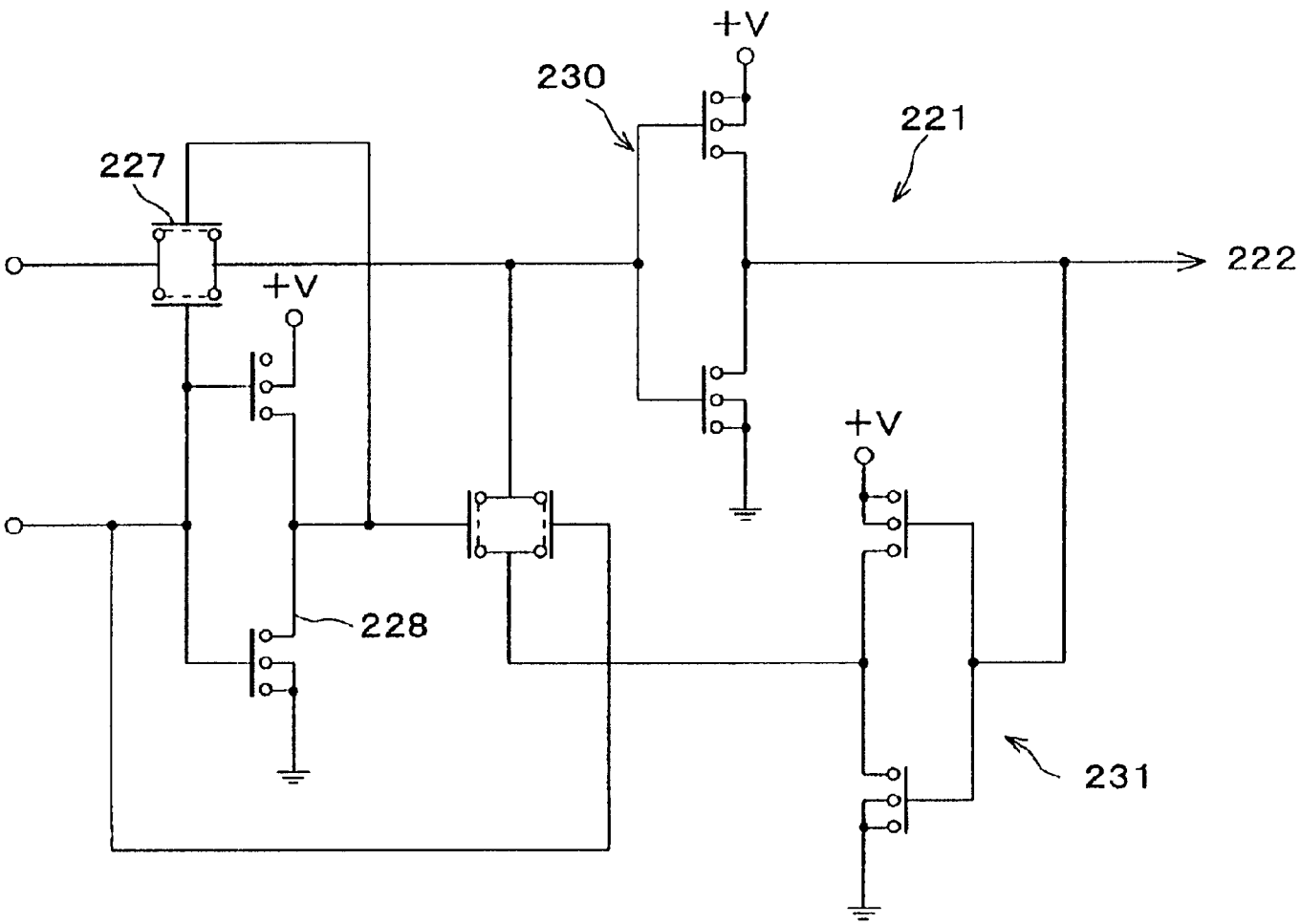
FIG. 27 is circuit diagram showing a circuit structure of the pixel memory cell in FIG. 26.

Similarly, with a 5-bit tone, anything will do and multiples of 4 per tone, for example, except 1, 2, 3, 4, . . . selection periods and multiples of 5 per tone as shown in (2)–(5) in FIG. 25. Next, now that the number of selection periods per tone is known, it will be checked based on how many scan electrodes a display is produced.

In the case of (2) in FIG. 25, the number of selection periods required to produce a 32 gray-scale display is (32 tones −1)×1=31. However, the number is not a multiple of the number of bits, that is, 5, and the TFT 25 must be used as in FIG. 19 to achieve such a display. Accordingly, it is understood that a 31 grayscale display is to be produced so that the number equals a multiple of 5, and the number of required selection periods is (31 tones −1)×1=30, and 30/5=6 scan lines are sufficient. In this case, the weight of the largest tone bit is 15 tones.

In the case of (3) in FIG. 25, the number of selection periods required to produce a 32 gray-scale display is (32 tones −1)×2=62. However, the number is not a multiple of the number of bits, that is, 5, and similarly, a 31 gray-scale display is to be produced so that the number of tones less one is a multiple of 5. It is understood that the number of required selection periods is (31 tones −1)×2=60, and 60/5=12 scan lines are sufficient. Here, the weight of the largest tone bit is 15 tones.

In the case of (4) in FIG. 25, the number of selection periods required to produce a 32 gray-scale display is (32 tone −1)×3=96. However, the number is not a multiple of the number of bits, that is, 5, and similarly, a 31 gray-scale display is to be produced so that the number of tones less one is a multiple of 5. It is understood that the number of required selection periods is (31 tones −1)×3=90, and 90/5=18 scan lines are sufficient. Here, the weight of the largest tone bit is 15 tones.

In the case of (5) in FIG. 25, the number of selection periods required to produce a 32 gray-scale display is (32 tones −1)×4=124. However, the number is not a multiple of the number of bits, that is, 5, and similarly, a 31 gray-scale display is to be produced so that the number of tones less one is a multiple of 5. It is understood that the number of required selection periods is (31 tones −1)×4=120, and 120/5=24 scan line are sufficient. Here, the weight of the largest tone bit is 15 tones.

In the case of this 5-bit gray-scale display, similarly to the case of a 4-bit gray-scale display, once the Y timings in the time X-Y to which the 1st to 3rd bits are allotted are determined and so is the number of scan lines, the Y timings in the time X-Y to which the remaining 4th to 5th bits are allotted can be determined suitably (Ys do not overlap) in a corresponding grayscale display period.

Further, about a half of the period allotted to the 5th bit which is the largest bit (including the 5th-bit data rewriting period) is moved near the beginning of the frame period one unit period at a time, to restrain moving picture breakups.

Incidentally, a substrate in accordance with the present invention may be arranged so as to include:

a first wire;

a first switching element connected at a first terminal thereof to the first wire;

a first memory element electrically connected to a second terminal of the first switching element; and an electro-optic element electrically connected to the second terminal of the first switching element.

Alternatively, a substrate in accordance with the present invention may be arranged so as to include:

a first wire;

a first switching element electrically connected at a first terminal thereof to the first wire;

a first memory element electrically connected to a second terminal of the first switching element;

potential maintaining means electrically connected to the second terminal of the first switching element; and an electro-optic element electrically connected to the second terminal of the first switching element.

Alternatively, a substrate in accordance with the present invention may be arranged in the above arrangement so that the first memory element includes a second switching element and a memory element for storing 1-bit data.

(1) and (2) below are examples of these arrangements:

(1) A substrate including an arrangement in which a first switching element is provided to each electro-optic element, the source terminal of the first switching element is connected to a data wire, the drain terminal of the first switching element is electrically connected to a first memory element, and the drain terminal of the first switching element is electrically connected to a pixel electrode.

Further, a substrate including an arrangement in which a first switching element is provided to each piece of memory means, a fourth switching element is provided to each piece of potential maintaining means, the source terminal of the switching element is connected to a data wire, the drain terminal of the switching element is connected to the memory means and the potential maintaining means, and the outputs from the memory means and the potential maintaining means are electrically connected to pixel electrodes.

A display substrate or display in which an electro-optic element, such as a liquid crystal display element, doubling as potential maintaining means is connected to the pixel electrodes of the substrate.

Incidentally, electrical connection here is defined to encompass both direct connection and indirect connection via a switching element.

(2) A substrate including an arrangement in which a first switching element is provided to each electro-optic element, the source terminal of the first switching element is connected to a data wire, the drain terminal of the first switching element is electrically connected to a first memory element, the drain terminal of the first switching element is electrically connected to potential maintaining means, such as a capacitor element, and the drain terminal of the first switching element is connected to the gate electrode of an active element for driving the electro-optic element.

Further, a substrate including an arrangement in which a first switching element is provided to each piece of memory means, a fourth switching element is provided to each piece of potential maintaining means, the source terminal of the switching element is connected to a data wire, the drain terminal of the switching element is connected to the memory means and the potential maintaining means, and the outputs from the memory means and the potential maintaining means are connected to the gate electrode of an active element for driving an electro-optic element.

Incidentally, in the substrate, a fifth switching element is preferably provided between the gate electrode of the active element and the memory means and the potential maintaining means.

Further, a display substrate or display in which an electro-optic element, such as an organic LED display, is connected to the source terminal or drain terminal of the active element of the substrate.

Incidentally, the capacitor element is preferably formed either by a capacitor and the third switching element or by a capacitor alone.

If the capacitor element is formed by a capacitor alone, no special capacitor is needed: a gate electrode capacitance in the active element can be used for that purpose.

The arrangements (1), (2) enables a display of more tones than the memories located in the pixel at low power. Further, the resultant substrate is suitable to time-division displays and readily modified to solve the problem of moving picture breakups; the effects are obvious.

In the arrangements (1), (2), the first memory element is preferably formed based on the third switching element and a memory element for storing 1-bit data.

In producing a time-ratio gray-scale display with the substrate arrangements (1), (2) in accordance with the present invention, a driving method can be used which contains: a first period in which a train of voltages are applied to the liquid crystal display element or potential maintaining means; a second period in which data is held to the first memory element; and a third period in which a voltage is applied to the liquid crystal display element or potential maintaining means using the data of the first memory element.

The third period, among them, occurs more than once in a predetermined cycle and thus solves the first problem of the present invention: moving picture breakups are reduced.

In other words, in the PDP and other pieces of apparatus, animated-image moving picture breakups are reduced by dividing large bit-weight data into several sets and displaying those sets before or after small bit-weight data. However, in the PDP, etc., since the large bit-weight data is displayed more than once, display scanning needs be done for each display.

In contrast, with an arrangement in accordance with the present invention in which the pixel has a memory, by holding the large bit-weight data for each pixel in the second period, multiple displays of the large bit-weight data in the third period can be produced without carrying out display scanning.

Further, a display in accordance with the present invention is a display containing the substrate and operates by the scan method (3) for the first to third periods as follows:

(3) Render the number of scan electrodes not more than m and the number of tones to be displayed by each pixel not more than K bits;

divide one cycle into m unit periods and each unit period into K selection periods;

supply the 1st-bit data to a data electrode in the p-th selection period in the A-th unit period, supply the 2nd-bit data to a data electrode in the q-th selection period ($q \neq p$) in the B-th unit period; and supply the K-th bit data to a data electrode in one or more of K selection periods forming a unit period of the S-th selection period, which is or are not used for other bits, where m is a positive integer, K is an integer larger than 1, and A, B, p, q, S are integers not less than 0).

In other words, when the number of scan lines of the display panel is not more than m and the number of display tones not more than K bits, the following operations are possible: one frame (or field) period is divided into m unit periods, each unit period is divided into K selection periods;

the electro-optic element or the potential maintaining means of a pixel on a scan line is rewritten using the 1st-bit data in the p-th selection period in the A-th unit period, using the 2nd-bit data in the q-th ($q \neq p$) selection period in the B-th ($B=A$ or $B \neq A$) unit period, using the 3rd-bit data in the r-th ($r \neq q$, $r \neq p$) selection period in the C-th ($C \neq B$, $C \neq A$) unit period, and so on; and the first memory element of the pixel on the scan line is rewritten using K bits (largest weight-bits) in one or more of K selection periods forming a unit period of the s-th ($s<r$, $s<q$, $s<p$) selection period, which is or are not used for other bits.

Here, the time period in which the 1st-bit data is being supplied to the electro-optic element or the potential maintaining means of the pixel is approximately in direct proportion to the weight of the 1st bit, and the time period in which the 2nd-bit data is supplied to the electro-optic element or the potential maintaining means of the pixel is approximately in direct proportion to the weight of the 2nd bit.

Further, the time period in which the largest bit data is being read from the first memory element and supplied to the electro-optic element or the potential maintaining means of the pixel is controlled by means which is independent from the rewriting means.

Due to the inclusion of the independent means, the time period in which the largest-bit data is being supplied to the electro-optic element or the potential maintaining means of the pixel is approximately in direct proportion to the weight of the largest bit.

According to the scan method, in a time-ratio grayscale method, the rate of the display period in a single frame period can be increased, which improves brightness and efficiency; the effects are obvious.

In the arrangements (1), (2), a sixth switching element is preferably interposed between the potential maintaining means and the OFF brightness setting wire. With the arrangement, as described in embodiment 7, the display control can have greater versatility than in embodiment 8 which is without the arrangement.

Further, a substrate in accordance with the present invention may include a first memory element for each electro-optic element and be arranged so that the electro-optic element has a power source wire separately from a power source wire of the first memory element.

(4), (5) below are examples of these arrangements:

(4) A substrate includes a pixel electrode connected to an electro-optic element, such as a liquid crystal display element, and a first memory element for applying voltage to the pixel electrode, and the first memory element includes an ON-control TFT (transistor) for controlling conducting/non-conducting states with an ON brightness setting wire and an OFF-control TFT (transistor) for controlling conducting/non-conducting states with an OFF brightness setting wire.

Further, a display substrate or display can be formed by connecting an electro-optic element, such as a liquid crystal display element, to the pixel electrode of the substrate.

The voltage applied to the ON brightness setting wire and the OFF brightness setting wire is preferably such that the voltage can be specified separately and independently from the power source voltage applied to the electro-optic element.

(5) A substrate includes an active element (driver TFT (transistor)) for driving an electro-optic element, such as an organic LED display, and a first memory element connected to the gate electrode of the active element (driver TFT (transistor)), and the first memory element includes: an ON-control TFT (transistor) for controlling conducting/non-conducting states between the gate electrode of the driver TFT (transistor) and an ON brightness setting wire; and an OFF-control TFT (transistor) for controlling conducting/non-conducting states between the gate electrode of the driver TFT (transistor) and an OFF brightness setting wire.

Further, a display substrate or display can be formed by connecting an electro-optic element, such as an organic LED display to the source terminal or drain terminal of the active element of the substrate.

The voltage applied to the ON brightness setting wire and the OFF brightness setting wire is preferably such that the voltage can be specified separately and independently from the power source voltage applied to the electro-optic element.

In a special case when the number of display tones is specified to K bits in the driving of the substrates of the arrangements (1), (2), each pixel is rewritten K times per frame (or field) period. Accordingly, it is preferable to transmit a reduced voltage to the signal wire and provide a voltage converter circuit to the pixel.

Further, since input data is data for the pixel unit, to enable bit-by-bit transmission of the data, a display substrate or display preferably includes:

a SRAM (static random access memory), located outside a pixel, to which a CPU or the like writes data representing the image (or text) to be displayed on the display;

an output wire for transmitting display data for one line at a time from the SRAM; and memory (pixel memory), provided inside the pixel, for storing data transmitted via the wire in each pixel.

Further, if pixel data is input conventionally line by line, if is preferable to output the pixel data bit by bit in a line period, using a shift register and a latch, and load the bit data to a memory located in the pixel and a memory (SRAM) located outside the pixel (display region). Especially preferred is an arrangement in which the required memory is partly located inside the pixel with the remaining part located outside the pixel and the data in the memory outside the pixel is acquired using the potential maintaining means located in the pixel. According to the arrangement, a gray-scale display can be produced with required display quality by providing only a part of the bit required to produce the display in the pixel. Further, the memories located outside the pixel can be reduced by the same number as those memories located in the pixel, which is preferable because of overall reduction in the area outside the pixels (display region).

Further, the first memory element in the arrangements (1), (2) is directly connected to the electro-optic element and the switching element (TFT, transistor) for driving the electro-optic element; therefore, in the arrangement of means 4, 5, the output voltage from the first memory element is preferably such that the voltage can be specified independently from the power source voltage applied to the electro-optic element.

Further, the SRAM may be either fabricated in the same process as the pixel memory and the TFT or in a different process for later connection.

Specifically, the SRAM, together with the pixel memory and the TFT, can be fabricated in a single Poly-Si TFT or CGS TFT process. Alternatively, only the pixel memory and the TFT are fabricated by a Poly-Si TFT or CGS TFT process, whereas the SRAM can be fabricated by a monocrystalline semiconductor process and connected later.

Further, the CPU and the SRAM may be either fabricated separately or integrated.

The foregoing display in which each pixel has its own pixel memory, the output of that pixel memory is applied to the gate voltage of the driver TFT, and the driver TFT drives the self-luminous element preferably includes a circuit structure which retains the output voltage from the pixel memory and another circuit structure which converts the output voltage from the pixel memory to a suitable ON potential (−5 V or below in the case of FIG. 8) and OFF potential (5 V or above in the case of FIG. 8).

Accordingly, a circuit structure is useful in which a switching element switches between the gate electrode of the driver TFT, the ON electrode through which a suitable ON potential is applied to the gate electrode, and the OFF electrode through which a suitable OFF potential is applied to the gate electrode.

It would be adequate If the memory circuit provided to each pixel specifies whether the potential to be applied to the gate electrode of the driver TFT is the ON potential or the OFF potential.

Especially preferred is a circuit structure in which the output end of the memory circuit gives the ON/OFF potential.

With the arrangement, the display produced by the electro-optic element in which each pixel has a memory becomes stable and less likely to develop brightness deviation. Advantages are obvious.

Further, a substrate in accordance with the present invention, in the arrangement, may be such that each pixel (dot) has a memory function and there are provided wires to transmit display data stored in a second memory element, not in the pixel (dot) memory, to multiple pixel (dot) memories simultaneously.

Further, a substrate in accordance with the present invention, in the arrangement, may be such that each pixel (dot) has a memory function and contains a second memory element in addition to the pixel (dot) memory.

In the arrangements (1), (2), transmitting data stored in the SRAM outside the pixel is useful in rewriting the memory provided to each pixel. When this is the case, as in the foregoing case, the foregoing circuit structure in which the output voltage from the pixel memory does not change preferably includes a as in FIGS. 31, 32, but a static memory arranged in the foregoing manner.

Further, the required memory (SRAM) may be partly provided in the pixel with the remaining part outside the pixel.

The SRAM may be an IC fabricated by a monocrystalline silicon process or a circuit fabricated by a Poly-Si TFT process. The SRAM includes memories corresponding to display dots, m in width×n in height (in the case of a black & white display, pixels=dots; in the case of a color display, each pixel is made of 3 dots of RGB, and therefore pixels= 3×dots) and also includes output wires corresponding to the dots in each line of the display, in place of a SEG-side drive circuit (driver circuit).

This enables the external, pixel-by-pixel data input to be transmitted directly in parallel from the SRAM to the pixel memories one line at a time bit by bit in accordance with the driving method. As shown in FIG. 28, in comparison to the transmission via a signal line driver, the workload and power to transmit data from the SRAM to the signal line driver circuit can be saved. The reduction in power consumption is especially notable when the arrangement is applied to means 1, 2 of the present invention.

According to the arrangement, the image data for one line from which a display is to be produced can be transmitted directly from the SRAM generating image data from which a display is to be produced to the pixel memory. Power consumption can be saved for the transmission of data to the SEG-side drive circuit (driver circuit). The device overall consumes less power. Advantages are obvious.

The first means in accordance with the present invention to achieve the first objective can be arranged so that in a time-ratio gray-scale method, each electro-optic element has its own memory means and potential maintaining means, and the display produced by the electro-optic element is controllable using outputs from the memory means and the potential maintaining means.

In this arrangement, to suppress the amounts of developed moving picture breakups in a case that multiple electro-optic elements are provided in a display screen which is the first objective to produce a time-ratio gray-scale display, large-weight bit data (bits less than, or equal to, the memories in each electro-optic element, irrespective of a single bit or multiple bits) is stored in memory means, and a display is produced by dividing the bit data stored in the memory means while a display is being produced from the remaining bit data by means of time-division tones, using the potential maintaining means. This reduces the maximum length of a successively displayed tone data and suppresses the amounts of developed moving picture breakups.

When the bit data stored in the memory means is divided to produce a display, there are two cases, in one of which the potential of the potential maintaining means is controlled using an output from the memory means and the electro-optic element is controlled using the potential of the potential maintaining means, in the other of which the switching element switches between the outputs from the potential maintaining means and the memory means and the electro-optic element is controlled using the resultant potential. An example of the switching element is a TFT element used in liquid crystal displays.

When there are more than one memory means, in addition to a gray-scale method, a display can be produced by switching between the multiple memory means, potential maintaining means, etc. by means of a switching element and thus switching between multiple video images by way of a resultant output supplied to the electro-optic element. The function is available even without power being supplied to a signal source, such as a CPU, outside the display and therefore useful in reducing the power consumption by the display.

The first means in accordance with the present invention which aims to achieve the second objective may be arranged so that each electro-optic element has corresponding memory means and potential maintaining means and the display produced by the electro-optic element is controlled using outputs from the memory means and the potential maintaining means.

To display more tones than memories located in each electro-optic element which is the second objective, the arrangement provides potential maintaining means in addition to the memory (even if a memory is omitted) for each electro-optic element. By the acquiring multiple bit data to the potential maintaining means in a time-ratio manner, more bit tones than the memories can be displayed.

The above gray-scale method which uses both the memory means and the potential maintaining means can be divided into two categories: the aforementioned time-ratio gray-scale method and an analog gray-scale method which will be now described. In the analog grayscale method, the memory means and the potential maintaining means are used simultaneously to generate voltage, current, etc. which is then applied to the electro-optic element to produce a gray-scale display.

In this case, the production of a multiple display does not require the provision of a switching element for switching whether the data to be displayed to the electro-optic element is the memory means or the potential maintaining means. However, to produce a display be switching between multiple video images, it is preferred if the switching element is provided.

Further, when this is the case, the below bit data supplied to the above potential maintaining means is acquired in some cases from the memory located outside the pixel (display region) and in the others from an external signal generator, such as a CPU, which is that pixel.

The first means in accordance with the present invention which aims to achieve the third objective may be arranged so that each electro-optic element has corresponding memory means and potential maintaining means in a display in which a memory is located outside the pixel (display region) and the display produced by the electro-optic element is controlled using outputs from the memory means and the potential maintaining means.

To reduce the amounts of memory located outside the pixel (display region) which is the third objective, the arrangement provides part of the memory in a pixel. To display tones using the memory outside the pixel and the memory located inside the pixel simultaneously, there is provided, in a pixel, potential maintaining means which acquires the memory data outside the pixel in a time-division manner to display tones.

In this case, without providing a power source to a signal source, such as a CPU, external to the display, switching between multitone video displays becomes possible, which is useful in reducing power consumption by the display.

Therefore, concrete examples of the memory means include a nonvolatile memory, such as a FRAM, which does not lose stored data without a power supply, a static memory, such as a SRAM, which does not lose stored data while the power source in on (two CMOS inverters with the output of one connected to the input of the other and vice versa), and dynamic memory structure, such as a capacitor, which does not lose data for several frame periods.

If the first objective is the only objective to be achieved, the memory means may be a dynamic memory constructed around a simple capacitor.

Further, since the potential maintaining means can be considered a memory which temporarily holds externally provided data, the nonvolatile memory or static memory can be used. That said, a simply arrange capacitor is preferably used due to a short data holding period.

The electro-optic element used in the present invention includes a liquid crystal element and other elements, such as an element formed by a self-luminous element and an active element, attached to the self-luminous element, for driving the self-luminous element.

Especially, when liquid crystal is used as the electro-optic element, since the liquid crystal itself is a capacitor, the liquid crystal can double as the potential maintaining means. In this case, the potential maintaining means is not necessarily visible.

Further, when an arrangement in which an active element is attached to a self-luminous element to drive the self-luminous element is used as the electro-optic element, since there is also a stray capacitance between the active element and the potential maintaining means, such a case is conceivable that the potential maintaining means itself is a stray capacitance. In that case, the potential maintaining means is not necessarily visible.

A TFT element used in liquid crystal displays is also used in the active element.

That arrangement is recognizable with a TFT substrate before it is fabricated in a display. A display substrate is obtained by building an electro-optic element into a specified electrode on the substrate.

The first means in accordance with the present invention is useful in an arrangement in which there are provided multiple electro-optic elements on a display substrate. The arrangement to send data to the memory means and the potential maintaining means corresponding to the multiple electro-optic elements from the outside of the display substrate can be divided into two categories: a method of providing a wire for each piece of the memory means and potential maintaining means and another method of providing the memory means or potential maintaining means to a single wire.

According to the latter method, a new switching element is needed between the wire and the memory means or potential maintaining means. A typical example of such an arrangement is matrix arrangements.

Specifically, multiple first wires (data lines or source lines) and multiple second wires (scan line or gate line)

arranged to cross the first wire are formed on a display substrate, the electro-optic element, memory means, and potential maintaining means are arranged near intersections of the first wires and the second wires, and first switching elements provided between the first wires and the memory means and the potential maintaining means.

The first switching element has a three-terminal arrangement like a TFT and is arranged so as to be connected at the first terminal (source terminal) thereof to the foregoing first wire, at the second terminal (drain terminal) directly or indirectly to the electro-optic element, the memory means, and the potential maintaining means, and at the third terminal (gate terminal) to the foregoing second wire.

The arrangement can be varied greatly depending on how the second terminal (drain terminal) of the first switching element is connected to the electro-optic element, the memory means, and the potential maintaining means.

Specifically, what we suggest as the first arrangement is an arrangement in which a first switching element is provided to each electro-optic element. The first terminal (source terminal) of the first switching element is connected to a first wire (data line), and the second terminal (drain terminal) of the first switching element is electrically connected to memory means, such as a memory element. Further, the second terminal (drain terminal) of the first switching element is electrically connected to potential maintaining means, such as a capacitor element, and the second terminal (drain terminal) of the first switching element is connected to an electro-optic element.

In this context, electrical connecting the second terminal (drain terminal) of the first switching element to memory means, such as a memory element, is defined as connecting the memory means, such as a memory element, and the second switching element in series and further to the second terminal (drain terminal) of the first switching element. In this case, when the memory means is a static memory element, the second switching element is preferably interposed between the second terminal (drain terminal) of the first switching element and the memory means. Further, when the memory means is a capacitor containing a ferroelectric memory, the memory means may be interposed between the first switching element and the second switching element.

Further, the electric connection of the second terminal (drain terminal) of the first switching element to potential maintaining means, such as a capacitor element, is divided into two cases, in one of which the third switching element is connected in series as with the memory means and in the other of which (in a case that the potential maintaining means is a capacitor) the connection is direct without no third switching.

The former arrangement, in which the potential of the potential maintaining means is never charged up due to the potential of the memory means, is effective in reducing power consumption. The latter does not require the provision of the third switching element and thereby offers more space to accommodate other elements by just that much.

In the arrangement, either voltage or current is generated based on outputs from the memory element and the potential maintaining means and supplied to the electro-optic element to produce a display.

In this case, the outputs from the memory means or the potential maintaining means can be switchably selected using the second switching element, the third switching element, etc. to generate the voltage or current to be supplied to the electro-optic element for switching between a gray-scale display, a multiple video display, etc.

To display multiple tones in that case, a time-ratio gray-scale display method can be employed whereby outputs from the memory means or the potential maintaining means are supplied to the electro-optic element for a period that is in direct proportion to the weight of bits of the data held to the memory means or the potential maintaining means.

Further, without using the time-ratio gray-scale display, voltage or current can still be generated which is in direct proportion to the weight of bits of the data held to the memory means or the potential maintaining means for output to the electro-optic element.

What we suggest as the second arrangement is an arrangement in which the first switching element is provided in such a way to correspond to the memory means and the fourth switching element is provided in such a way to correspond to the potential maintaining means. Further, the first terminal (source terminal) of the first switching element is connected to a first wire (data line), and the second terminal (drain terminal) of the first switching element is connected to memory means, such as a memory element. The first terminal (source terminal) of the fourth switching element is connected to the first wire (data line), and the second terminal (drain terminal) of the fourth switching element connected to potential maintaining means, such as a capacitor element.

In the arrangement, as in the foregoing case, either voltage or current is generated based on outputs from the memory element and the potential maintaining means and supplied to the electro-optic element to produce a display.

In this case, to switch between the outputs from the memory means or the potential maintaining means and generate the voltage or current to be supplied to the electro-optic element to produce a gray-scale display and multiple video displays, there is needed a fifth switching element between the memory means and the potential maintaining means and the electro-optic element.

To display multiple tones in that case, a time-ratio gray-scale display method can be employed whereby outputs from the memory means or potential maintaining means are supplied to the electro-optic element for a period that is in direct proportion to the weight of bits of the data held to the memory means or the potential maintaining means.

Further, without using the time-ratio gray-scale method, voltage or current can still be generated which is in direct proportion to the weight of bits of the data held to the memory means or the potential maintaining means for output to the electro-optic element.

The electro-optic element may be a liquid crystal element or an arrangement in which a self-luminous element and an active element (TFT element) are connected in series between the power source and the ground.

The first means in accordance with the present invention, which is capable of reducing power consumption by great amounts when applied to a display using memory elements, is preferably used as a self-luminous element in a device, such as an organic LED display, which boasts a high light emitting efficiency.

In this manner, to achieve the first objective by way of use of the first means in accordance with the present invention, a display in accordance with the present invention operates by a method of driving a display including electro-optic elements which, as a result of application of voltage to pixels arranged for each scan line only for a time corresponding to the tone in a horizontal scanning period for each frame period, change electro-optically by an amount corresponding to a tone of data to be displayed and produce a display from the data for that frame period, and the method can be arranged so that: first, second, and third periods are specified in one frame period in this order; a data holding period is specified before the third period in one frame period; a voltage is applied to the electro-optic elements only for a time corresponding to the data of the largest tone (largest weight bit) in the first period; the first memory element is caused to hold the largest tone data in the data holding period; a voltage is applied to the electro-optic elements only for a time corresponding to the data less than the largest tone in the second period; and a voltage is applied to the electro-optic elements only for a time corresponding to a remaining time in the largest tone data held by the first memory element in the third period.

According to the arrangement, the voltage for the largest tone data is divided into parts and applied over multiple times which exist before and after a voltage application period for the data less than the largest tone in one frame period. In the operation, the first voltage applied to the electro-optic element in regard of the largest tone data is held by the first memory element, and voltages for second and successive applications are supplied not externally, but from the first memory element.

Therefore, by holding large bit-weight data for each pixel in the second period, displays can be produced in the third period from the large bit-weight data without carrying out display scanning. As a result, display scanning does not need to be carried out for each display, and the development of moving picture breakups can be suppressed.

A driving method, presented as an example of the time-ratio gray-scale method using the first means in accordance with the present invention, is a method of driving a display including electro-optic elements which, as a result of application of voltage to pixels arranged for each scan line only for a time corresponding to the tone of the data to be displayed in a horizontal scanning period for each frame period, changes electro-optically by an amount corresponding to the tone and produces a display from the data corresponding to the frame period and can be arranged so that one frame period is divided into m unit periods, and each unit period is divided into K selection periods, where m is the number of scan lines and K is the number of tone bits displayed by each pixel, and also that, when the data in the electro-optic elements of pixels on the scan line is rewritten in a horizontal scanning period, the j-th bit data is supplied to an electro-optic element at a timing of the p-th selection period in a certain unit period N(j) for each j, and the K-th bit data is supplied to the first memory element at a timing of the p(K)-th selection period in a certain unit period N(K) and thereafter supplied to the electro-optic element from the first memory element, where j is a positive integer less than K, and p(j) (j=1, 2, 3, . . . , K−1), as well as p(K), are mutually different, positive integers not more than K.

According to the arrangement, the data for the largest tone (largest weight bit) is supplied to the first memory element at a timing of a certain selection period in a certain unit period in one frame period, and thereafter, the voltage for the largest tone data held by the first memory element is applied to the electro-optic element. In other words, the voltage for the largest tone data is held by the first memory element, and when the voltage applied to the electro-optic element, the voltage is supplied not externally, but from the first memory element.

Therefore, by holding large bit-weight data for each pixel, displays of the large bit-weight data can be produced without carrying out display scanning. As a result, display scanning does not need to be carried out for each display, and the development of moving picture breakups can be suppressed.

Further, in a time-ratio gray-scale method using the first means in accordance with the present invention, an arrangement is preferable in which there is provided a sixth switching element between the potential maintaining means and the OFF brightness setting wire.

When the potential maintaining means is directly connected to the electro-optic element (not via a switching element), in the first arrangement, the potential maintaining means changes according to the voltage read from the memory means and thereby controls the voltage or current applied to the electro-optic element. Accordingly, using the sixth switching element, the potential of the potential maintaining means is specified to an OFF brightness potential.

Further, even when the potential maintaining means is connected to the electro-optic element via a switching element, due to the presence of a stray capacitance, it is similarly preferable to use the sixth switching element to specify the potential of the stray capacitance to an OFF brightness potential.

By thus releasing the electric charge held in the potential maintaining means and the stray capacitance by the use of the sixth switching element, the duration of the voltage corresponding to the largest tone data being applied to the electro-optic element can be adjusted in accordance with the weight of the largest tone.

According to the driving method described above, only the data for the largest bit is stored in the memory provided to the pixel. The amounts of developed moving picture breakups is in direct proportion to the weight of that undivided largest bit. Therefore, dividing only the largest bit will result the development of moving picture breakups for the weight of a next bit.

Accordingly, in the present invention, the time-ratio gray-scale display is preferably performed by using as many memories provided to the pixels as possible.

Further, the first means in accordance with the present invention is not only effective with the time-division tones. The first means in accordance with the present invention can produce a gray-scale display of more bits than the memories provided to the pixels which are the second objective of the present invention.

The first arrangement as the foregoing gray-scale display method is such that multiple voltages can be applied to the electro-optic element which is an objective by providing multiple capacitors and controlling the voltage applied to a terminal of each capacitor between binary values, for example, a power source voltage and the ground potential, using the memory element or the potential maintaining means.

According to an example of such a method, when the electro-optic element is a liquid crystal element, one of the two terminals is connected to an opposite electrode, while the other terminal is connected to the multiple capacitors, outputs from the memory means and the potential maintaining means are used to control the voltage applied to a terminal of each of the capacitors to a value which is equal to an opposite voltage or another value, and the voltage applied to the liquid crystal is varied in many stages.

When a liquid crystal is driven in this manner, moving picture breakups cannot develop theoretically due to slow response of liquid crystal, since even with a voltage applied in a time-ratio manner, the display shows a display state corresponding to the mean voltage. Specifically, when means 1 in accordance with the present invention is to be applied to a liquid crystal, the objective is not to suppress moving picture breakups, but to produce a display of an increased number of tones by the use of the limited number of memories provided to the pixels.

Alternatively, for example, the current through electro-optic elements can be controlled by using a capacitor in place of the liquid crystal element and applying the voltage to a TFT (active element) for supplying current to self-luminous elements (organic LED display).

Further, the current supplied to the self-luminous elements (organic LED display) can be varied in many stages by providing TFTs (active elements) for supplying current to the self-luminous elements (organic LED display) and binary-controlling the TFTs based on outputs from the memory means and the potential maintaining means.

In this case, since the response of the organic LED display is fast, the current supplied in a time-ratio manner results in the development of moving picture breakup; however, even in this case, as well as an objective to suppress first moving picture breakup can be achieved, an objective to produce a display in an increased number of tones by means of a limited number of memories provided to the second pixels is achieved.

Further, means in accordance with the present invention is a display including pixel electrodes connected to electro-optic elements, such as liquid crystal display elements or self-luminous elements (organic LED display), and first memory elements for applying voltage to the pixel electrodes, and an arrangement can be made so that the power source voltage for the electro-optic element and the On-Off voltage to be applied to the first memory element as a signal to determine the On- and Off-periods of the application of voltage to the electro-optic element are supplied from different power sources.

According to the arrangement, the power source voltage for the electro-optic element and the On-Off voltage to be applied to the first memory element are supplied from different power sources. Therefore, a change in the power source voltage of the electro-optic element does not cause a change in the voltage to be applied to the first memory element. Therefore, in addition to the effects of the above arrangement, in the relationship between the gate voltage V of an element, such as a driver TFT, for driving the first memory element and the current I through the electro-optic element, such as a self-luminous element in an organic LED display or the like, changes in V-I characteristics can be suppressed, and especially, stable brightness characteristics become available with self-luminous elements.

Further, a display in accordance with the present invention is used in a method of driving the display and preferably includes a second memory element for converting externally provided data to data for the pixels scanned a line at a time.

According to the arrangement, the bit data coming in pixel by pixel can be transmitted directly from the second memory elements to pixels in parallel for data for each line at a timing required by the driving method. Further, thanks to the provision of a control circuit required by the data conversion, the driving method can be used without paying too much attention. Further, directly writing from a second memory element, such as a SRAM, to the pixel memory eliminates the need to serially transmit data from the second memory element to a signal line driver (SEG driver). Therefore, in addition to the effects of the arrangement, when compared to transmission via a signal line driver, labor and electric power to transmit data from a SRAM or the like to a signal line driver can be saved, and energy can be saved for that much; the overall power consumption by the display can be reduced.

In conventional liquid crystal displays and other similar displays, input video data was analog data. This is presumably the reason why even recently, an arrangement is popular in which digital data is input together with bit data corresponding to the number of displayed tones for each pixel. The same arrangement is applied to the data transmission from a CPU to a video RAM. Meanwhile, in the case of time-division tones in which the first objective of the present invention occurs, a round of display scanning is carried out for each bit; therefore, the input data coming in pixel by pixel must be converted to data which can be used in a time-division display whereby a display is produced bit by bit.

Accordingly, in means 2 in accordance with the present invention, for the data conversion, second memory elements (a memory array) which correspond to the arrangement of the electro-optic elements of the display screen can be provided outside the display region (pixel).

In an arrangement in which data for one pixel is written to the second memory element at random from the outside of the display by means of a CPU, the number of the memories provided in the memory array preferably corresponds to the number of tones to be displayed by each electro-optic element.

However, in the case of an input signal serially transmitting data for one line from the outside of the display, it is preferable if the data for one line is held in, for example, a line memory and the bit data of the associated pixel is stored divided between the first memory element provided to that pixel and the second memory element provided outside the pixel (display region).

The arrangement achieves the third objective of the present invention.

Specifically, the number of the second memory elements provided outside the pixels (display region) can be reduced by the number of the first memory elements provided to the pixels, and the display can produce the same number of tones from input data, but with a smaller substrate size.

In this case, as with the first memory element provided to the pixel, the data of the second memory element provided outside the pixel (display region) is reflected in the display by the electro-optic element by acquiring the data into the potential maintaining means provided to the pixel in a time-ratio manner.

Further, in the arrangement, A-bit memory elements are provided in the pixel and B-bit memory elements are provided outside the pixel; therefore, a total of (A+B) bits of display data exists. Not all the memory elements can hold independent data, but multiple video images can also be recorded using the display data.

For example, supposing that among the (A+B) bits, a bit is used to transmit data and cannot hold independent data, if the remaining (A+B−1) bit data is used, and the video data is 1 bit for each electro-optic element, a video image can be selected from (A+B−1) video images to produce a video display without newly acquiring data from the outside.

This means that a display can be produced with no action (no activation) of a CPU or another similar circuit outside the display. Since this means that the portable terminal or the like can display a simple, animated standby screen image and the like within the range of the (A+B−1) bits, the arrangement is useful with such portable terminal devices.

Further, when a self-luminous element is used as an electro-optic element, if such a function to reduce power consumption is to be exploited, the function is usefully implemented on an organic LED display with a high light emitting efficiency.

As mentioned above, by employing the arrangement in accordance with the present invention in which the pixel has memory means (memory) and potential maintaining means (capacitor), more tones can be displayed than the memories provided to pixels. Further, by producing a display by switching between the multiple memories provided to the pixels, a display can be produced by switching between multiple video images even without newly obtaining data from the outside. Further, the voltage corresponding to the largest tone data is held by the first memory element, and the voltage is applied by dividing the voltage application time for the data to partly solve the problem of moving picture breakups.

Further, employing the aforementioned memory elements enables driving even in such cases where driving was impossible conventionally and thus offers a ground for development of new driving methods.

Especially this potential maintaining means arranged so that the pixel has memory means (memory) and potential maintaining means (capacitor) is suitable to time-ratio gray-scale displays.

Using a display in accordance with the present invention, an arrangement becomes possible in which the first, second, and third periods are specified in this order in a single frame period, a data holding period is specified before the third period in a single frame period, a voltage corresponding to the data for the largest tone (the largest weight bit) is applied to the electro-optic element in the first period, the largest tone data is held by the first memory element in the data holding period, a voltage is applied to the electro-optic element only for a time corresponding to the data less than the largest tone in the second period, and a voltage is applied to the electro-optic element only for a time corresponding to the remaining time of the largest tone data held by the first memory element in the third period.

Thus, by holding large bit-weight data for each pixel in the second period, displays can be produced in the third period from the large bit-weight data without carrying out display scanning. As a result, display scanning does not need to be carried out for each display, and the development of moving picture breakups can be suppressed.

Further, more tones can be displayed than the memories provided to the pixels, which contributes to improvement of display quality.

Further, a method of driving a display in accordance with the present invention can be arranged so that one frame period is divided into m unit periods, and each unit period is divided into K selection periods, where m is the number of scan lines and K is the number of tone bits displayed by each pixel, and also that, when the data in the electro-optic elements of pixels on the scan line is rewritten in a horizontal scanning period, the j-th bit data is supplied to an electro-optic element at a timing of the p-th selection period in a certain unit period N(j) for each j, and the K-th bit data is supplied to the first memory element at a timing of the p(K)-th selection period in a certain unit period N(K) and thereafter supplied to the electro-optic element from the first memory element, where j is a positive integer less than K, and p (j) (j=1, 2, 3, . . . , K−1) as well as p(K), are mutually different, positive integer not more than K.

Accordingly, by holding large bit-weight data for each pixel, displays can be produced from large bit-weight data without carrying out display scanning. Therefore, the development of moving picture breakups can be suppressed without carrying out display scanning for each display.

Further, a display in accordance with the present invention can be arranged so that there is provided a sixth switching element between the potential maintaining means and the OFF brightness setting wire.

In addition to this arrangement, the foregoing arrangement can be adapted so that the voltage corresponding to the largest tone data held by the first memory element is temporarily held by the potential maintaining means before being applied to the electro-optic element.

By causing the potential maintaining means to discharge the stored electric charge using the sixth switching element, the time duration when the voltage corresponding to the largest tone data is being applied to the electro-optic element can be adjusted according to the weight of the largest tone.

Further, a display in accordance with the present invention can be arranged so that there are provided a pixel electrode connected to an electro-optic element, such as a liquid crystal display element, and a first memory element for applying voltage to the pixel electrode and that the On- and Off-voltages applied to the first memory element as a signal to determine On- and Off-periods for the power source voltage for the electro-optic element and the application of voltage to the electro-optic element are supplied from separate power sources.

Thus, a change in the power source voltage for the electro-optic element does not cause a change in the voltage applied to the first memory element. Therefore, on top of the effects of the foregoing arrangement, stable brightness characteristics can be obtained.

Further, a display in accordance with the present invention includes the foregoing arrangement and is adapted so that a display is produced from data by scanning of pixels line by line and that there is provided a second memory element for directly transmitting data for a line serially to the pixels.

Directly writing from the second memory element to the pixel memory in this manner eliminates the need to serially transmit data from the second memory element to a signal line driver. Therefore, in addition to the effects of the foregoing arrangement, labor and electric power to transmit data to the signal line driver can be saved, and the overall power consumption by the display can be reduced.

Further, the first memory element provided to the pixel, in combination with the second memory element provided outside the pixel (display region), can record data with required tones. Therefore, more tones can be displayed than the first memory elements provided to the pixels, and a video image can be selectively displayed from two or more video images without obtaining data from the outside.

Further, since the memory is partly provided to the pixel, the number of the second memory elements provided outside the pixel (display region) can be reduced. As a result of this, the memory can be accommodated in a smaller area, and required amount of data can be recorded on a substrate of smaller size. This leads to an increased number of panels being cut out from a single glass substrate and reduced costs of the panel.

Further, a panel having a display region of the same size can be fabricated with smaller dimensions. In addition, the display consumes less power due to the video display produced only from the data stored in the panel. Especially, within the range of the memory provided to the panel, multiple video images can be displayed by switching without energizing an external device, such as a CPU, and considerable power consumption reducing effects are expected.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A display, comprising:

electro-optic elements; and memory means and potential maintaining means both provided for each of the electro-optic elements, wherein:

a display operation by the electro-optic elements is controlled using outputs from the memory means and the potential maintaining means;

the electro-optic elements are provided near intersections of first wires and second wires provided in a direction crossing the first wires, the display further comprising:

first switching element for each pixel, each first switching element being electrically connected at a first terminal thereof to one of the first wires; and second switching element for each pixel, each second switching element being electrically connected in series with the memory means and a second terminal of the first switching element, wherein, for a given pixel in the display, the second terminal of the corresponding first switching element is electrically connected to the potential maintaining means.

2. The display as set forth in claim 1, further comprising: third switching element for each pixel, each third switching element being electrically connected in series with the potential maintaining means.

3. The display as set forth in claim 1, wherein the memory means is connected to a switching element which switches between an output from the memory means and an output from the potential maintaining means.

4. The display of claim 1, wherein the outputs from the memory means and/or the potential maintaining means are supplied to the electro-optic elements for a period corresponding to a weight of data stored in the memory means and/or the potential maintaining means.

5. The display of claim 4, wherein the potential maintaining means is a liquid crystal element including liquid crystal material sandwiched between at least first and second opposing electrodes.

6. The display as set forth in claim 1, wherein the electro-optic elements produce a display based on a voltage corresponding to a weight of data stored in the memory means or the potential maintaining means.

7. The display as set forth in claim 1, wherein the electro-optic elements produce a display based on a current corresponding to a weight of data stored in the memory means or the potential maintaining means.

8. The display of claiim 1, further comprising sixth switching elements each interposed between the potential maintaining means and either a power source wire or a ground wire.

9. The display of claim 1, further comprising second memory means, provided outside a pixel area, for recording a signal from which the electro-optic elements produce a display.

10. The display as set forth in claim 9, wherein a display is produced from a signal recorded in the memory means and a signal supplied from the second memory means to the potential maintaining means.

11. The display as set forth in claim 9, wherein a display is produced from a signal recorded in the memory means and a signal supplied from the second memory means to the potential maintaining means by switching between multiple video images.

12. The display of claim 9, wherein the potential maintaining means is a liquid crystal element including liquid crystal material sandwiched between at least first and second opposing electrodes.

13. The display as set forth in claim 1, wherein the electro-optic elements are organic LED elements.

14. The display of claim 1, wherein the potential maintaining means is a liquid crystal element including liquid crystal material sandwiched between at least first and second opposing electrodes.

15. A display, comprising:

electro-optic elements; and memory means and potential maintaining means both provided for each of the electro-optic elements, wherein:

a display operation by the electro-optic elements is controlled using outputs from the memory means and the potential maintaining means;

wherein the electro-optic elements are provided near intersections of first wires and second wires provided in a direction crossing the first wires, the display further comprising:

first switching element for each pixel, each first switching element being electrically connected at a first terminal thereof to one of the first wires and electrically connected at a second terminal thereof to the memory means; and fourth switching element for each pixel, each fourth switching element being electrically connected at a first terminal thereof to one of the first wires and electrically connected at a second terminal thereof to the potential maintaining means.

16. The display as set forth in claim 15, further comprising fifth switching element for each pixel, each fifth switching element being interposed between one of the electro-optic elements and the memory means.

* * * * *